United States Patent [19]

Uram et al.

[11] 4,227,093

[45] Oct. 7, 1980

[54] SYSTEMS AND METHOD FOR ORGANIZING COMPUTER PROGRAMS FOR OPERATING A STEAM TURBINE WITH DIGITAL COMPUTER CONTROL

[75] Inventors: Robert Uram, East Pittsburgh, Pa.; Juan J. Tanco, Buenos Aires, Argentina

[73] Assignee: Westinghouse Electric Corp., Pittsburgh, Pa.

[21] Appl. No.: 391,406

[22] Filed: Aug. 24, 1973

Related U.S. Application Data

[63] Continuation of Ser. No. 247,887, Apr. 26, 1972, abandoned.

[51] Int. Cl.[2] ..... H02P 9/04

[52] U.S. Cl. ..... 290/40 R; 364/494; 60/660

[58] Field of Search ..... 290/40, 2; 60/105, 660–667; 235/151.21; 364/492, 494, 495

[56] References Cited

U.S. PATENT DOCUMENTS

| | | | |
|---|---|---|---|
| 3,325,650 | 6/1967 | Barnes | 290/2 |
| 3,382,671 | 5/1968 | Ehni | 290/40 |
| 3,552,872 | 1/1971 | Giros et al. | 290/40 X |
| 3,564,273 | 2/1971 | Cockrell | 290/40 |
| 3,588,265 | 6/1971 | Berry | 290/40 X |
| 3,609,384 | 9/1971 | Strohmeyer | 290/40 X |
| 3,614,457 | 10/1971 | Eggenberger | 290/40 |
| 3,619,931 | 11/1971 | Strohmeyer | 290/40 X |
| 3,643,437 | 2/1972 | Birnbaum et al. | 290/40 X |
| 3,782,113 | 1/1974 | Luongo | 290/40 X |

*Primary Examiner*—J. V. Truhe
*Assistant Examiner*—J. W. Redman
*Attorney, Agent, or Firm*—E. F. Possessky

[57] ABSTRACT

Steam flow and pressure conditions needed in a turbine to satisfy the speed and load demand of an electric power generating system are controlled by a programmed digital computer system during start-up, synchronization and operation. Manual backup control is provided for the computer control. An operator interface is provided with the computer through a panel and various communication devices.

43 Claims, 103 Drawing Figures

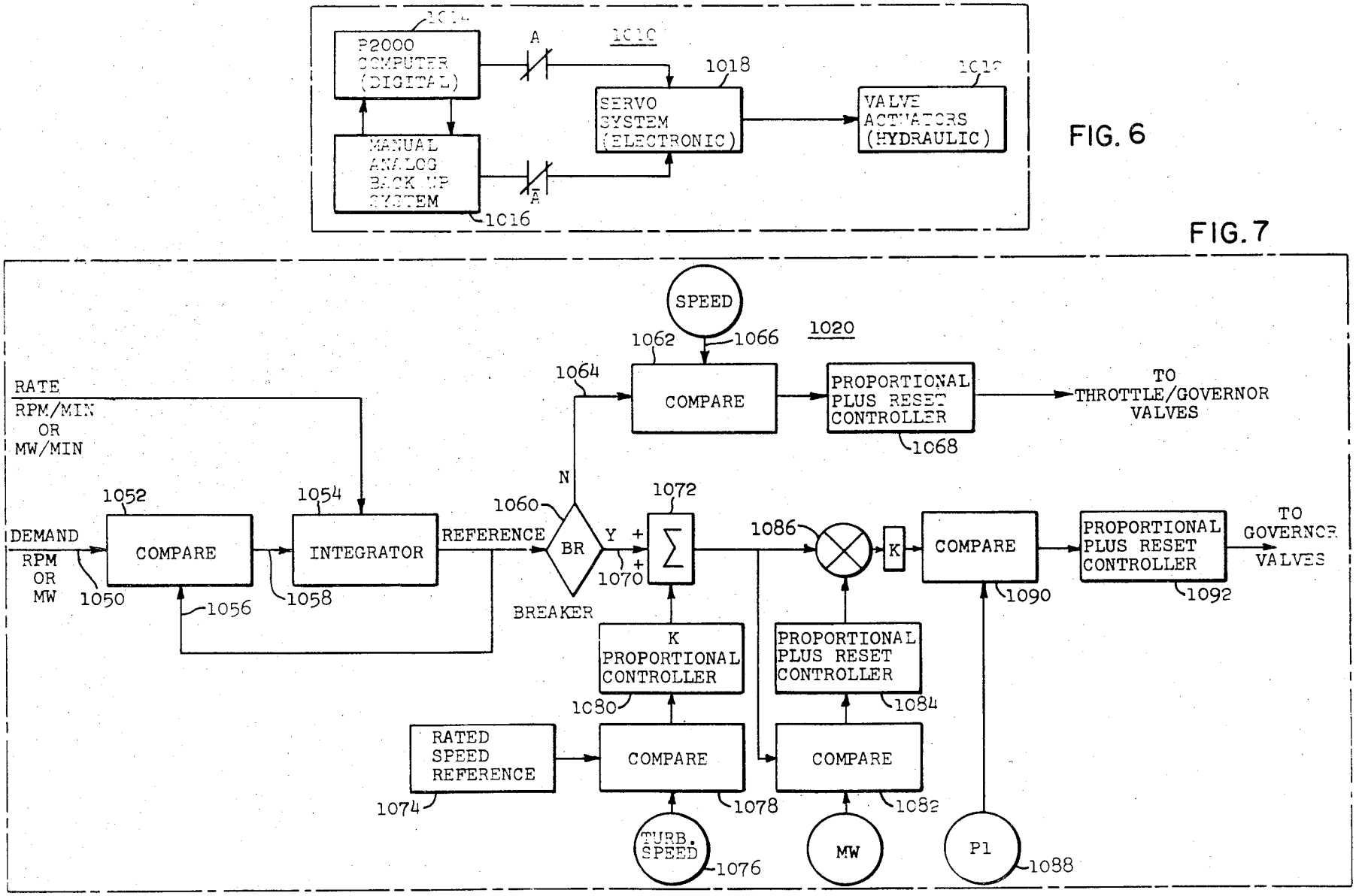
FIG. 6
FIG. 7
VALVE ACTUATORS (HYDRAULIC)
SERVO SYSTEM (ELECTRONIC)
P2000 COMPUTER (DIGITAL)
MANUAL ANALOG BACK UP SYSTEM
1018
1016
A
A
1020
TO THROTTLE/GOVERNOR VALVES
TO GOVERNOR VALVES
SPEED
COMPARE
PROPORTIONAL PLUS RESET CONTROLLER
PROPORTIONAL PLUS RESET CONTROLLER
COMPARE
P1
MW
COMPARE
PROPORTIONAL PLUS RESET CONTROLLER
K
K PROPORTIONAL CONTROLLER
COMPARE
TURB. SPEED
RATED SPEED REFERENCE
BR
BREAKER
REFERENCE
INTEGRATOR
COMPARE
RATE RPM/MIN OR MW/MIN
DEMAND RPM OR MW
N
Y
1050
1052
1054
1056
1058
1060
1062
1064
1066
1068
1070
1072
1074
1076
1078
1080
1082
1084
1086
1088
1090
1092

TABLE 1-1. TASK PRIORITY ASSIGNMENT

FIG. 9

| Level | Function | Frequency | Core Location |
|---|---|---|---|
| F | STOP/INITIALIZE | ON DEMAND | 2F40 |
| E | AUXILIARY SYNCHRONIZER | 0.1 SEC | 14BD |
| D | CONTROL | 1.0 SEC | 2730 |
| C | OPERATOR'S PANEL | ON DEMAND | 21B0 |
| B | ANALOG SCAN | 0.5 SEC | 16D0 |
| A | ATS-PERIODICS | 1.0 SEC | 4420 |
| 9 | LOGIC | ON DEMAND | 1962 |
| 8 | VISUAL DISPLAY | 1.0 SEC | 1E60 |
| 7 | DATA LINK | ON DEMAND | 3D10 |
| 6 | ATS-ANALOG CONVERSIONS | 5.0 SEC | 6960 |
| 5 | FLASH | 0.5 SEC | 15A0 |
| 4 | PROGRAMMER'S CONSOLE | ON DEMAND | 3000 |
| 3 | ATS-MESSAGE WRITER | 5.0 SEC | 6CA0 |
| 2 | ANALOG/DIGITAL TREND | 1.0 SEC | 3E70 |
| 1 | CCO TEST* | ON DEMAND | 0E80 |
| 0 | BATCH PROCESSORS** | ON DEMAND | 4000 |

*The CCO test task may be used only during maintenance and debugging periods, since this program overlays the data link program area.

**The batch processors may be used only on manual control and with the sync disabled; also, the sequence of events interrupt must be disabled since the batch processor programs overlay the ATS program area.

TABLE 1-2. CORE MAP 1—FINAL OPERATING VERSION

FIG. 10

| Starting Location | Program | Size | |
|---|---|---|---|
| | | Dec | Hex |
| 0 | FAM FAST ACCESS MEMORY | 32 | 20 |
| 20 | SEQUENCE OF EVENTS INTERRUPT | 32 | 20 |
| 40 | VALVE INTERRUPT | 96 | 60 |
| A0 | ZERO TABLE | 96 | 60 |
| 100 | SRI TABLE | 32 | 20 |
| 120 | PLANTCCI SUBROUTINE | 120 | 78 |
| 198 | SPEED CHANNEL 1 INTERRUPT | 47 | 2F |
| 1C7 | SPEED CHANNEL 2 INTERRUPT | 25 | 19 |
| 1E0 | CCO IMAGE TABLE | 32 | 20 |
| 200 | MONITOR | 3162 | C5A |
| E5A | MONITOR PATCHES | 6 | 6 |
| E60 | MONITOR SPARE | 32 | 20 |
| E80 | DATA LINK-SPARE TERMINAL | 16 | 10 |
| E92 | DATA LINK-DT INTERRUPT | 40 | 28 |
| EBA | DATA LINK-CONTROL WORDS | 10 | A |
| EC4 | DATA LINK-INPUT BUFFER | 10 | A |
| ECE | DATA LINK-OUTPUT BUFFER | 50 | 32 |
| F00 | SYSTEM LIBRARY | 618 | 26A |
| 116A | BREAKER OPEN INTERRUPT | 22 | 16 |

1610

1710

1850

1150

| Pushbutton | IPBX | Function |
|---|---|---|
| REF | 1 | Display REFERENCE in REF windows and DEMAND in DMD windows |
| ACCEL RATE | 2 | Display ACCELERATION RATE in REF windows and clear DMD windows |
| LOAD RATE | 3 | Display LOAD RATE in REF windows and clear DMD windows |
| LOW LIMIT | 4 | Display LOW LOAD LIMIT in REF windows and clear DMD windows |
| HIGH LIMIT | 5 | Display HIGH LOAD LIMIT in REF windows and clear DMD windows |
| VALVE POSITION LIMIT | 6 | Display VALVE POSITION LIMIT in REF windows and governor valve variable being limited in DMD windows |
| PARAMETER DISPLAY | 7 | Initiate display of internal control system variable; see operating instructions |
| VALVE STATUS | 8 | Initiate display of valve position; see operating instructions |

FIG. 31

NOTE: POS
1. DIFF. SUPERVISION OF TURNING GEAR OPERATION
REQUIRED EVERY 1 MINUTE

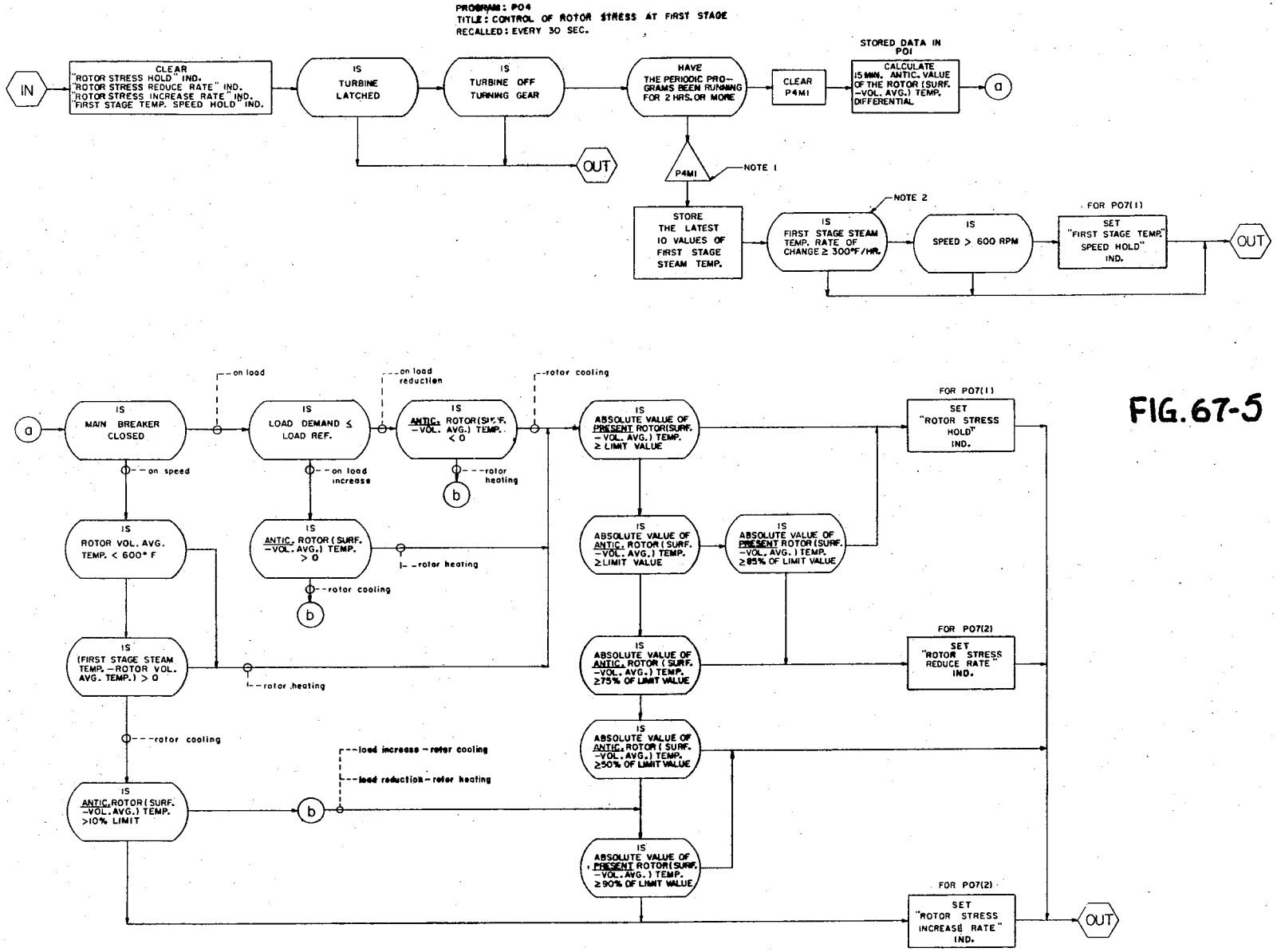
PROGRAM: P04
TITLE: CONTROL OF ROTOR STRESS AT FIRST STAGE
RECALLED: EVERY 30 SEC.
IN
CLEAR "ROTOR STRESS HOLD" IND. "ROTOR STRESS REDUCE RATE" IND. "ROTOR STRESS INCREASE RATE" IND. "FIRST STAGE TEMP. SPEED HOLD" IND.
IS TURBINE LATCHED
IS TURBINE OFF TURNING GEAR
OUT
HAVE THE PERIODIC PROGRAMS BEEN RUNNING FOR 2 HRS. OR MORE
P4M1
NOTE 1
CLEAR P4M1
STORED DATA IN P01
CALCULATE ANTIC. VALUE OF THE ROTOR (SURF.-VOL. AVG.) TEMP. DIFFERENTIAL
a
STORE THE LATEST 10 VALUES OF FIRST STAGE STEAM TEMP.
IS FIRST STAGE STEAM TEMP. RATE OF CHANGE ≥ 300°F/HR.
NOTE 2
IS SPEED > 600 RPM
FOR P07(1)
SET "FIRST STAGE TEMP. SPEED HOLD" IND.
OUT
FIG. 67-5
a
IS MAIN BREAKER CLOSED
on speed
IS ROTOR VOL. AVG. TEMP. < 600° F
IS (FIRST STAGE STEAM TEMP.-ROTOR VOL. AVG. TEMP.) > 0
rotor cooling
IS ANTIC. ROTOR (SURF.-VOL. AVG.) TEMP. >10% LIMIT
on load
IS LOAD DEMAND ≤ LOAD REF.
on load increase
on load reduction
IS ANTIC. ROTOR (SURF.-VOL. AVG.) TEMP. > 0
rotor cooling
b
IS ANTIC. ROTOR (SURF.-VOL. AVG.) TEMP. < 0
rotor heating
b
rotor heating
rotor cooling
IS ABSOLUTE VALUE OF PRESENT ROTOR (SURF.-VOL. AVG.) TEMP. ≥ LIMIT VALUE
FOR P07(1)
SET "ROTOR STRESS HOLD" IND.
IS ABSOLUTE VALUE OF ANTIC. ROTOR (SURF.-VOL. AVG.) TEMP. ≥ LIMIT VALUE
IS ABSOLUTE VALUE OF PRESENT ROTOR (SURF.-VOL. AVG.) TEMP. ≥85% OF LIMIT VALUE
IS ABSOLUTE VALUE OF ANTIC. ROTOR (SURF.-VOL. AVG.) TEMP. ≥75% OF LIMIT VALUE
FOR P07(2)
SET "ROTOR STRESS REDUCE RATE" IND.
IS ABSOLUTE VALUE OF ANTIC. ROTOR (SURF.-VOL. AVG.) TEMP. ≥50% OF LIMIT VALUE
load increase - rotor cooling
load reduction - rotor heating
b
IS ABSOLUTE VALUE OF PRESENT ROTOR (SURF.-VOL. AVG.) TEMP. ≥90% OF LIMIT VALUE
FOR P07(2)
SET "ROTOR STRESS INCREASE RATE" IND.
OUT

FIG. 67-8A

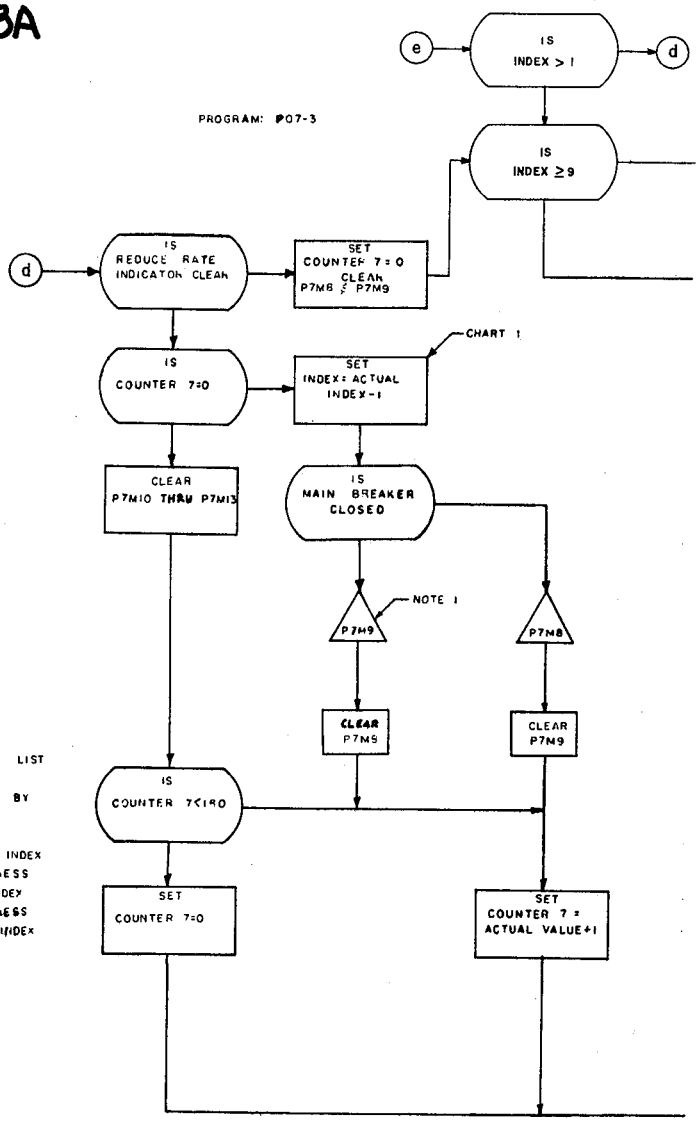

NOTES:

1. FOR PRINT MESSAGES REFER TO MESSAGE LIST DWG. NO.
2. INDEX IS SELECTED BY THIS PROGRAM NOT BY THE OPERATOR
3. TARGET SPEED REF. IS SELECTED BY P15
4. COUNTER#6 :IS USED TO INCREASE THE INDEX EVERY 3 MIN. BY ROTOR STRESS
   COUNTER#7 :IS USED TO REDUCE THE INDEX EVERY 3 MIN. BY ROTOR STRESS
   COUNTER#8 :IS USED TO INCREASE THE INDEX EVERY 5 MIN. BY DIFF. EXP.
5. LIGHT #4 TEXT = TURB. DECEL.
   LIGHT #5 TEXT = TURB. ACCEL.
   LIGHT #6 TEXT = SPEED HOLD
   LIGHT #7 TEXT = HOLD LOAD
6. TRIP IND'S. : VIBR. TRIP (P05)
   METAL TEMP. TRIP (P06)
   DIFF. EXP. TRIP (P02)
   BEARING METAL TEMP. TRIP (P08)

| | | EXPECTED GEN. STATOR COIL DISCH. GAS OR $H_2O$ TEMP. RISE = | GEN. STATOR COIL DISCHARGE GAS OR $H_2O$ RISE LIMIT = |
|---|---|---|---|
| HYDROGEN COOLED GENERATORS | WITH SINGLE VENT STATOR COILS 60 PSIG RATED GAS PRESSURE | $36\left(\frac{74.7}{14.7+PSIG}\right)\left(\frac{I_{SA}}{I_S}\right)^2$ | $40+\left(\frac{60-PSIG}{7.5}\right)$ |
| HYDROGEN COOLED GENERATORS | WITH DOUBLE VENT STATOR COILS 60 PSIG RATED GAS PRESSURE | $50\left(\frac{74.7}{14.7+PSIG}\right)\left(\frac{I_{SA}}{I_S}\right)^2$ | $55+\left(\frac{60-PSIG}{15}\right)$ |
| HYDROGEN COOLED GENERATORS | WITH DOUBLE VENT STATOR COILS 75 PSIG RATED GAS PRESSURE | $50\left(\frac{89.7}{14.7+PSIG}\right)\left(\frac{I_{SA}}{I_S}\right)^2$ | $55+\left(\frac{75-PSIG}{15}\right)$ |
| HYDROGEN COOLED GENERATORS | WITH WATER COOLED STATOR COILS 75 PSIG RATED GAS PRESSURE | $30\left(\frac{I_{SA}}{I_S}\right)^2$ | 35 |
| CONVENTIONALLY COOLED GENERATORS | | EXPECTED EMBEDDED STATOR COIL RTD RISE = $45\left(\frac{44.7}{18.7+RISE}\right)^{.68}\left(\frac{I_{SA}}{I_S}\right)^2$ | EMBEDDED STATOR COIL RTD RISE LIMIT = $50+\left(\frac{30-PSIG}{2}\right)$ |

CHART I
(SEE NOTE 2)

NOTE 2. $I_{SA}$ = ACTUAL GENERATOR STATOR CURRENT
$I_S$ = GENERATOR STATOR CURRENT AT RATED VOLTAGE AND RATED HYDROGEN PRESSURE
PSIG = ACTUAL GENERATOR HYDROGEN PRESSURE

FIG. 67-9

PROGRAM: PI1
TITLE: SUPERVISION OF DRAIN VALVES AND COMPUTATION OF ANTICIPATED DIFFERENTIAL EXPANSION
RECALLED: EVERY 1 MIN.

NOTES:
1. FOR PRINT MESSAGES REFER TO MESSAGE LIB
2. COUNTER 'D' IS CLEARED BY THE PROGRAM INITIALIZATION
3. THE LIMITS WILL BE SPECIFIED FOR EVERY TURBINE IN PO2

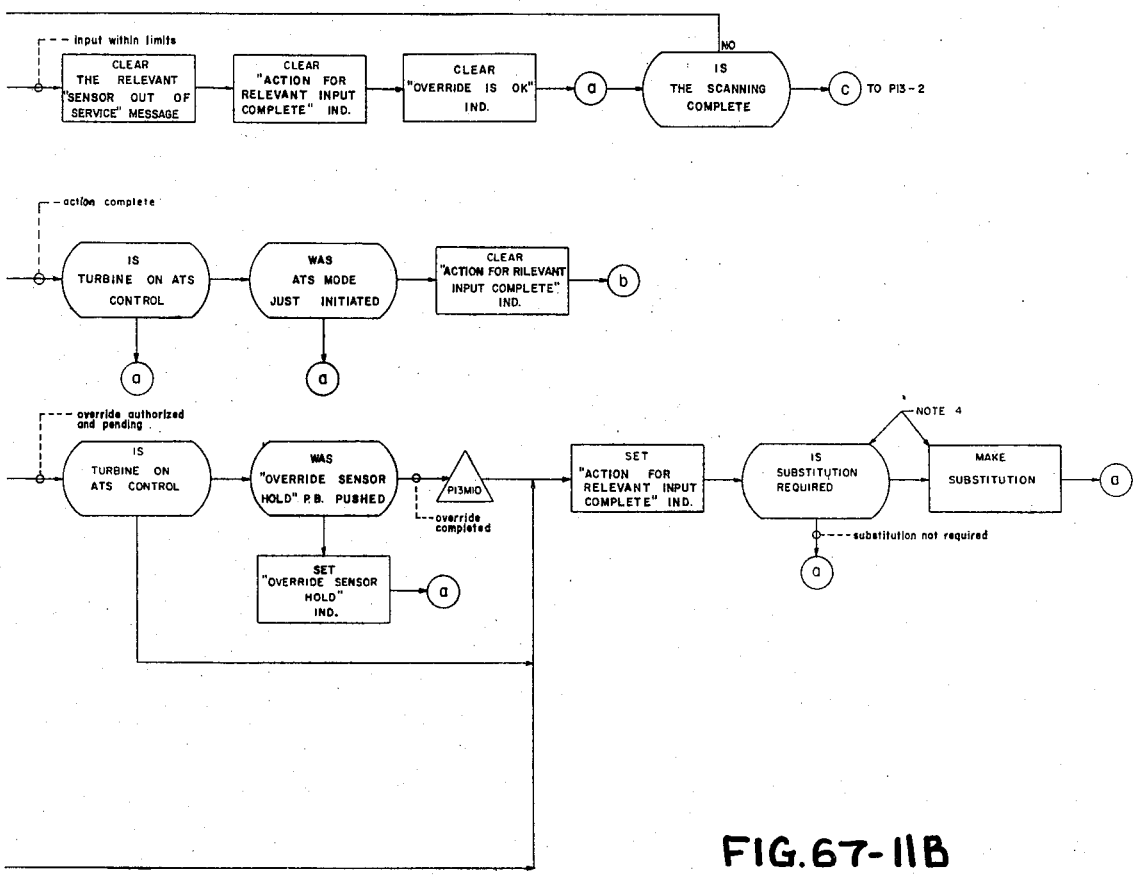

FIG. 67-11B

NOTES:

1. FOR PRINT MESSAGES REFER TO MESSAGE LIST
2. THE CORRESPONDING "SENSOR OUT OF SERVICE" MESSAGE WILL BE PRINTED OUT. (PI3M2, PI3M4, PI3M5, PI3M6, PI3M7, PI3M8, PI3M11, OR PI3M12)
3. VIDAR IS AN ANALOG TO FREQUENCY CONVERTER
4. REFER TO PI3 WRITE-UP
5. THE "ATS PERMISSIVE" IND. IS CLEARED TO REJECT THE ATS MODE WHEN A CRITICAL SENSOR HAS FAILED.
6. THIS INDICATOR IS ALSO USED TO LIGHT THE "OVERRIDE SENSOR HOLD" P.B.

NOTES:
1. FOR PRINT MESSAGES REFER TO MESSAGE LIST DWG. NO.
2. THIS INDICATOR IS SET BY THE BASE DEH PROGRAM

NO-LOAD AND LIGHT LOAD OPERATION GUIDE FOR REHEAT TURBINES

ATMOSPHERIC PRESS.=29.92
ABS=ATM+GAUGE

EXHAUST PRESSURE NOT TO EXCEED 2" Hga WHEN RUNNING

IF

OVERSPEED TEST.

Cond. Press. ≤ 1.92 in. HgA Temp 1 = 1000-(80 x Cond. Press. Abs.)
Cond. Press. > 1.92 in. HgA Temp 1 = 1150-(160 x Cond. Press. Abs.)

Cond. Press. ≤ 1.92 in. HgA Temp 2 = 1023-(33.3 x Cond. Press. Abs.)
Cond. Press. > 1.92 in. HgA Temp 2 = 1150-(100 x Cond. Press. Abs.)

CT-22596B

DIFFERENTIAL EXPANSION - GENERATOR END

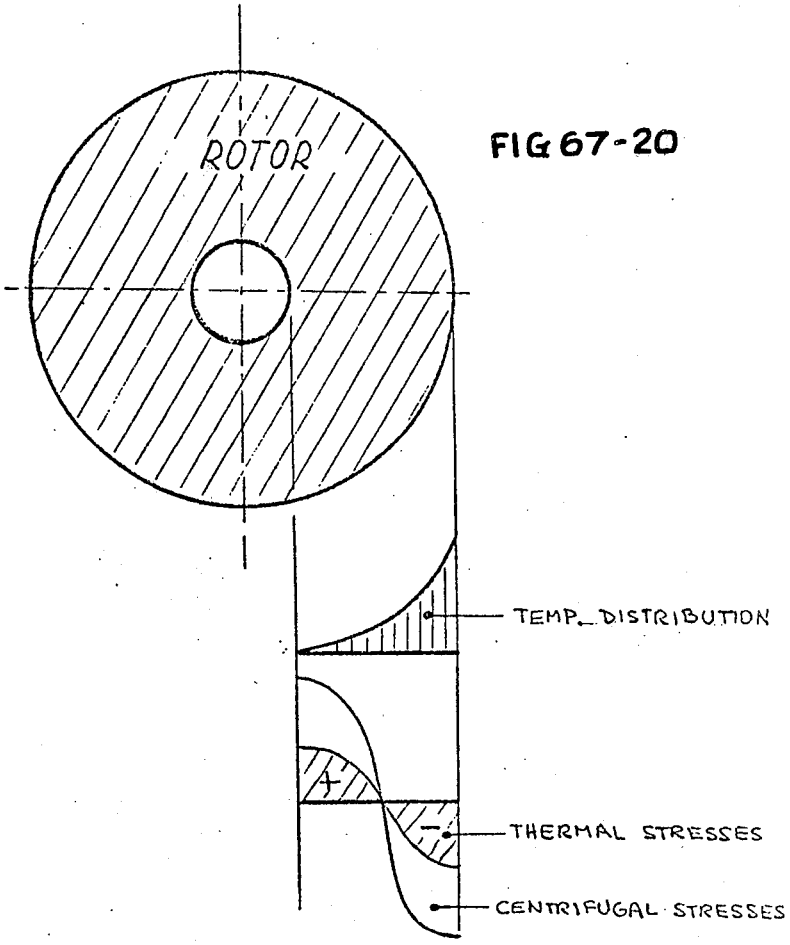
FIG 67-20
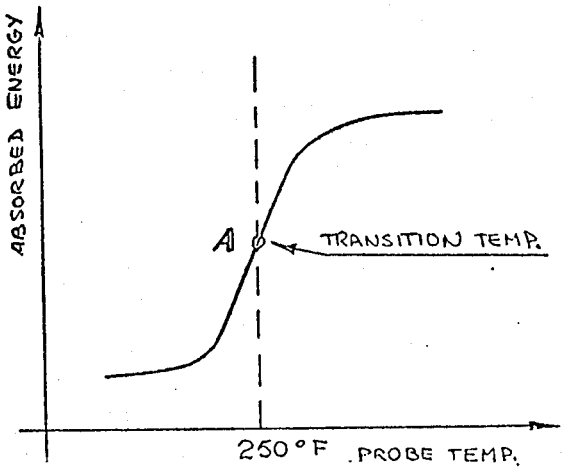

SYSTEMS AND METHOD FOR ORGANIZING COMPUTER PROGRAMS FOR OPERATING A STEAM TURBINE WITH DIGITAL COMPUTER CONTROL

This is a continuation, of application Ser. No. 247,887 filed Apr. 26, 1972, now abandoned.

BACKGROUND OF THE INVENTION

The present invention relates to the elastic fluid turbines and more particularly to systems and methods for operating steam turbines and electric power plants in which generators are operated by steam turbines.

With respect to steam turbine control, prime mover turbine control usually operates to determine turbine rotor shaft speed, turbine load, and/or turbine throttle pressure as end control system variables. In the case of large electric power plants in which throttle pressure is steam-generating system controlled, turbine control is typically directed to the megawatt amount of electric load and the frequency participation of the turbine after the turbine rotor speed has been controllably brought to the synchronous value and the generator has been connected to the electric power system.

In addition to the conventional steam turbine generating system, another type of power generating system in which steam turbine control is needed is a combined cycle generating system. The combined cycle generating system involves a combination of heat sources and energy conversion apparatus organized to produce an electric power output. For example, gas turbines can drive generators and use their exhaust gases to supply heat for steam to be used in driving a steam turbine. A separate boiler can also be included in the system to provide steam generating heat. Electric power is supplied by separate generators driven by the turbines.

The end controlled plant or plant system variables and the turbine operation are normally determined by controlled variation of the steam flow to one or more of the various stages of the particular type and particular design of the turbine in use. In prime mover turbine applications such as drum type boiler electric power plants where turbine throttle pressure is externally controlled by the boiler operation, the turbine inlet steam flow is an end controlled steam characteristic or an intermediately controlled system variable which controllably determines in turn the end control system variables, i.e., turbine speed, electric load or the turbine speed and the electric load. It is noteworthy, however, that some supplemental or protective control may be placed on the end control variable by additional downstream steam flow control such as by control of reheat valving and to that extent inlet turbine steam flow control is not strictly wholly controllably determinative of the end controlled system variables under all operating conditions.

In determining turbine operation and the end controlled system variables, turbine steam flow control has generally been achieved by controlled operation of valves disposed in the steam flow path or paths. To illustrate the nature of the turbine valve control in general and to establish simultaneously some background for subsequent description, consideration will now be directed to the system structure and the operation of a typical large electric power tandem steam turbine design for use with a fossil fuel drum-type boiler steam generating system.

Steam generated at controlled pressure may be admitted to the turbine steam chest through one or more throttle or stop valves operated by the turbine control system. Governor or control valves are arranged to supply steam inlets disposed around the periphery of a high pressure turbine section casing. The governor valves are also operated by the turbine control system to determine the flow of steam from the steam chest through the stationary nozzles or vanes and the rotor blading of the high pressure turbine section.

Torque resulting from the work performed by steam expansion causes rotor shaft rotation and reduced steam pressure. The steam is usually then directed to a reheat stage where its enthalpy is raised to a more efficient operating level. In the reheat stage, the high pressure section outlet steam is ordinarily directed to one or more reheaters associated with the primary steam generating system where heat energy is applied to the steam. In large electric power nuclear turbine plants, turbine reheater stages are usually not used and instead combined moisture separator reheaters are employed between the tandem nuclear turbine sections.

Reheated steam crosses over the next or immediate pressure section of a large fossil fuel turbine where additional rotor torque is developed as intermediate pressure steam expands and drives the intermediate pressure turbine blading. One or more interceptor and/or reheater stop valves are usually installed in the reheat steam flow path or paths in order to cut off or reduce the flow of turbine contained steam as required to protect against turbine overspeed. Reheat and/or interceptor valve operation at best produces late corrective turbine response and accordingly is normally not used controllably as a primary determinant of turbine operation.

Additional reheat may be applied to the steam after it exits from the intermediate section. In any event, steam would typically be at a pressure of about 1200 psi as it enters the next or low pressure turbine section usually provided in the large fossil fuel turbines. Additional rotor torque is accordingly developed and the vitiated steam then exhausts to a condenser.

In both the intermediate pressure and the low pressure sections, no direct steam flow control is normally applied as already suggested. Instead, steam conditions at these turbine locations are normally determined by mechanical system design subject to time delayed effects following control placed on the high pressure section steam admission conditions.

In a typical large fossil fuel turbine just described, 30% of the total steady state torque might be generated by the high pressure section and 70% might be generated by the intermediate pressure and low pressure sections. In practice, the mechanical design of the turbine system defines the number of turbine sections and their respective torque ratings as well as other structural characteristics such as the disposition of the sections or one or more shafts, the number of reheat stages, the blading and vane design, the number and form of turbine stages and steam flow paths in the sections, etc.

A variety of valve arrangements may be used for steam control in the various turbine types and designs, and hydraulically operated valve devices have generally been used for steam control in the various valving arrangements. The use of hydraulically operated valves has been predicated largely on their relatively low cost coupled with their ability to meet stroke operating power and positioning speed and accuracy requirements.

Turbine valve control and automatic turbine operation have undergone successive stages of development. With increasing plant sizes, mechanical-hydraulic controls have been largely supplanted by analog electrohydraulic controllers sometimes designated as AEH controllers. The Giras and Birnbaum patent application, Ser. No. 319,115 filed Dec. 29, 1972, provides a further description of the turbine control technology development and the earlier prior patent and publication art. The latter application discloses a programmed digital computer controller which generally provides improved turbine and electric power plant operation over the earlier prior art. U.S. Pat. No. 3,588,265 issued to W. Berry, entitled System and Method For Providing Steam Turbine Operation With Improved Dynamics, and assigned to the present assignee, is also directed to a digital computer controller which provides improved automatic turbine startup and loading operations. U.S. Pat. No. 3,552,872 issued to T. Giras and T. C. Barns, Jr. entitled Computer Positioning Control System With Manual Backup Control Especially Adapted For Operating Steam Turbine Valves, and assigned to the present assignee, discloses a digital computer controller interfaced with a manual backup controller. A general publication pertaining to turbine digital controllers has appeared in Electrical World Magazine.

At this point in the background writeup, it is noted that prior art citations are made herein in an attempt to characterize the context within which the presently disclosed subject matter has been developed. No representations are made that the cited art is the best art nor that the cited art is immune to alternative interpretations.

Generally, the earlier Berry and the earlier Giras and Birnbaum DEH turbine operating system comprise basic hardware and software elements and control loops which bear some similarity to a number of basic elements and loops described herein. However, the present disclosure involves improvements largely stemming from the combined application of principles associated with turbine technology and principles associated with the computer and control technologies in the determination of a particular detailed system arrangement and operation. Thus, the earlier DEH is largely directed to central control concepts which, although implementable with conventional know-how, open up opportunities for improvement-type developments related to the more central aspects of turbine control and operation as well as the more supportive aspects of turbine control and operation including areas such as turbine protection, remote system interfacing, accuracy and reliability, computer utilization efficiency, operator interface, maintenance and operator training.

SUMMARY OF THE INVENTION

The present system supplement, expands, and improves over the prior art. In doing so, the present system includes a series of specialized programs for controlling the turbine generator system easing synchronization of the generator to the line, monitoring a great number of various and different parameter signals and allowing for great facility of operator machine cooperation. Special programs monitor the control and monitoring systems whereby the reliability, safety, and flexibility of the system are greatly increased. Information, transmission and warning systems improve the ease of operation and usefulness of the present system over the prior art.

The present system provides for both automatic startup, simple synchronization, complete control and shutdown of the turbine generator system.

BRIEF DESCRIPTION OF THE DRAWINGS

FIG. 9 shows a table of program or task priority assignments in accordance with the principles of the invention;

DESCRIPTION OF DRAWINGS 2

Figure 1:
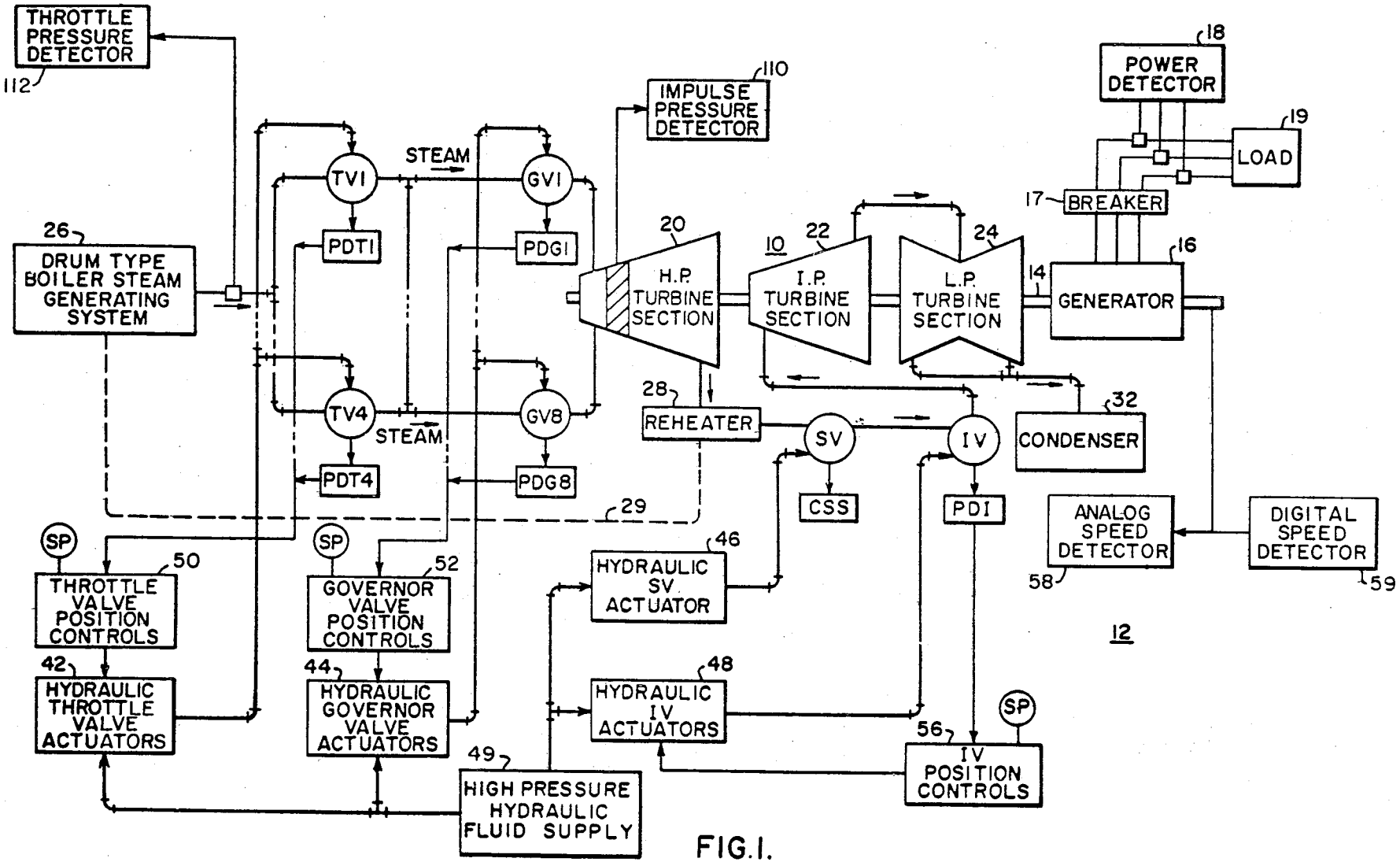
FIG. 1 shows a schematic diagram on an electric power plant including a large steam turbine and a fossile fuel fired drum type boiler and control devices which are all operable in accordance with the principles of the invention.
Figure 2:
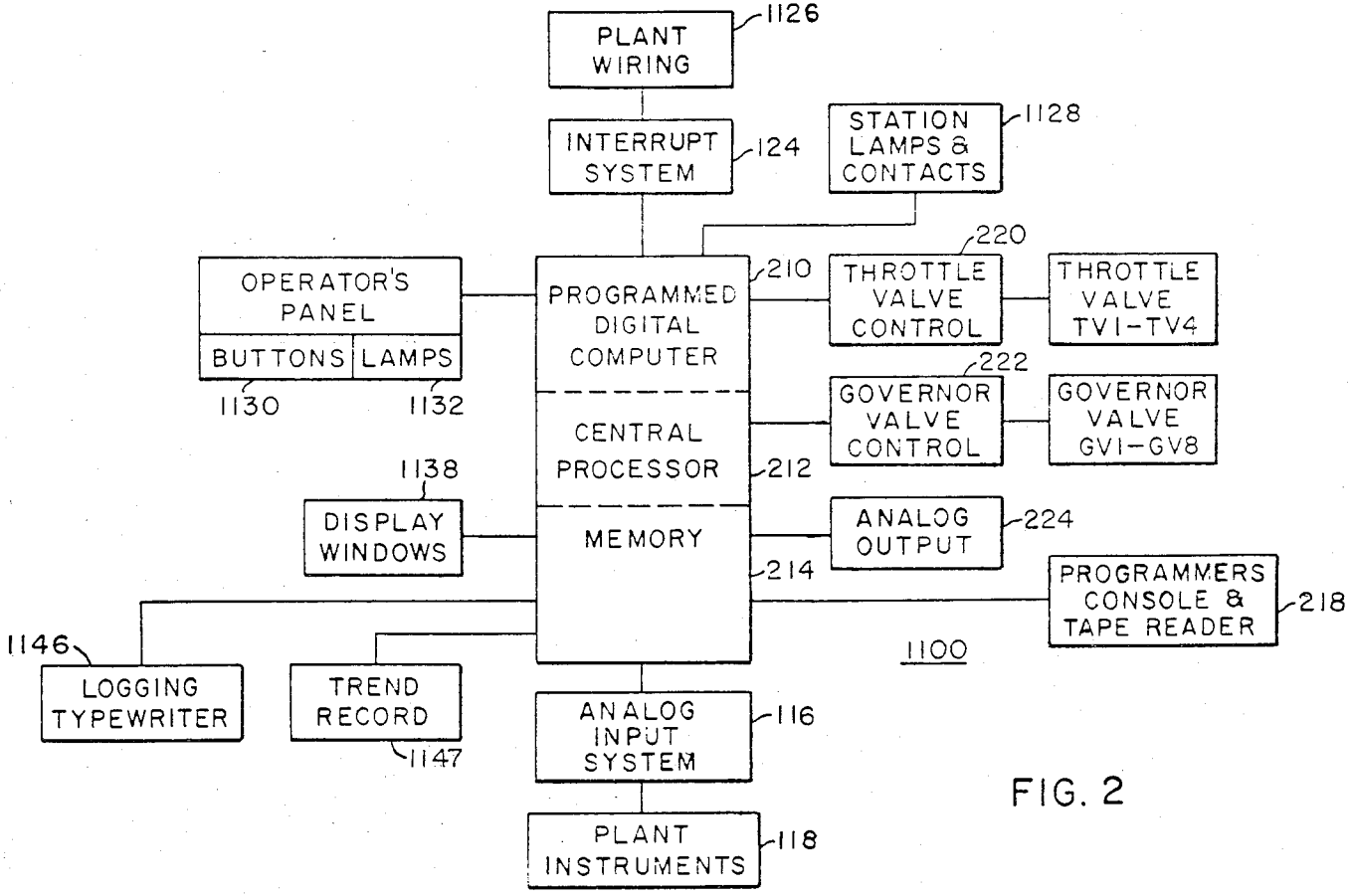
FIG. 2 shows a schematic diagram on a programmed digital computer control system operable with a steam turbine and its associated devices shown in FIG. 1 in accordance with the principles of the invention.
Figure 3:
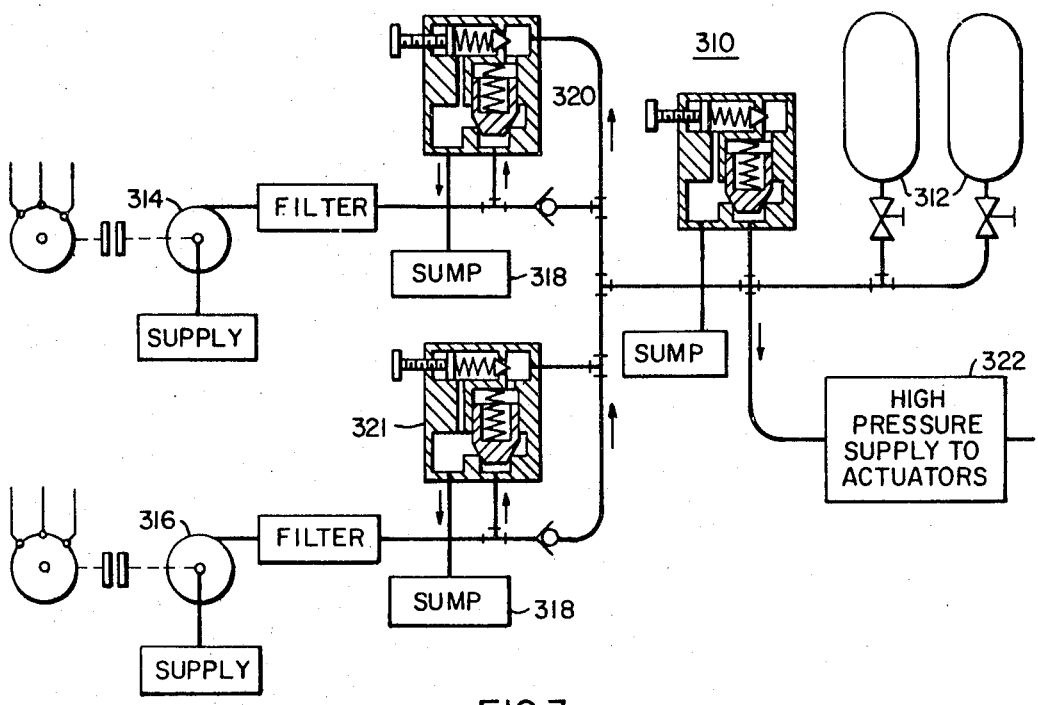
FIG. 3 shows a hydraulic system for supplying hydraulic fluid to valve actuators of the steam turbine.
Figure 4:
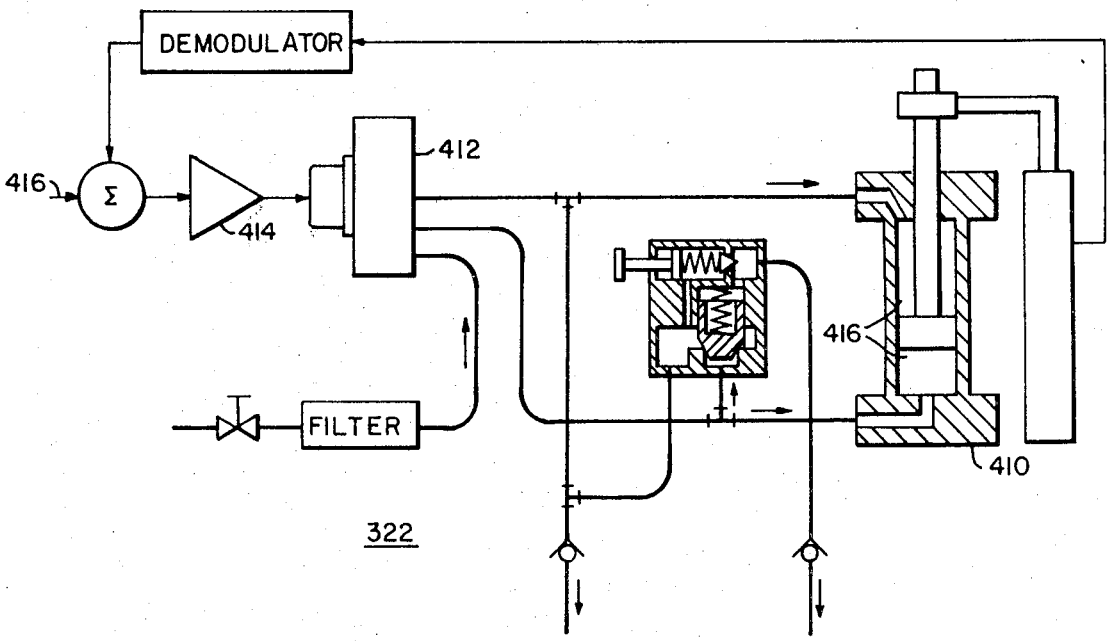
FIG. 4 shows a schematic diagram of a servo system connected to the valve actuators.
Figure 5:
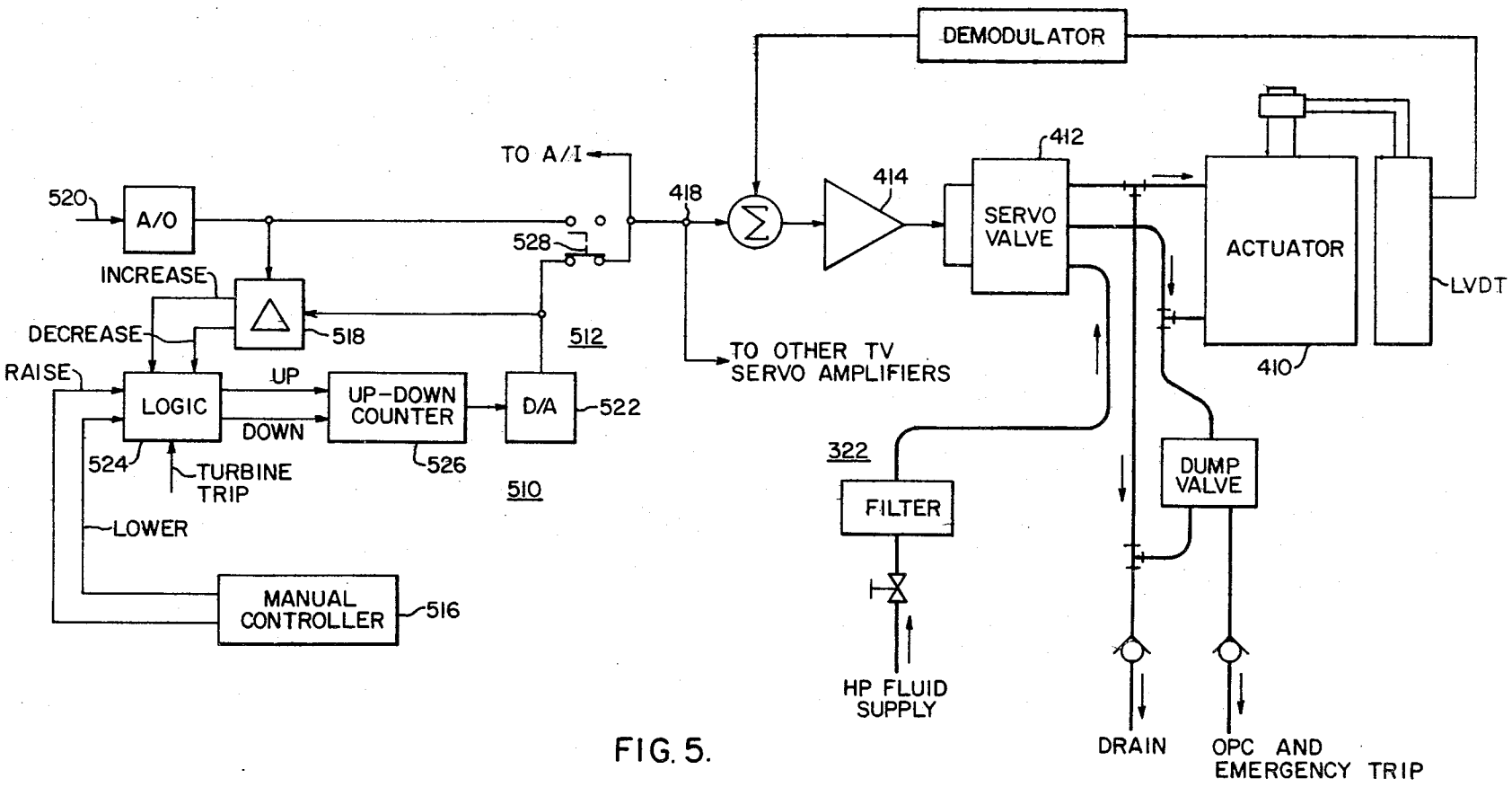
FIG. 5 shows a schematic diagram of a hybrid interface between a manual backup system and the digital computer connected with the servo system controlling the valve actuators.
Figure 17:
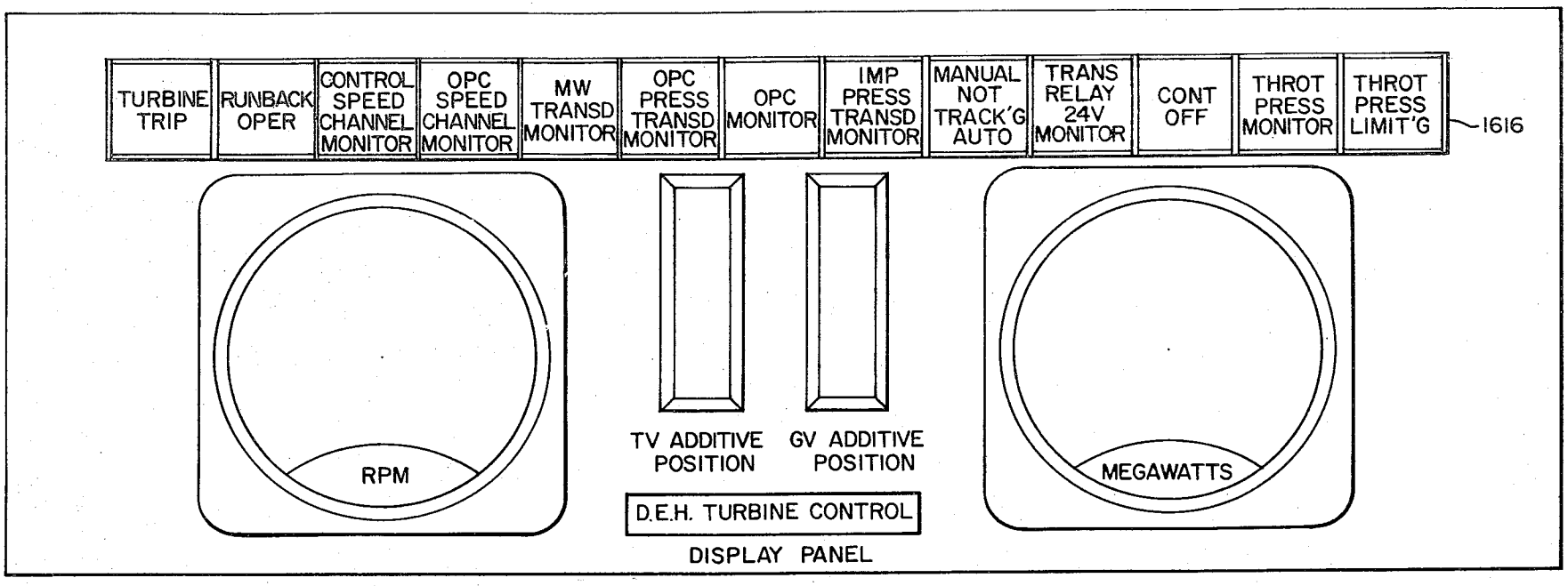
Figure 18:
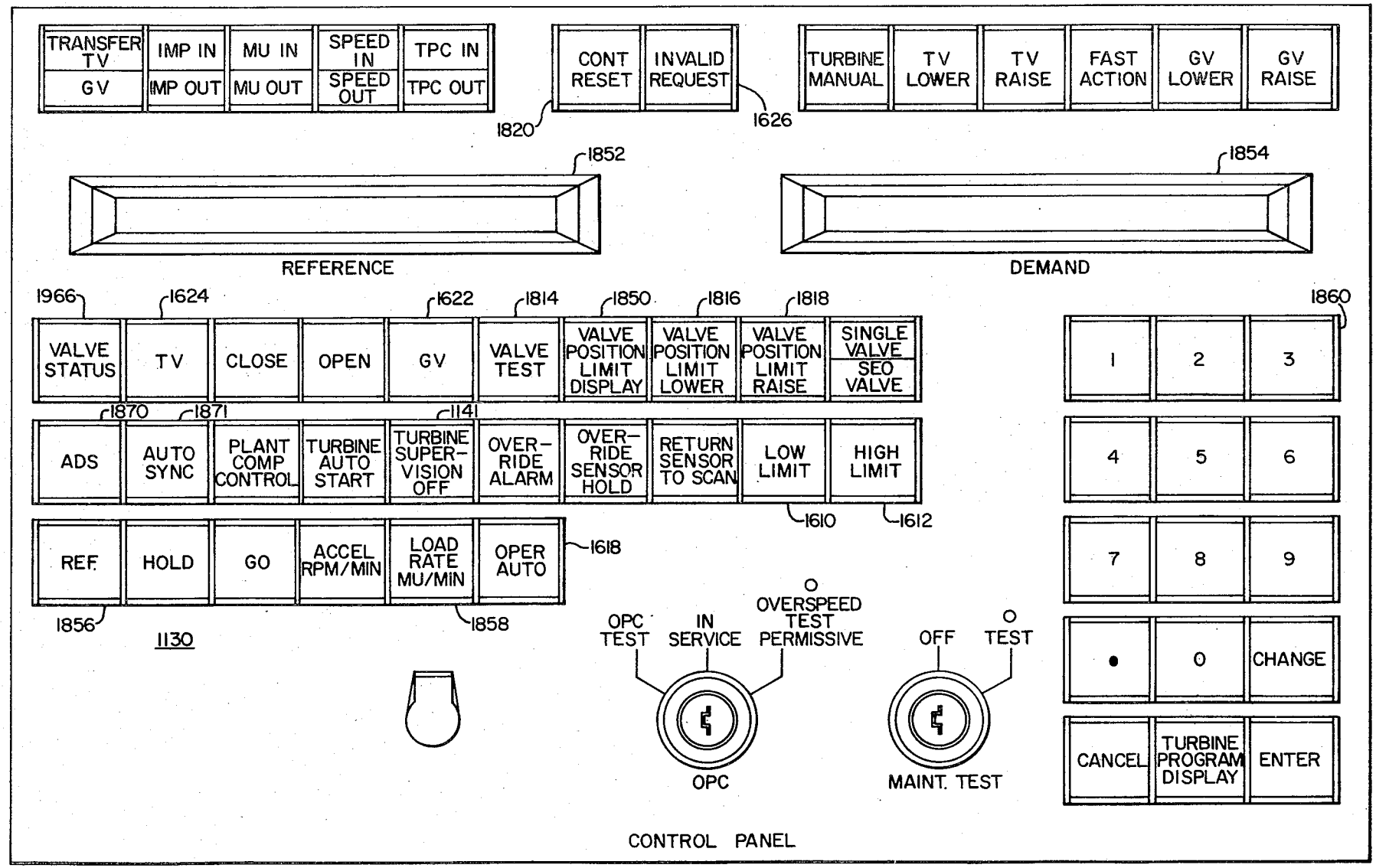
Figure 19:
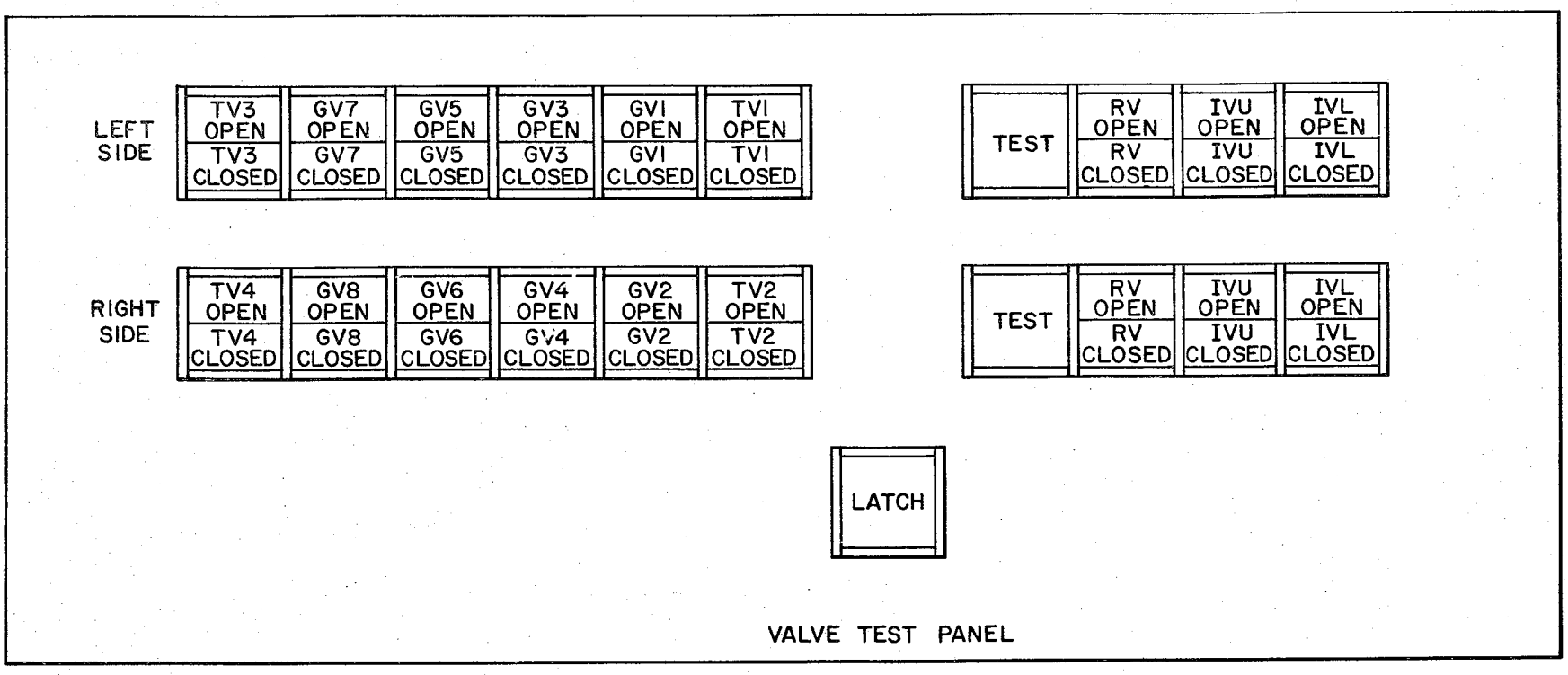
Figure 20:
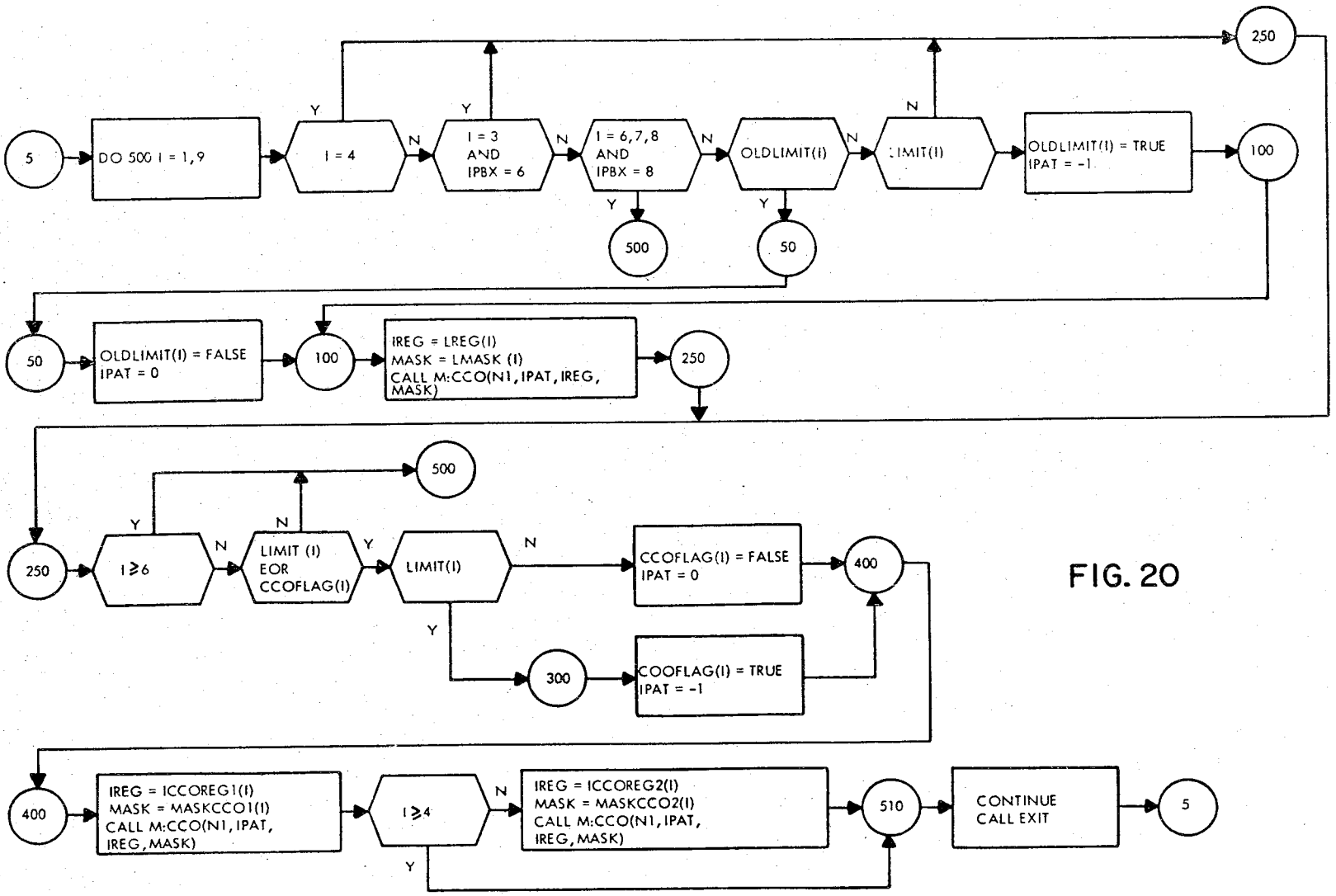
Figure 21:
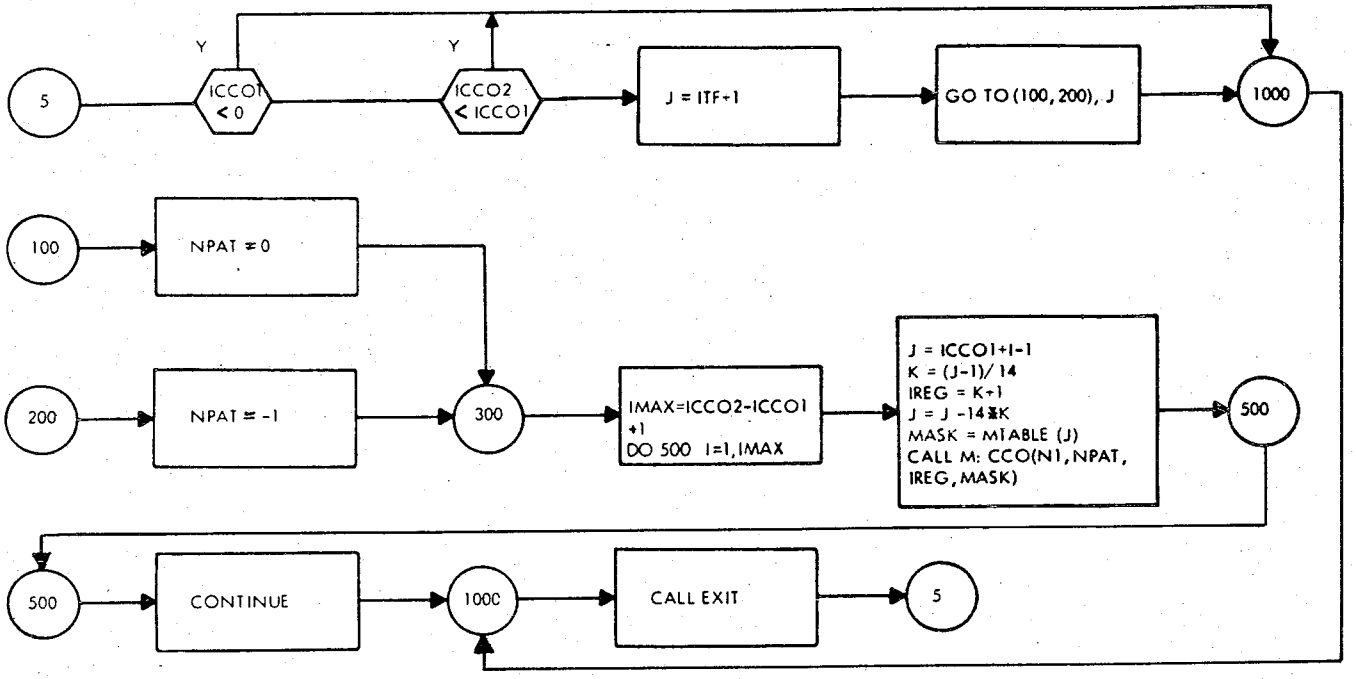
Figure 22:
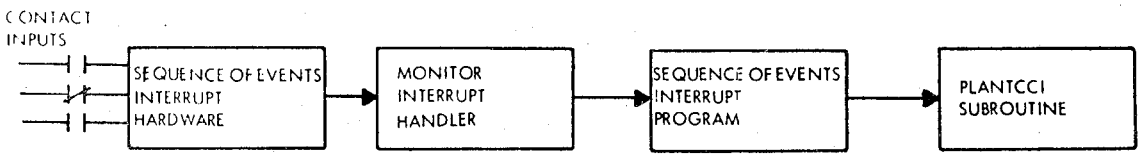
Figure 23:
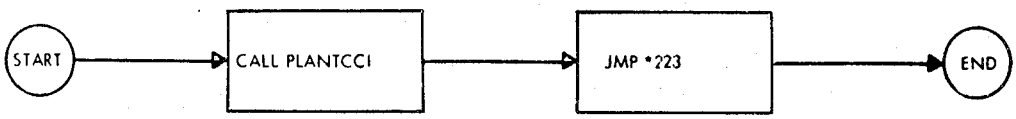
Figure 24:
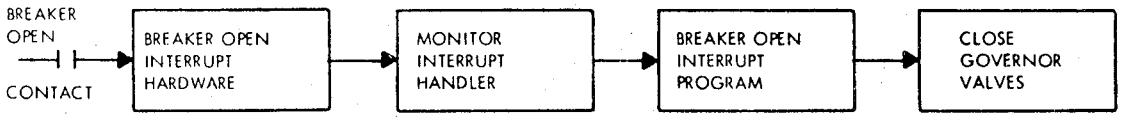
Figure 25:
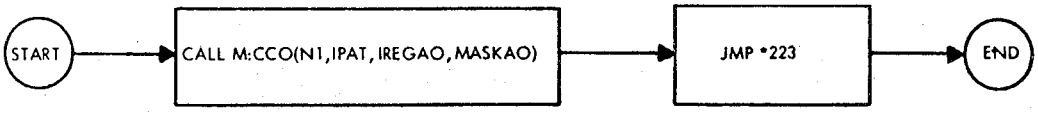
Figure 26:
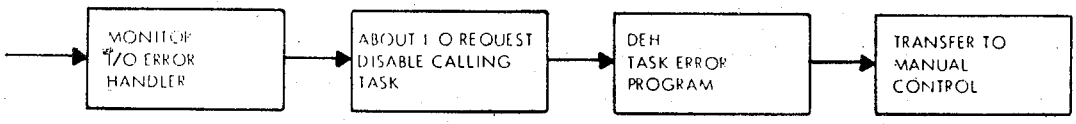
Figure 27:
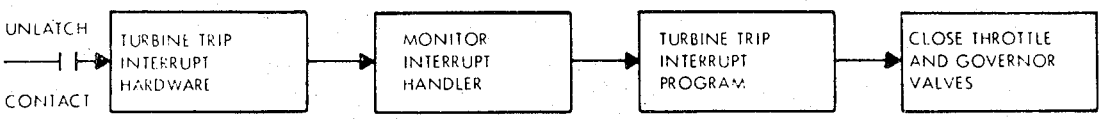
Figure 28:
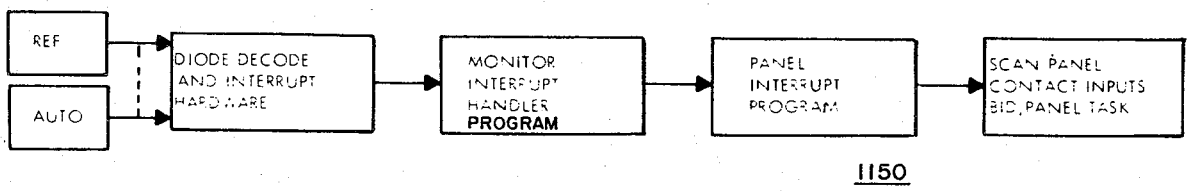
Figure 29:
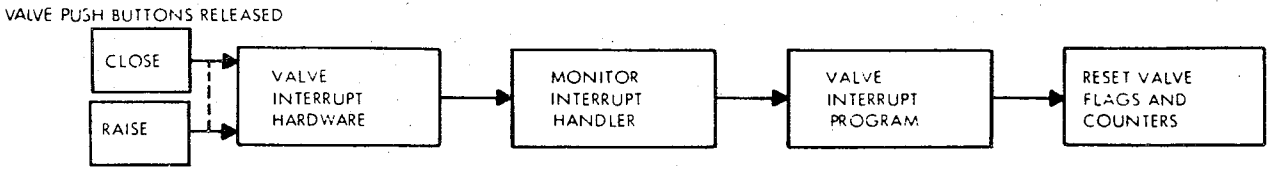
Figure 30:
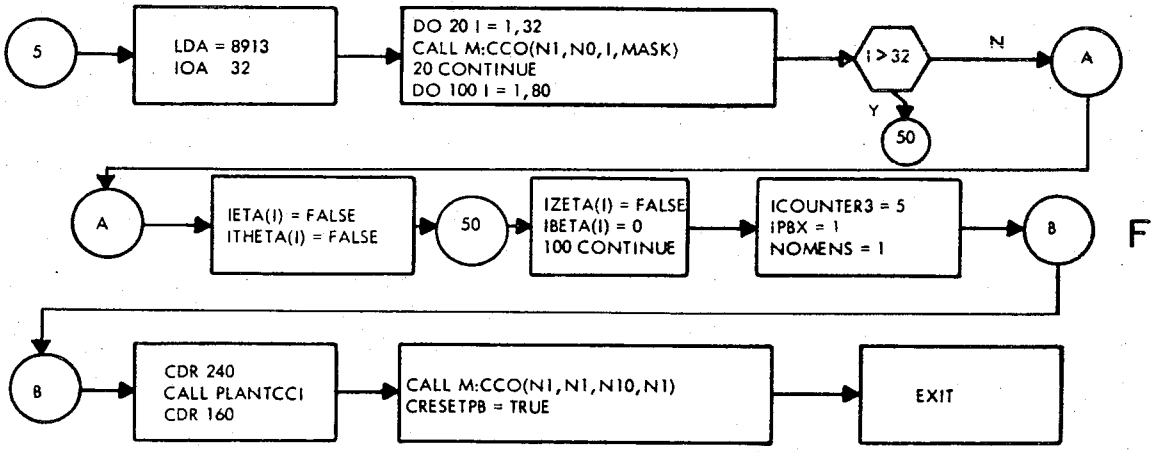
Figure 32:
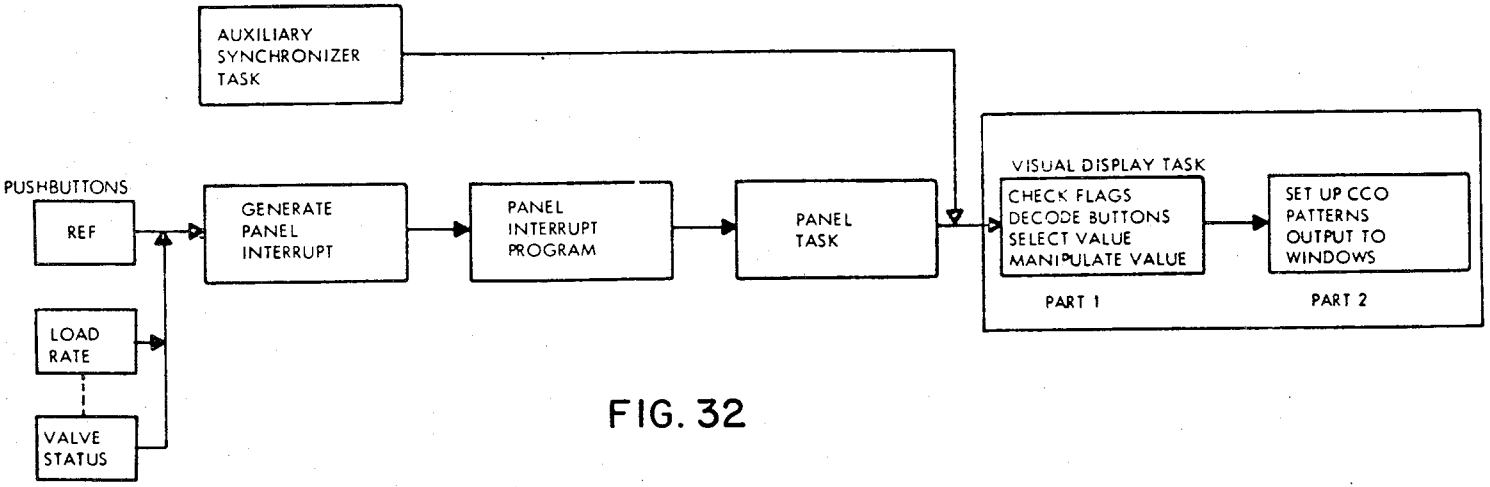
Figure 33:
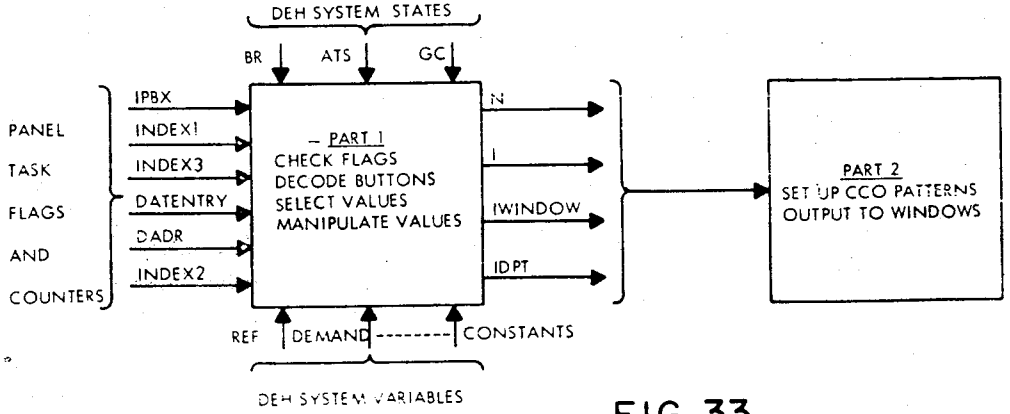
Figure 34:
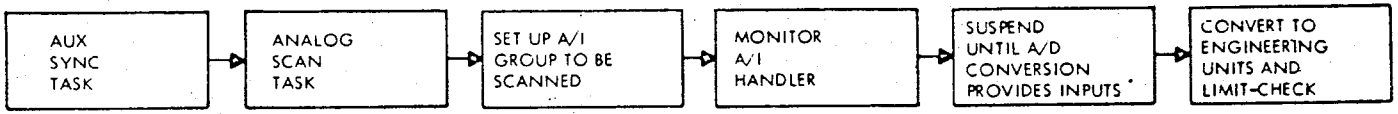
Figure 35:
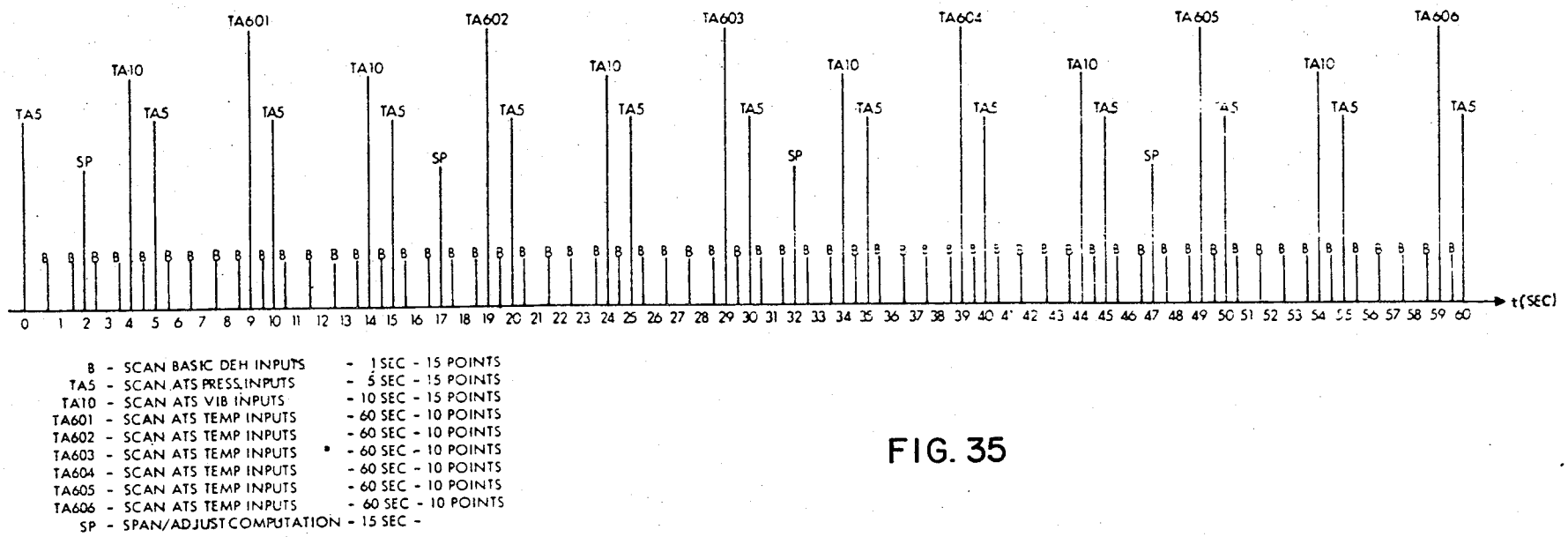
Figure 37:
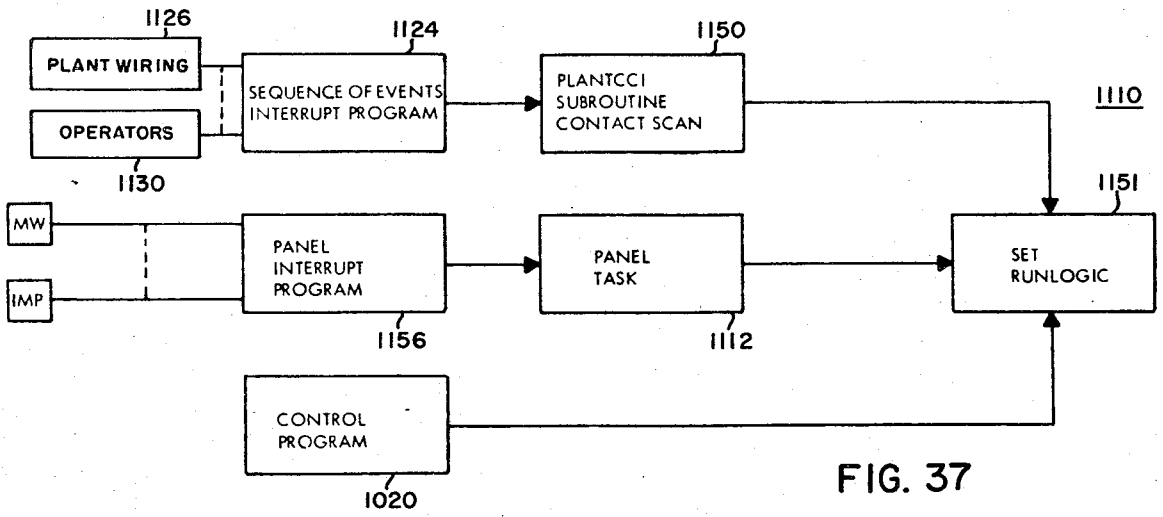
Figure 36:
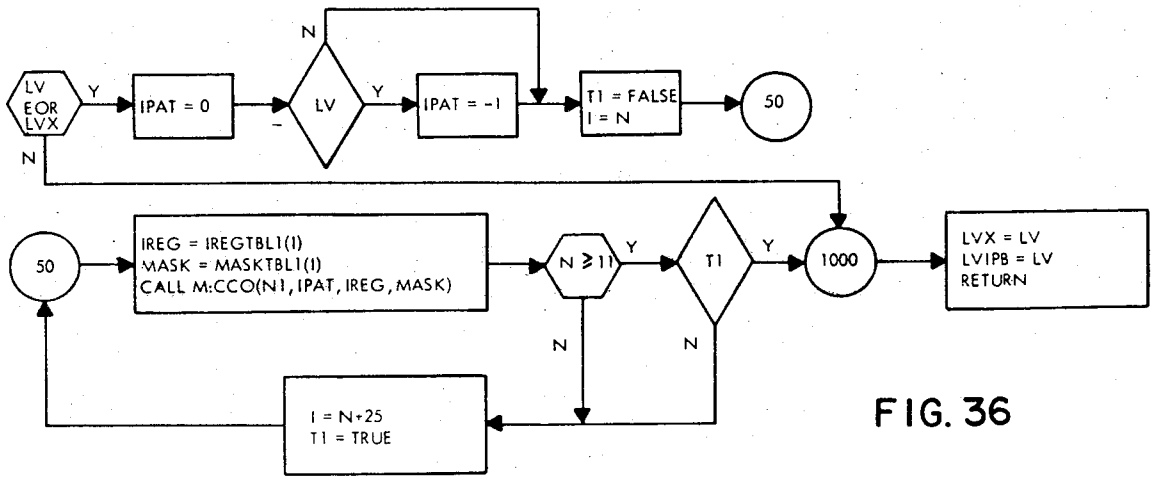
Figure 38:
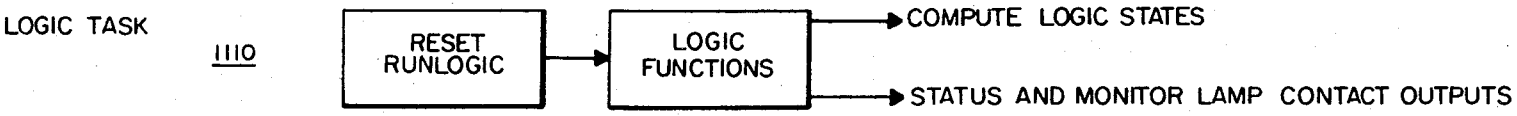
Figure 40:
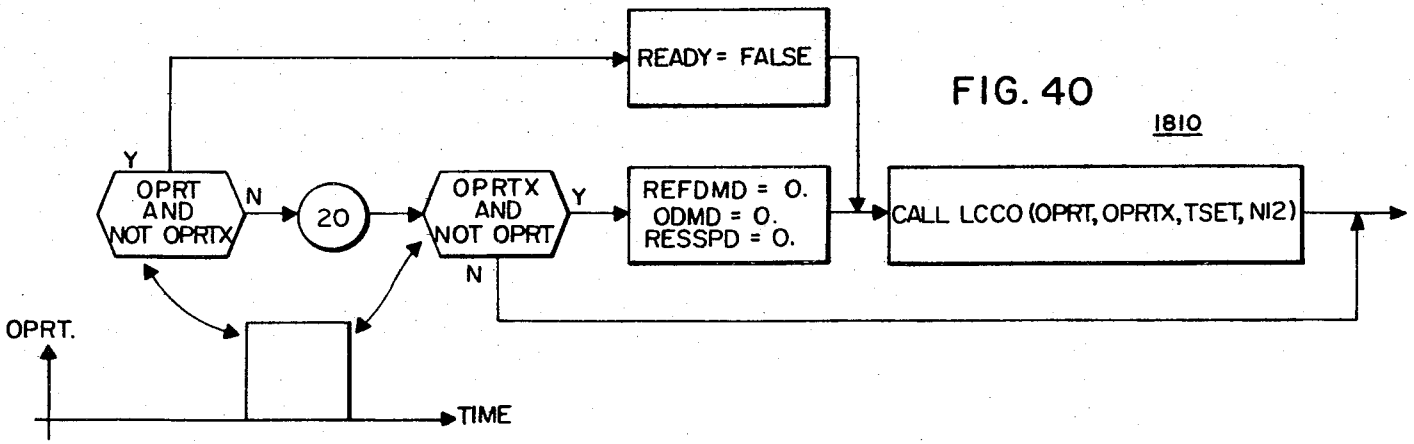
Figure 41:
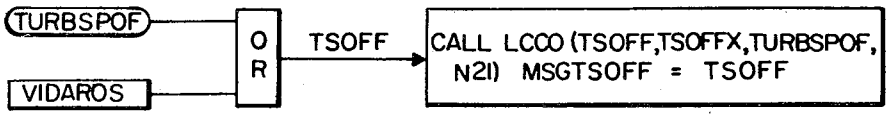
Figure 39:
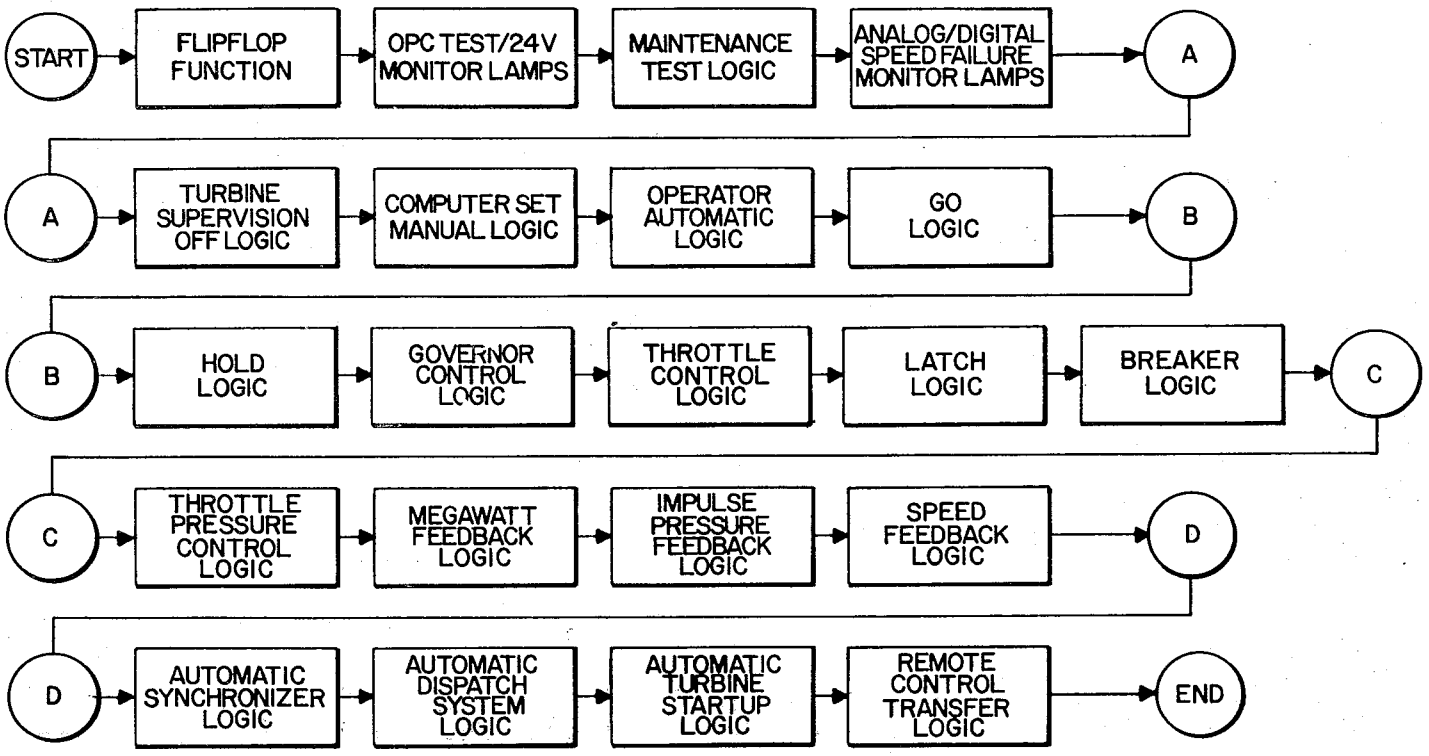
Figure 42:
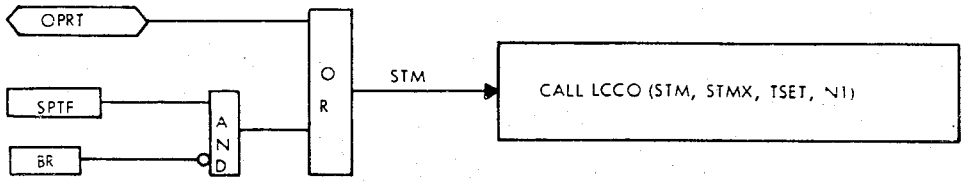
Figure 43:
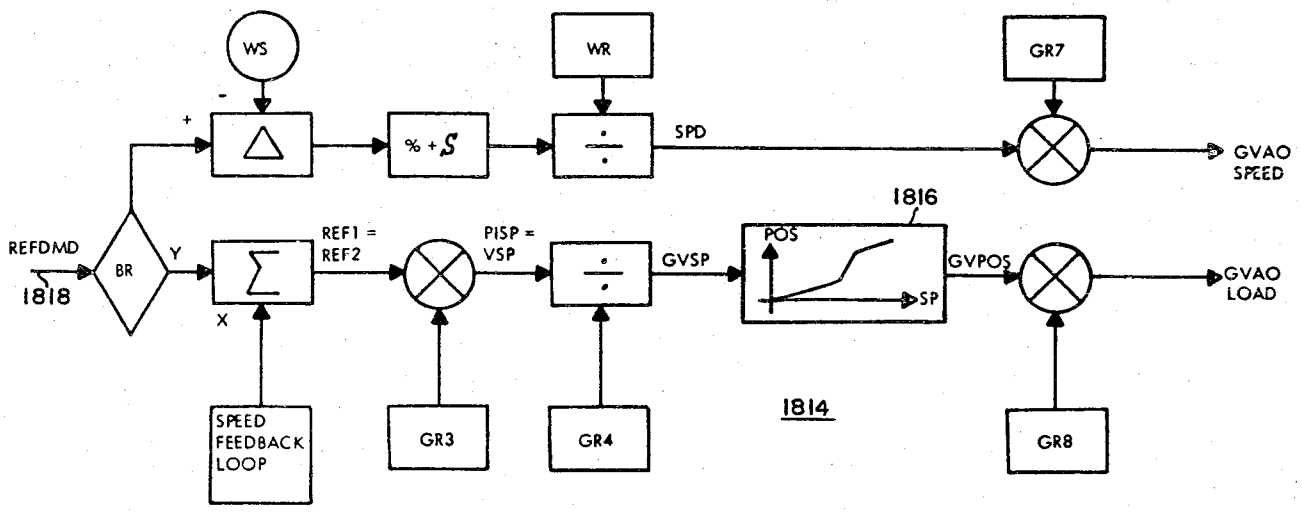
Figure 44:
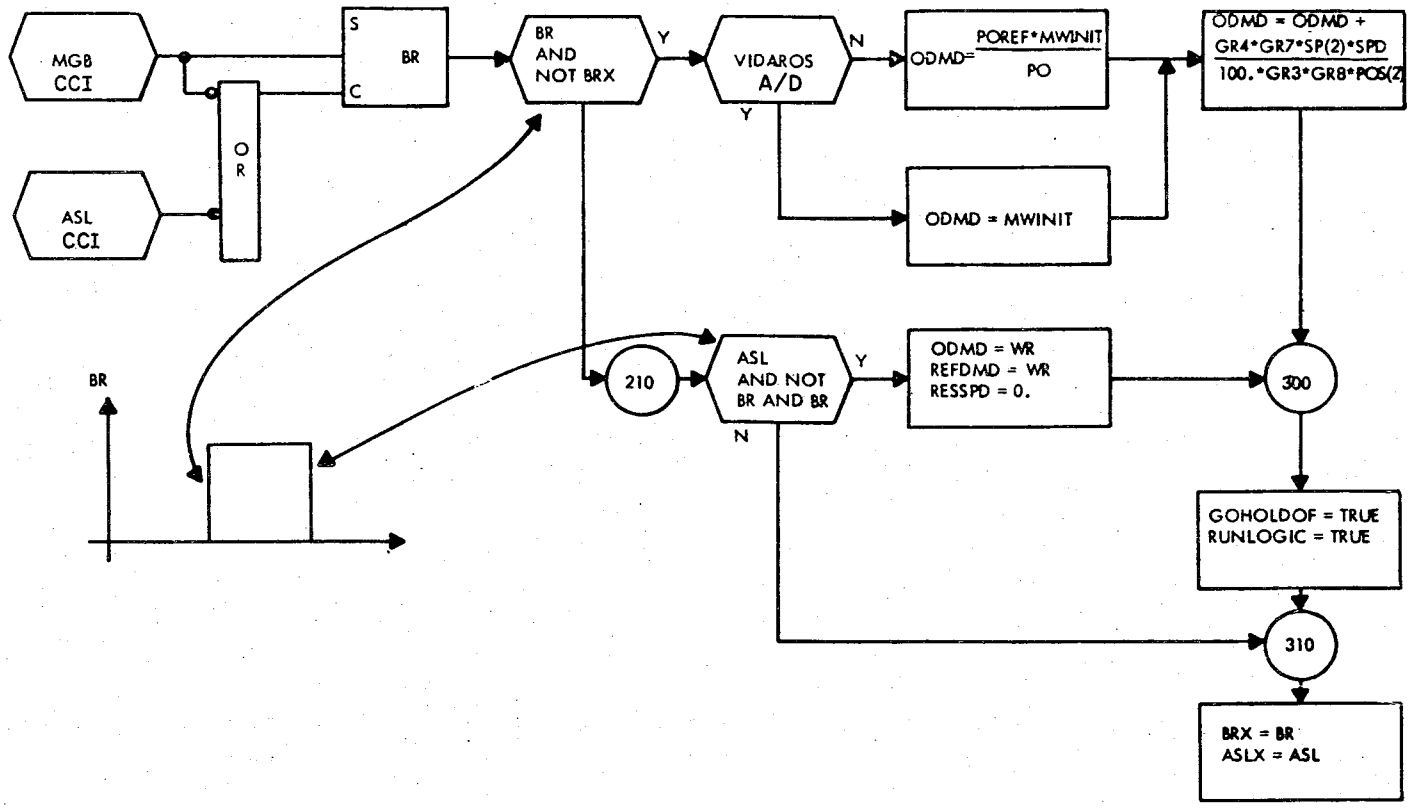
Figure 45:
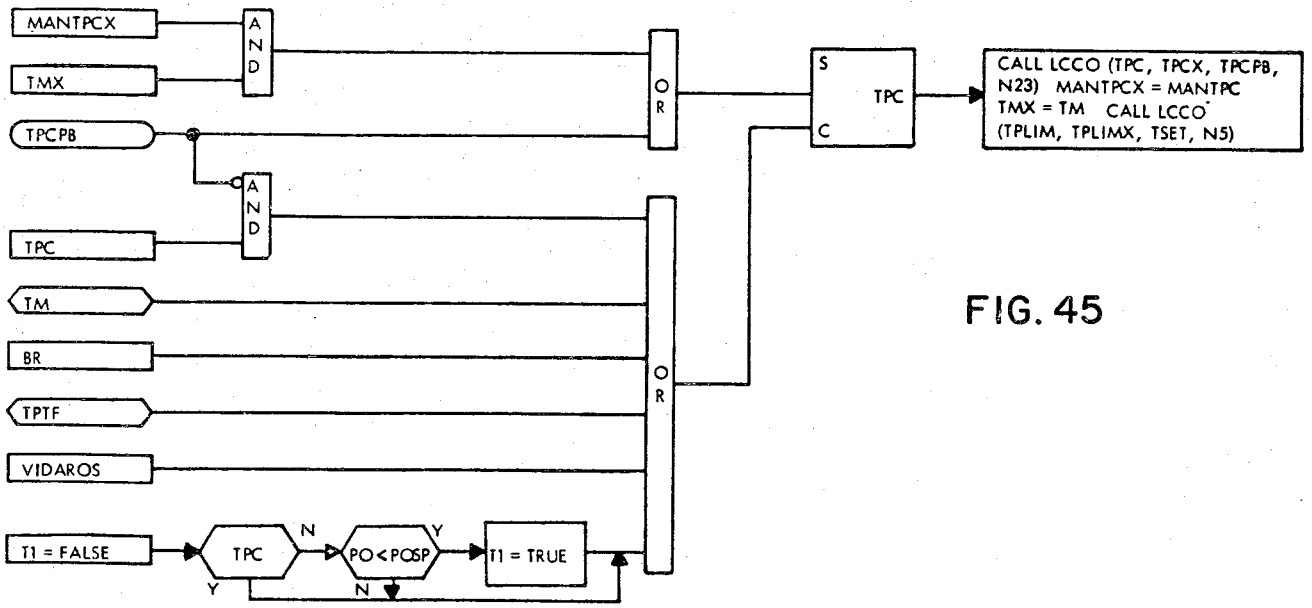
Figures 46, 47:
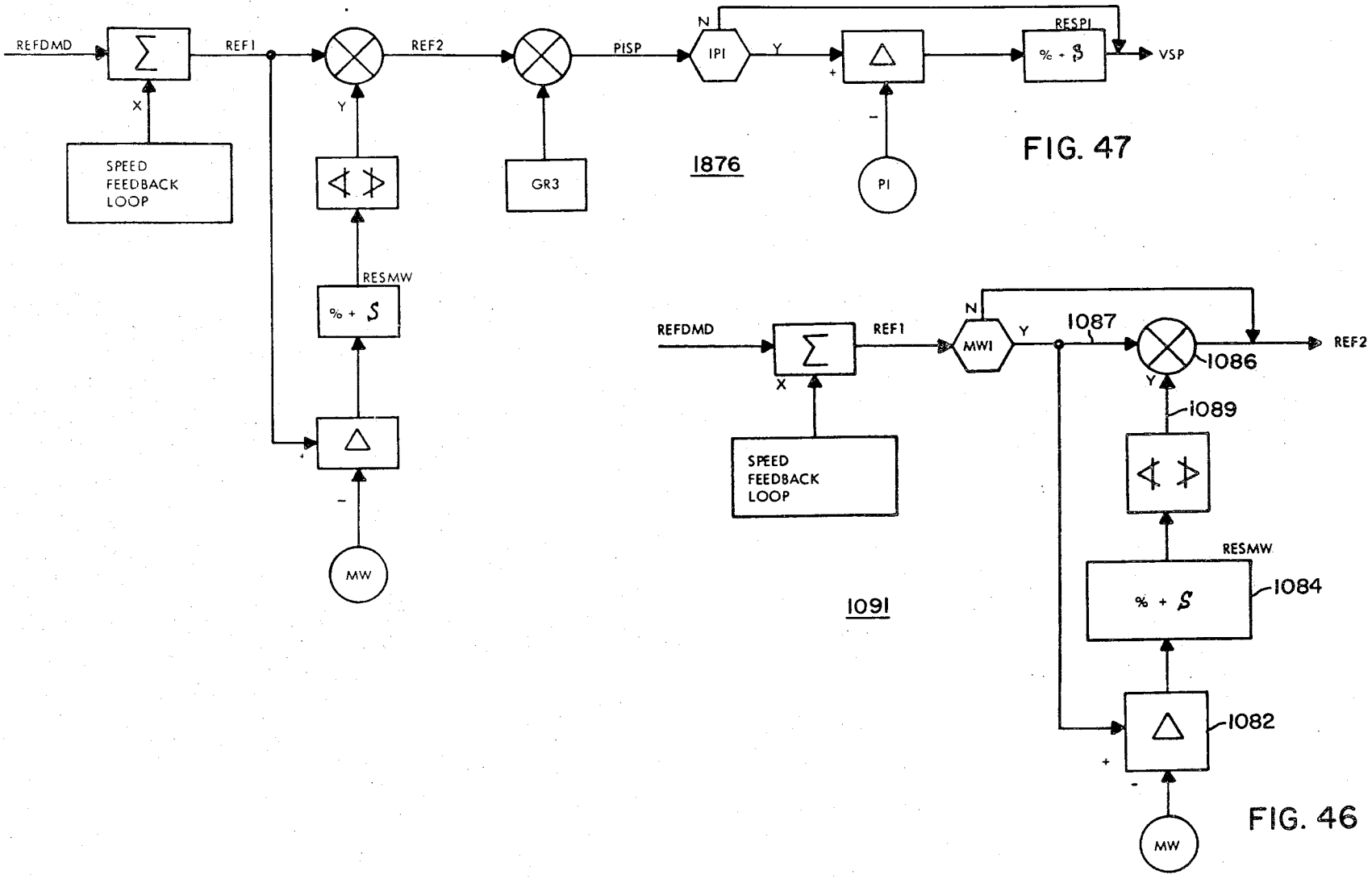
Figure 48:
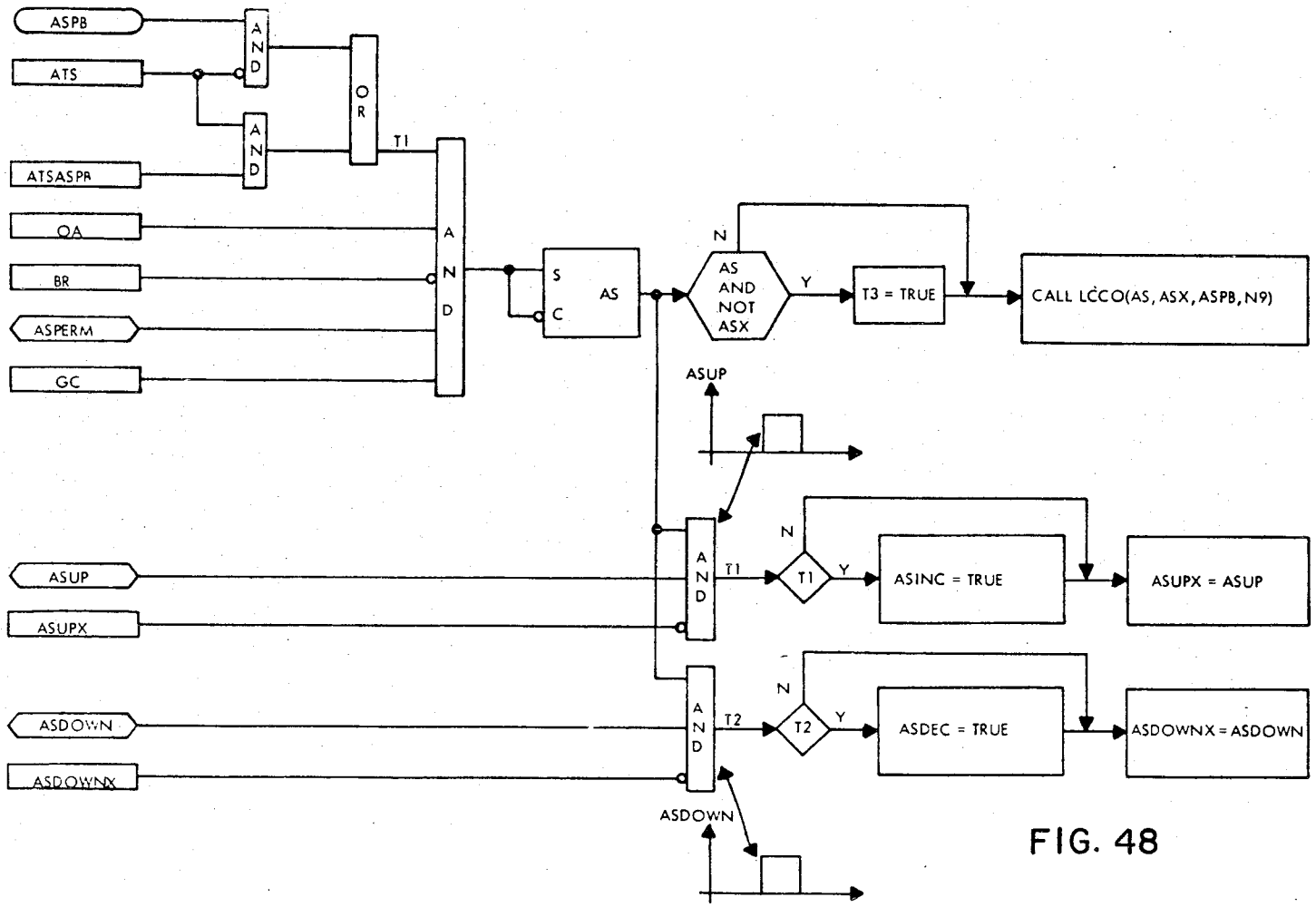
Figure 49:
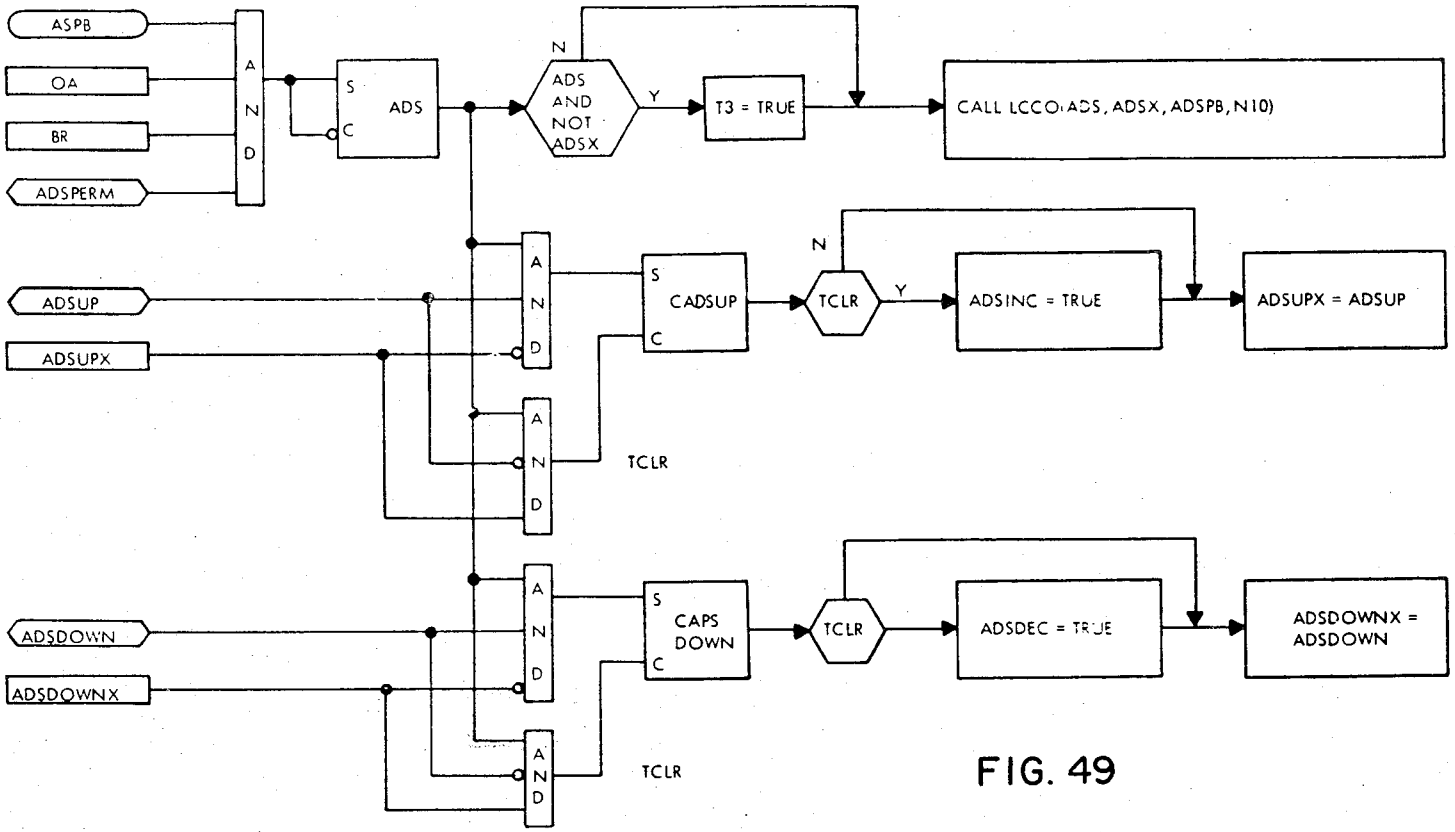
Figure 50:
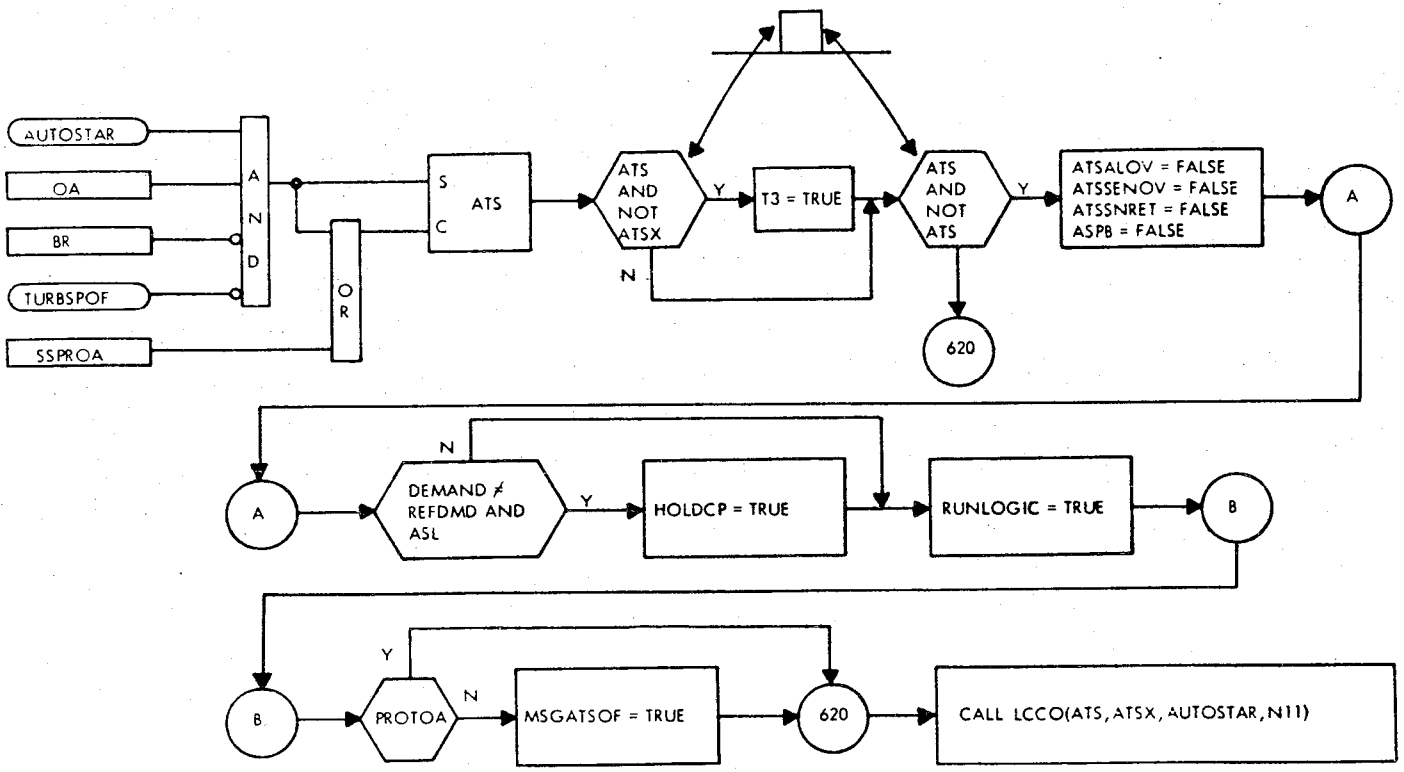
Figure 51:
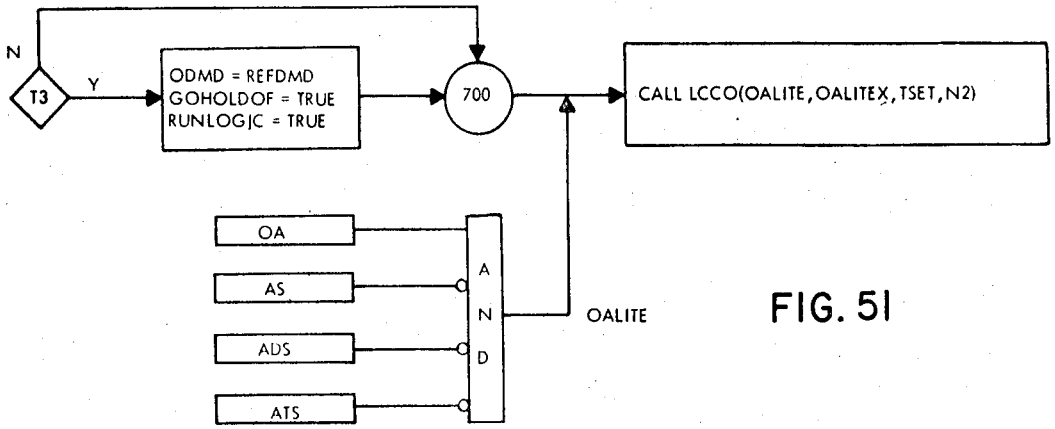
Figure 54:
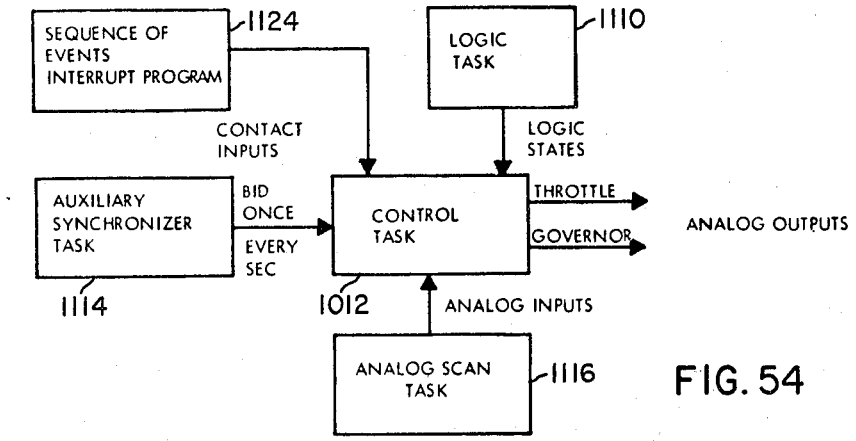
Figure 56:
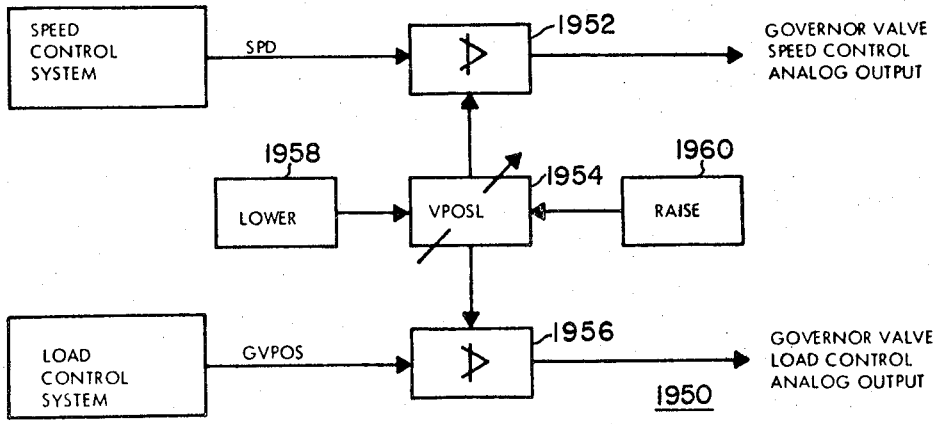
Figure 52:
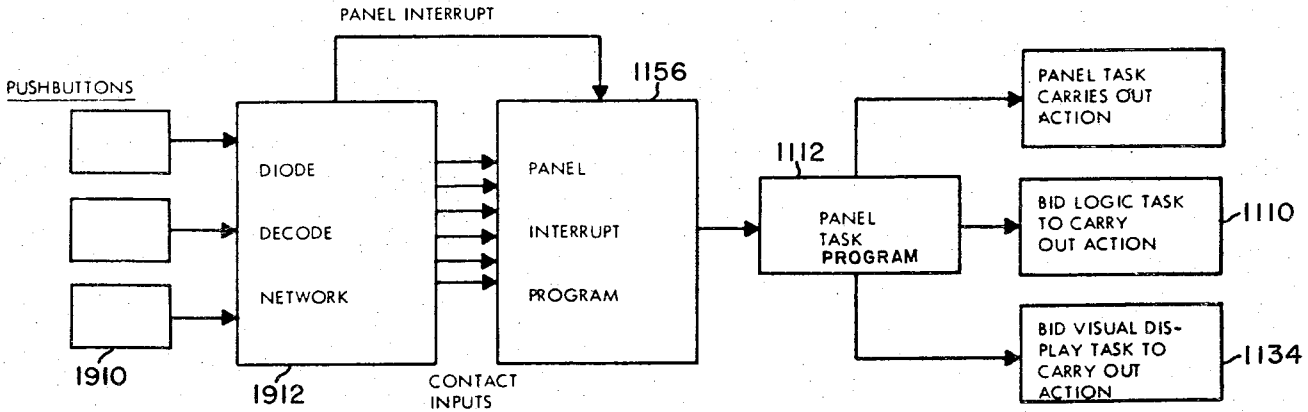
Figure 53:
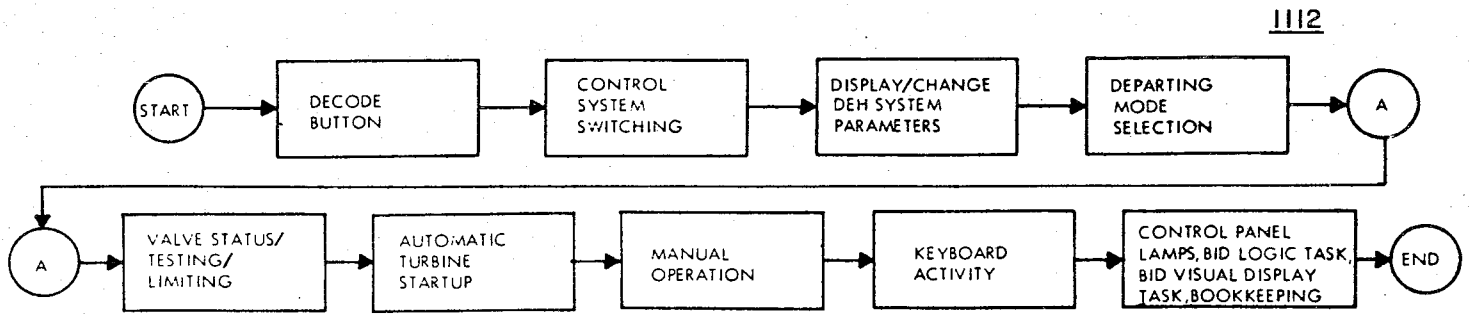
Figure 55:
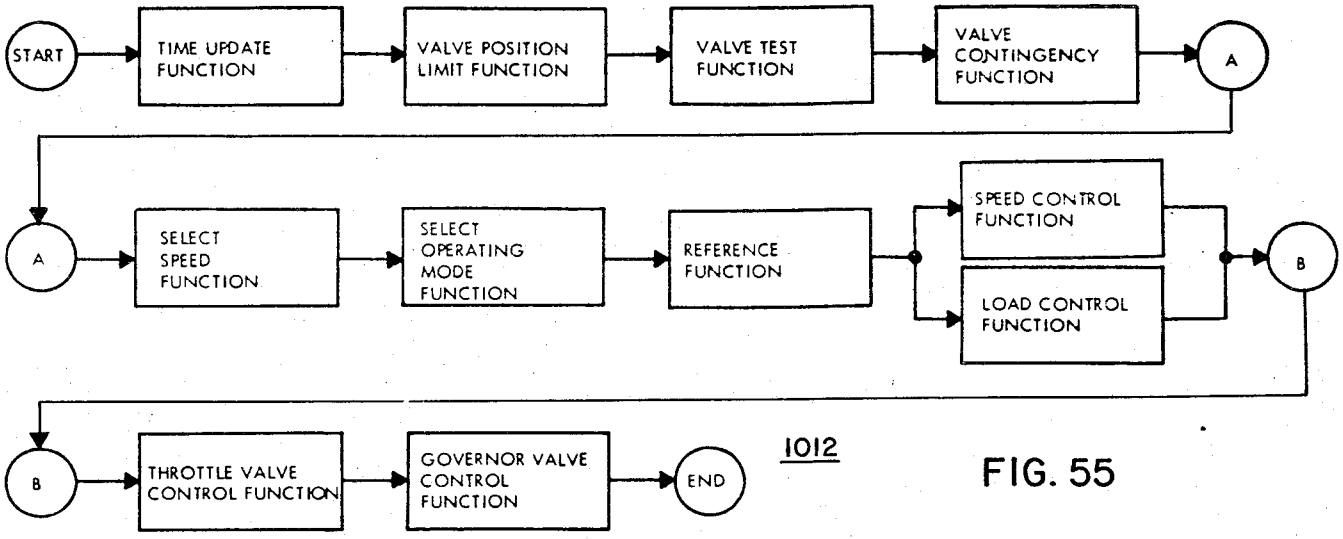
Figure 57:
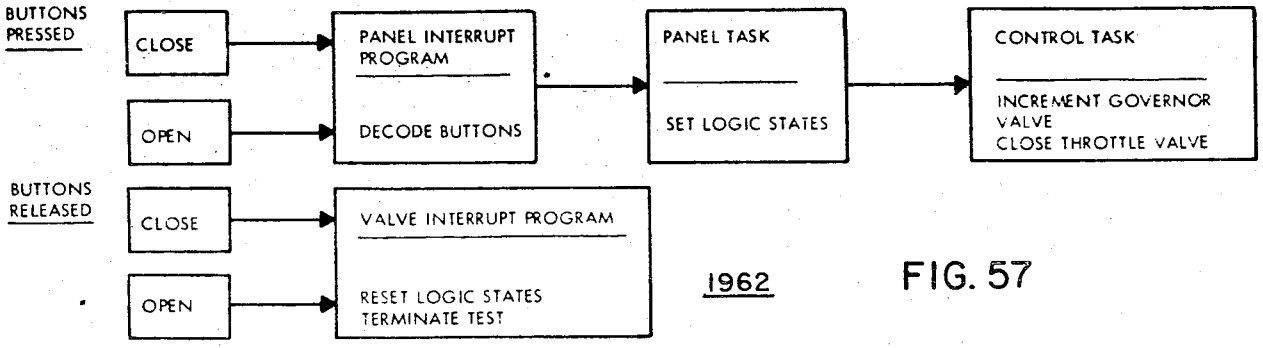
Figure 56A:
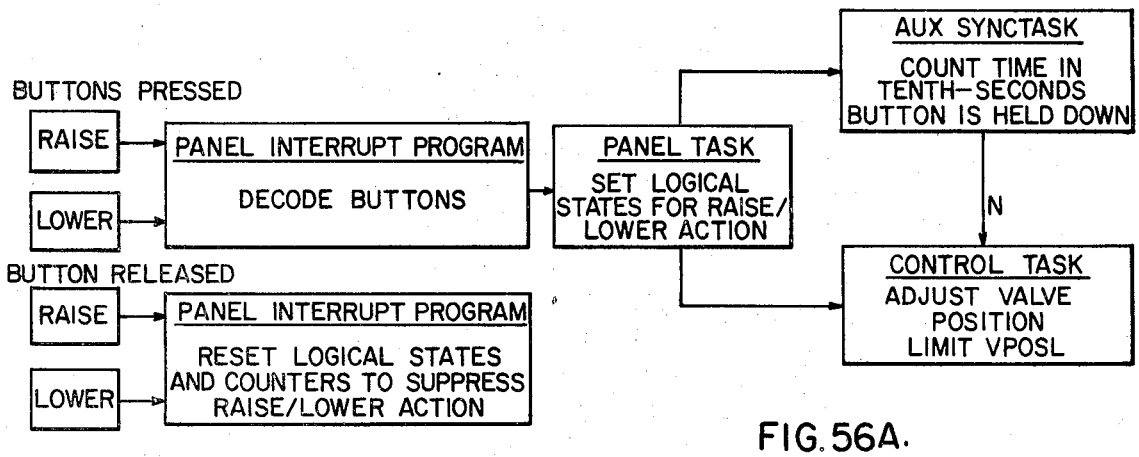
Figure 65A:
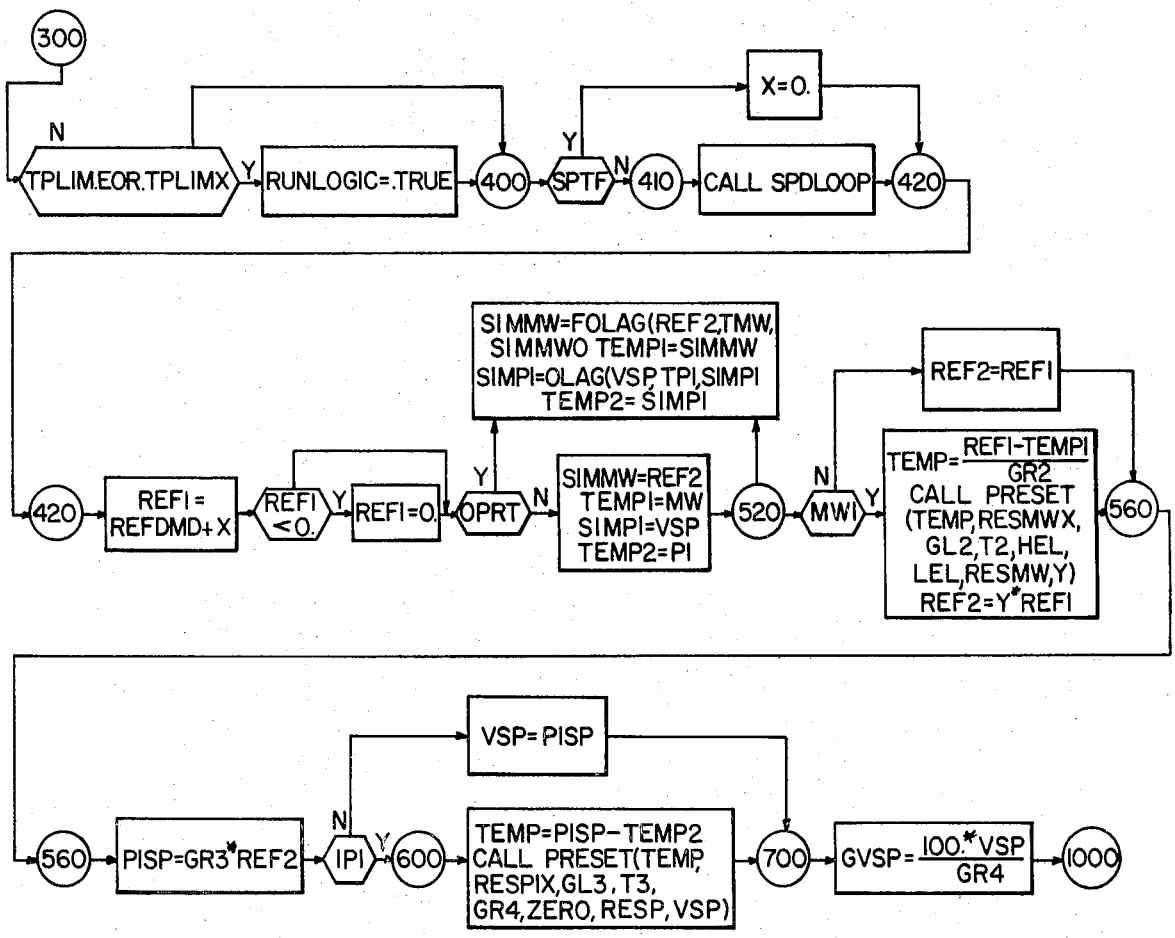
Figure 58:
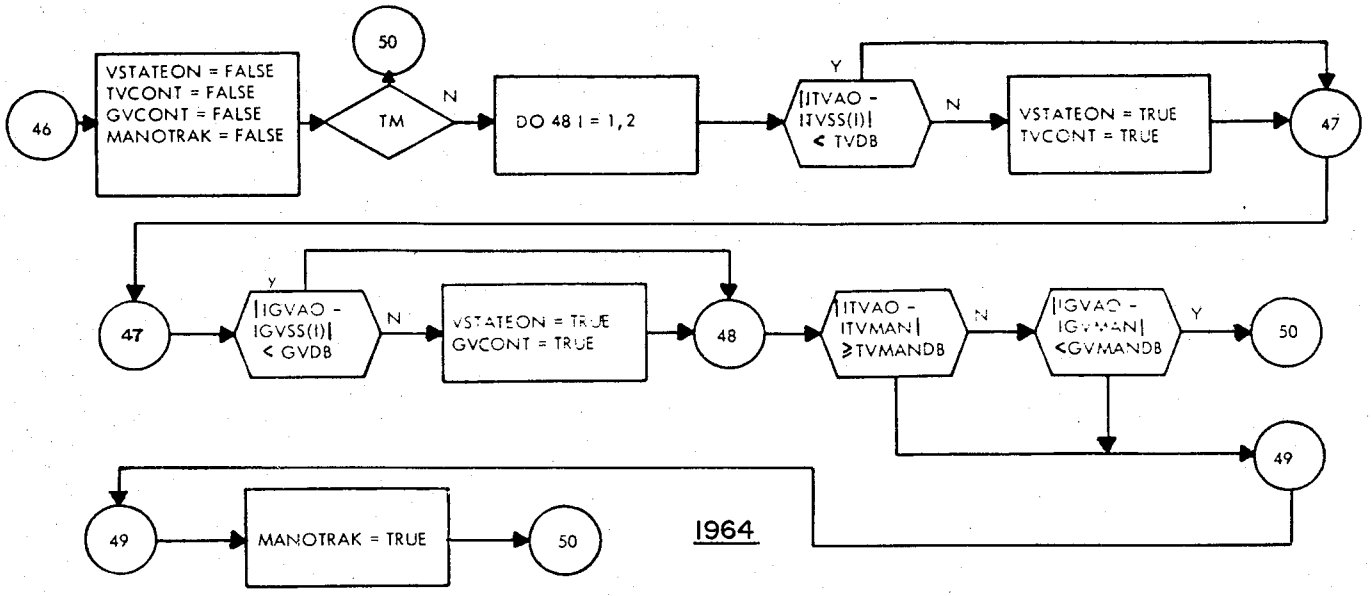
Figure 59:
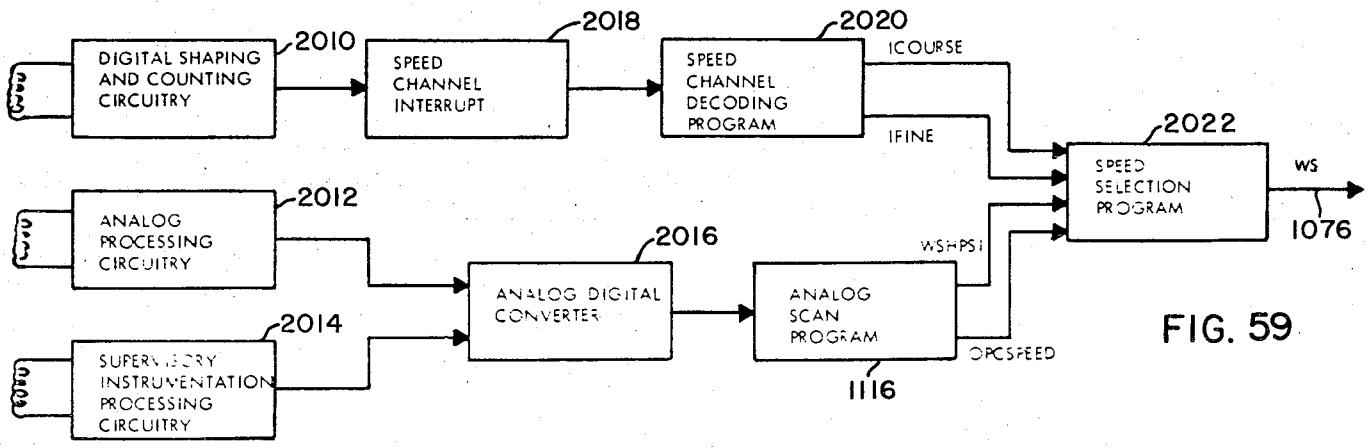
Figure 60A:
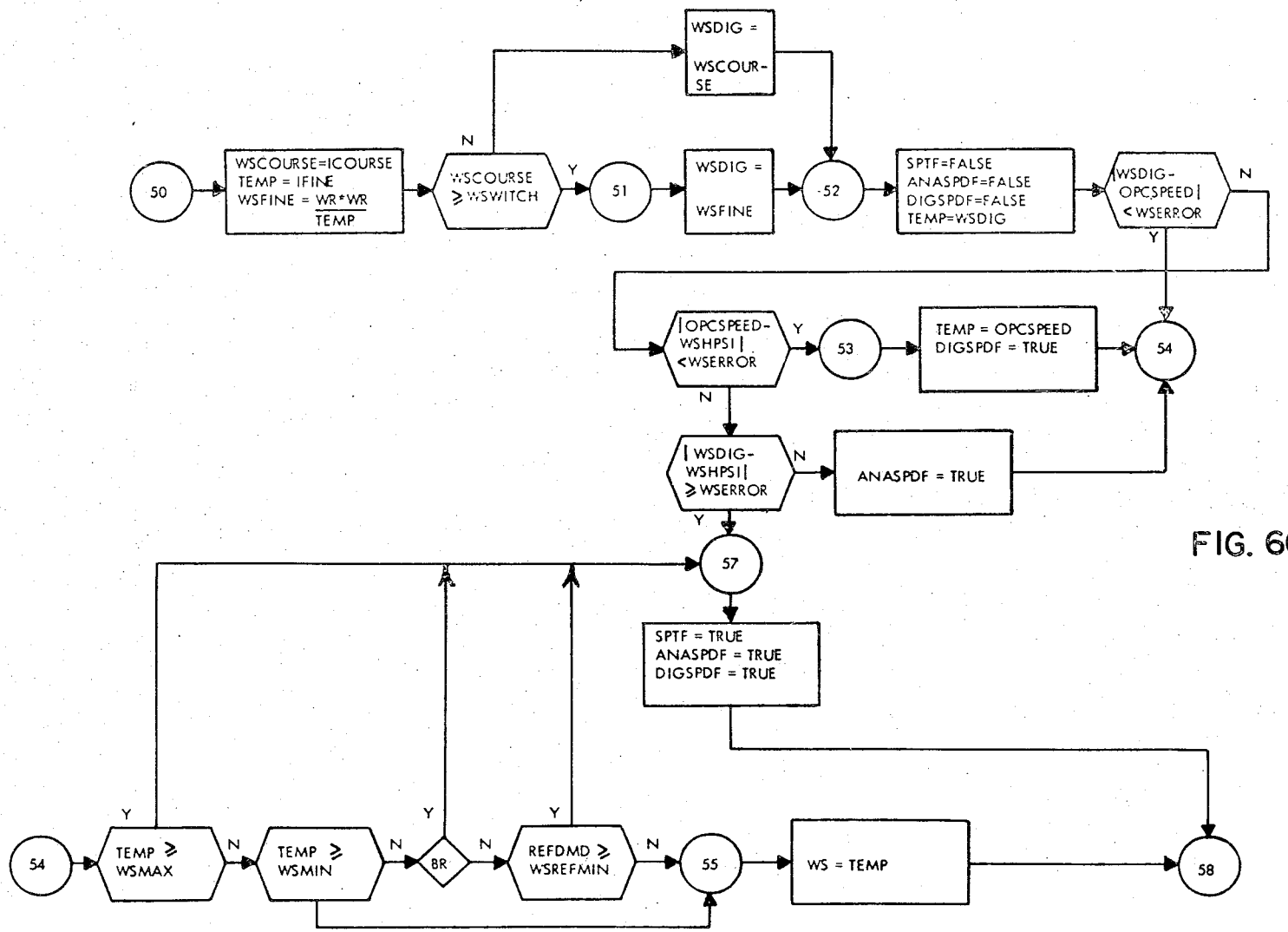
Figure 60B:
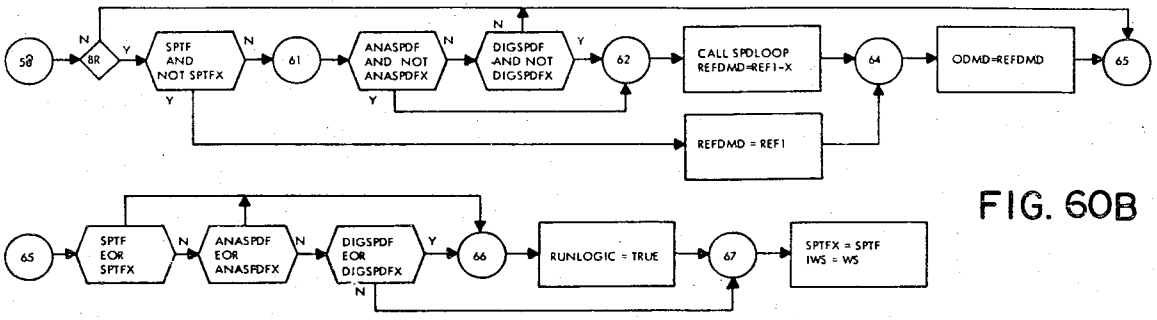
Figure 61:
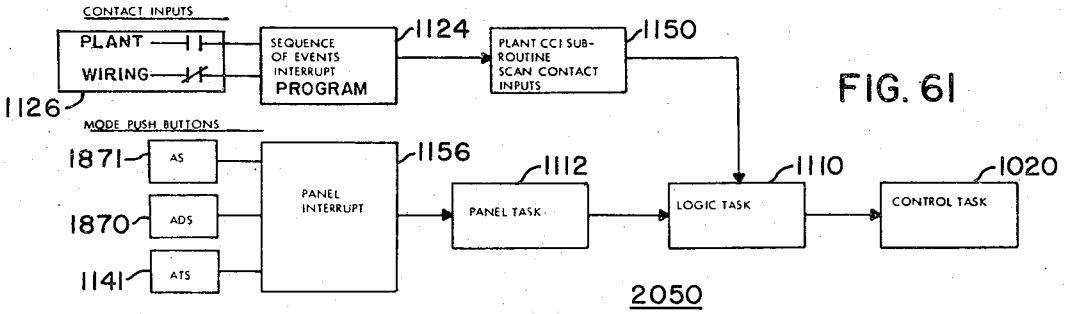
Figure 61A:
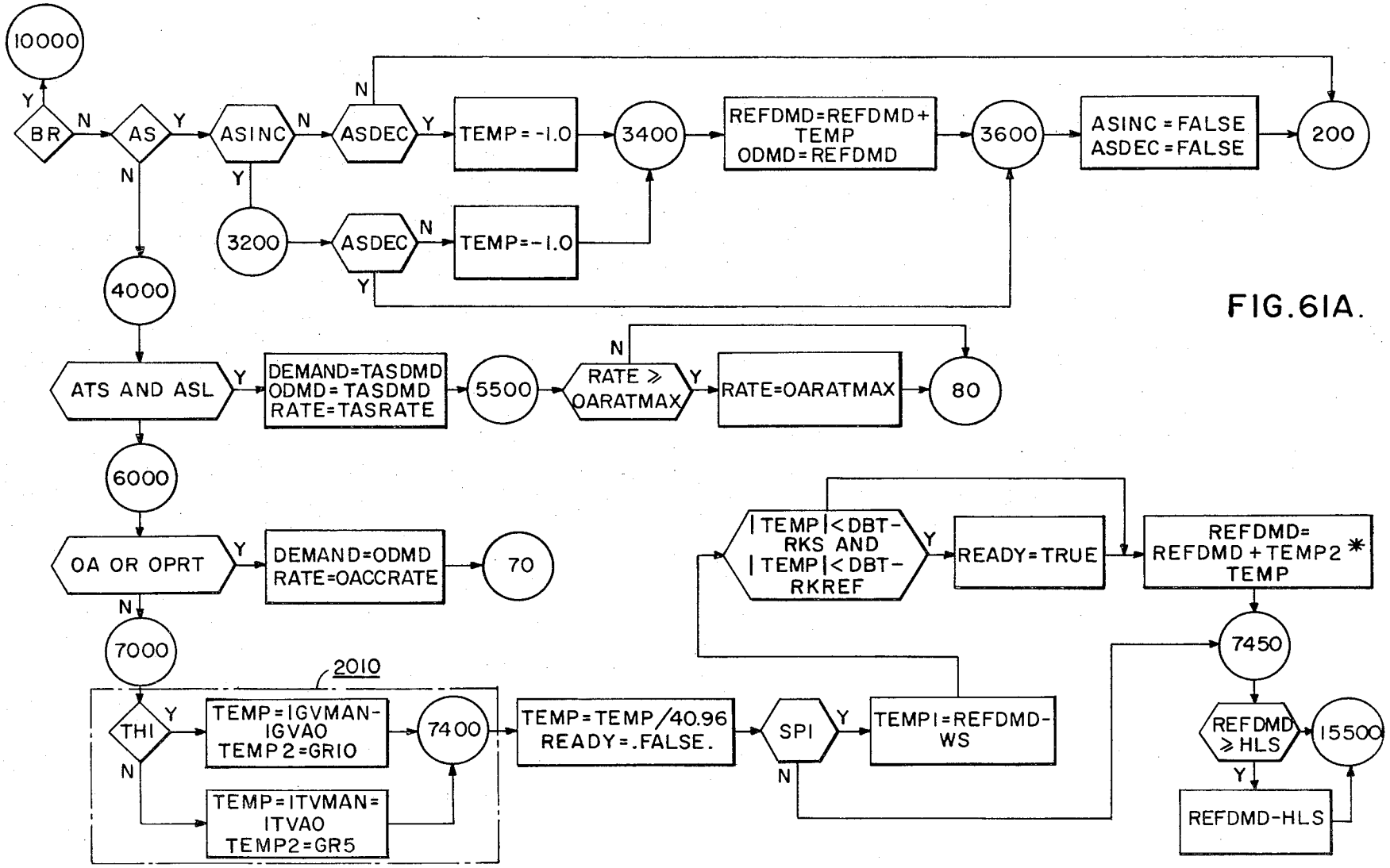
Figure 61B:
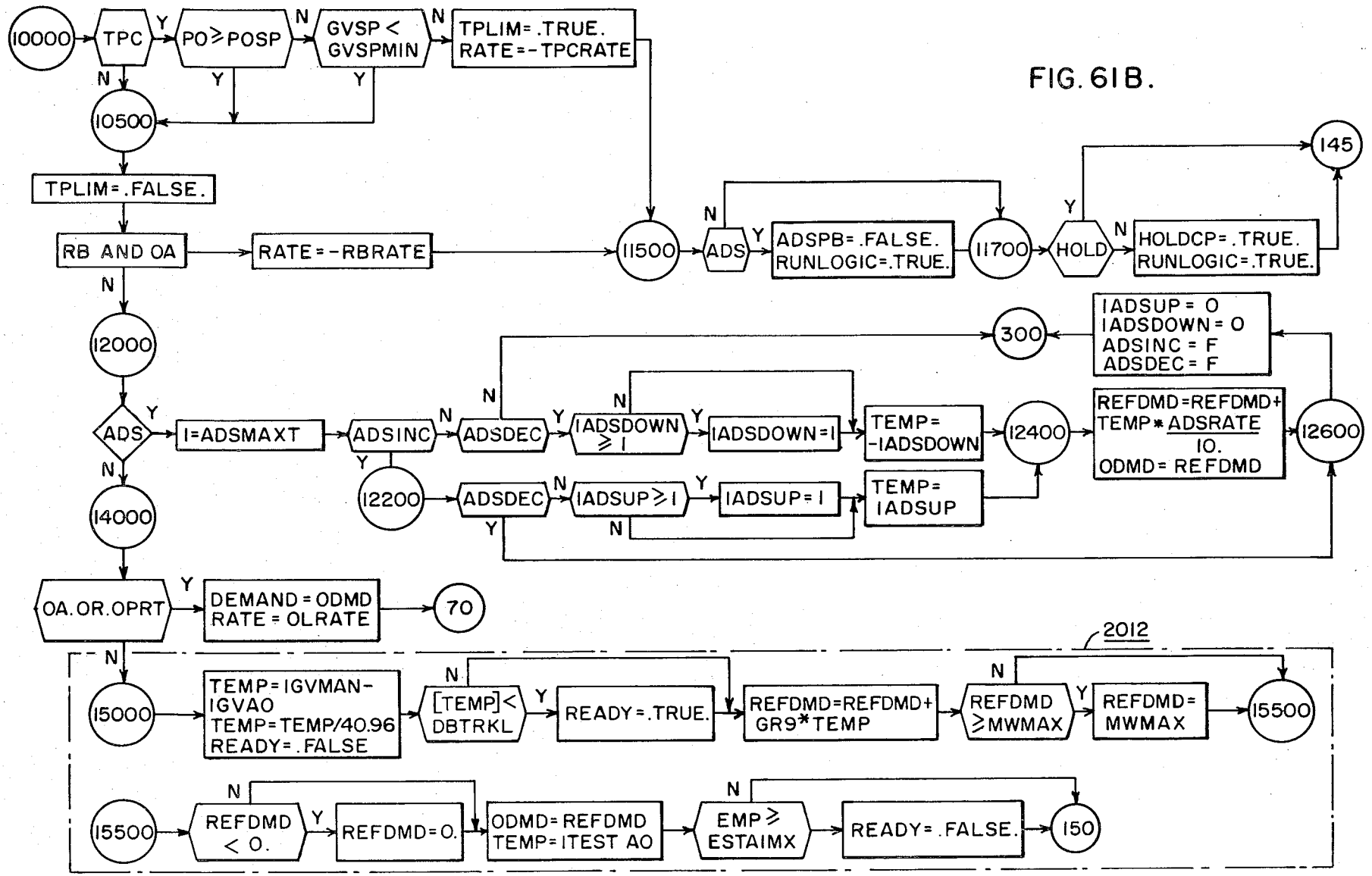
Figure 62:
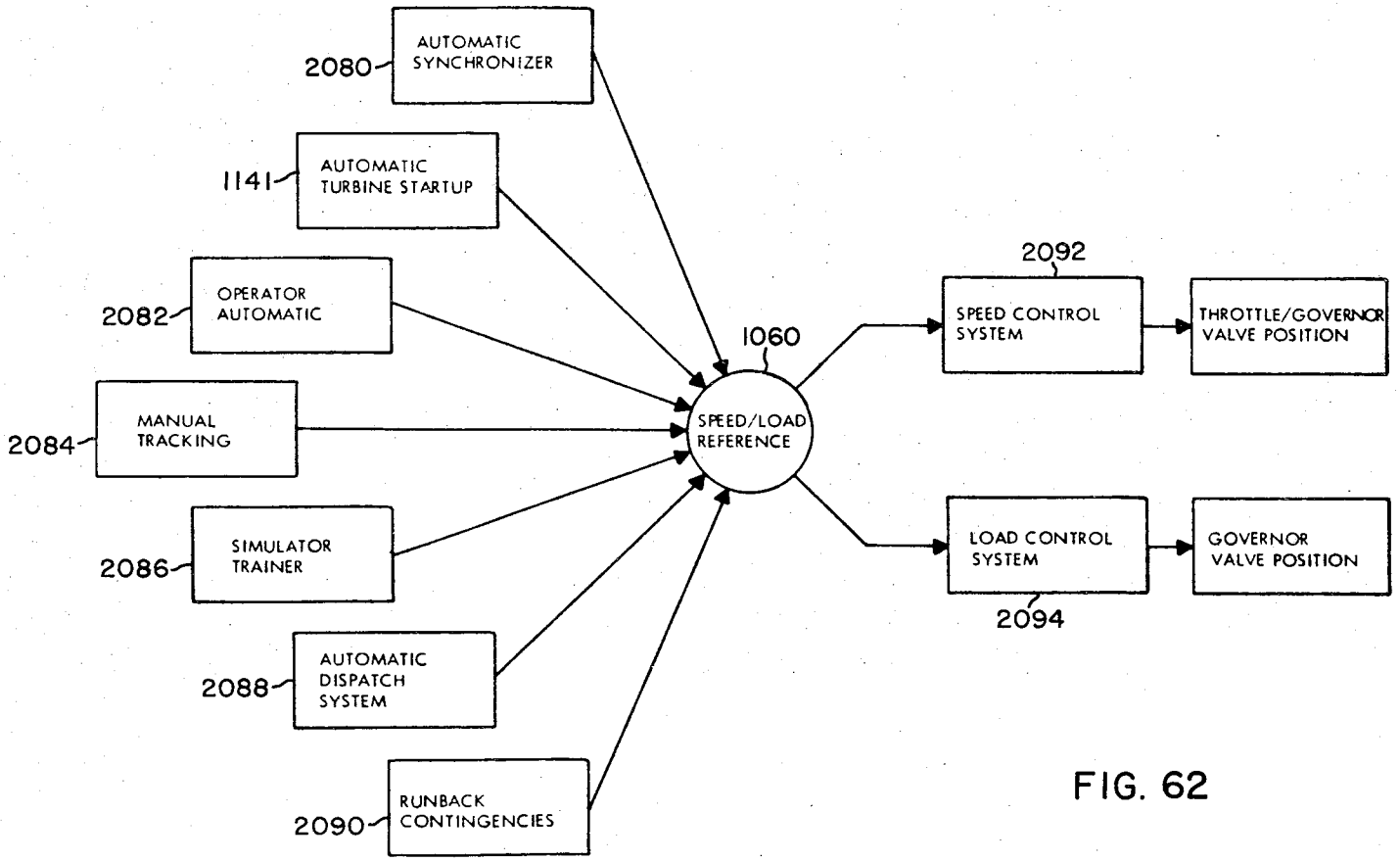
Figure 63:
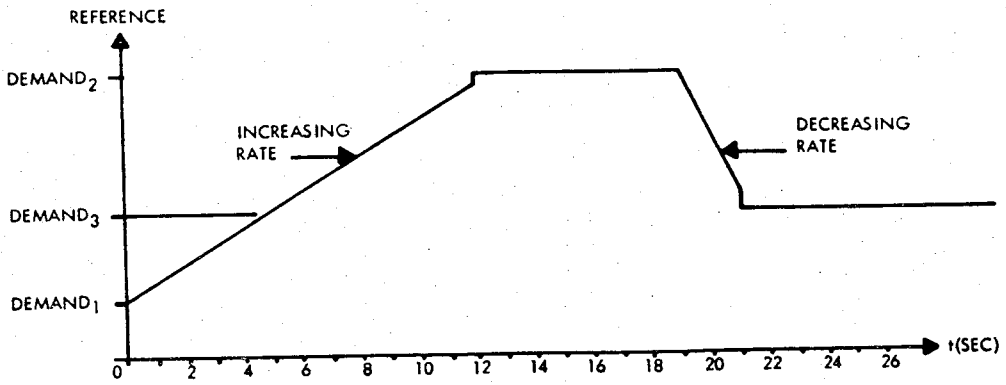
Figure 64:
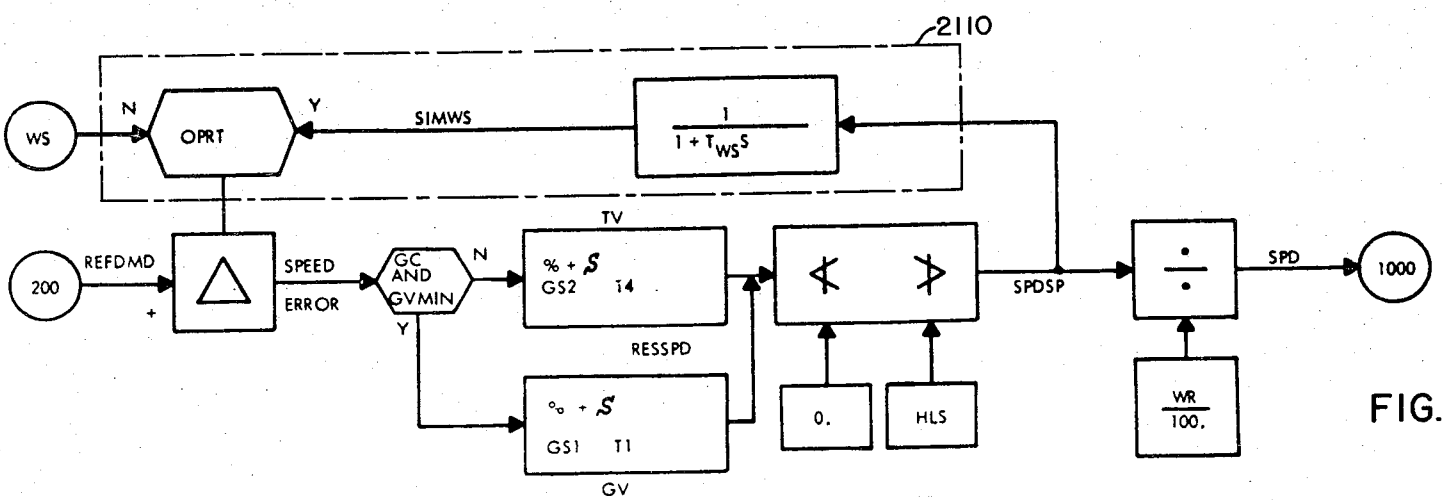
Figure 65:
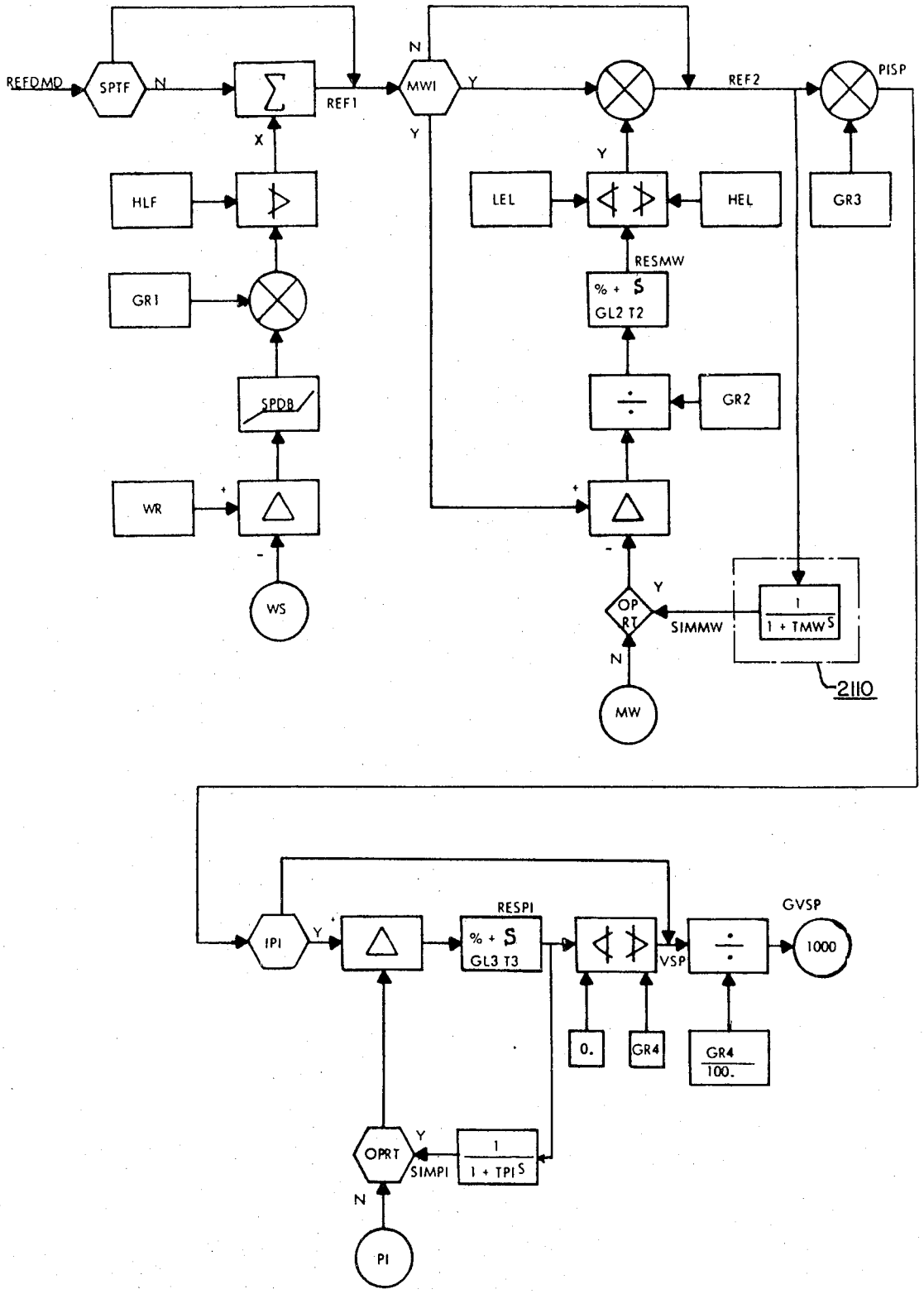
Figure 66:
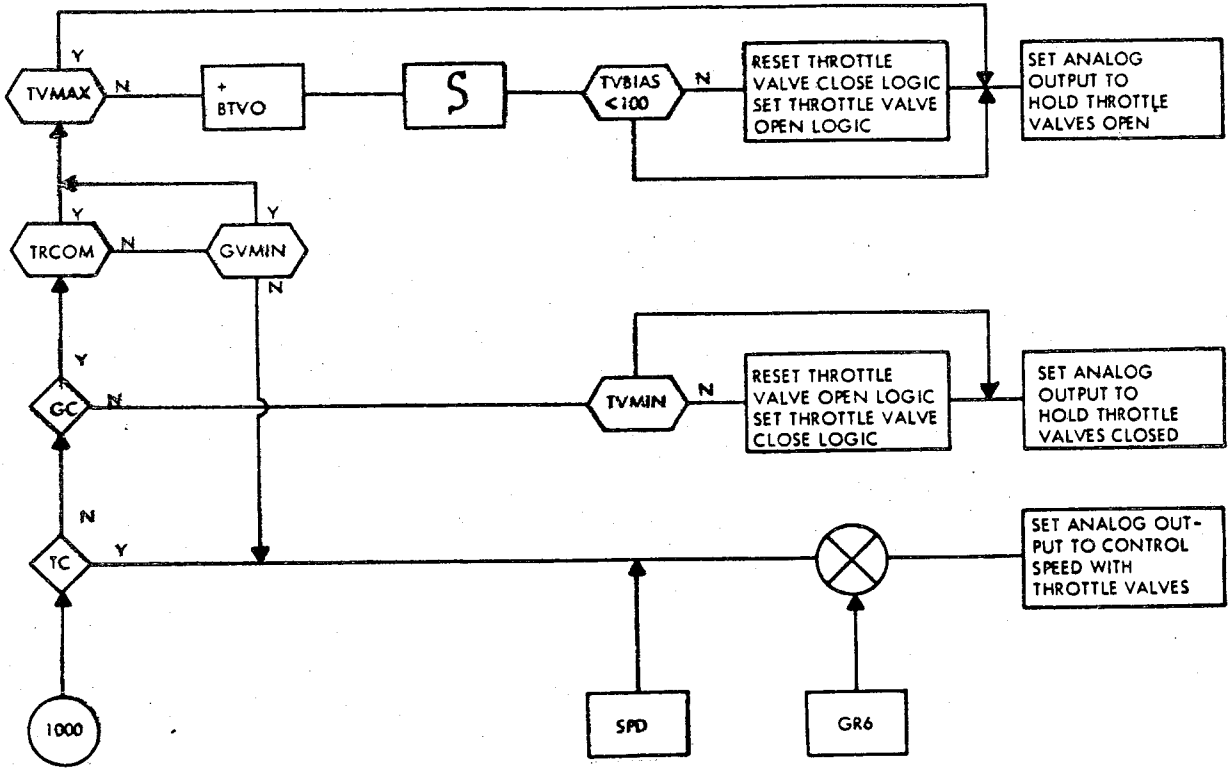
Figure 67:
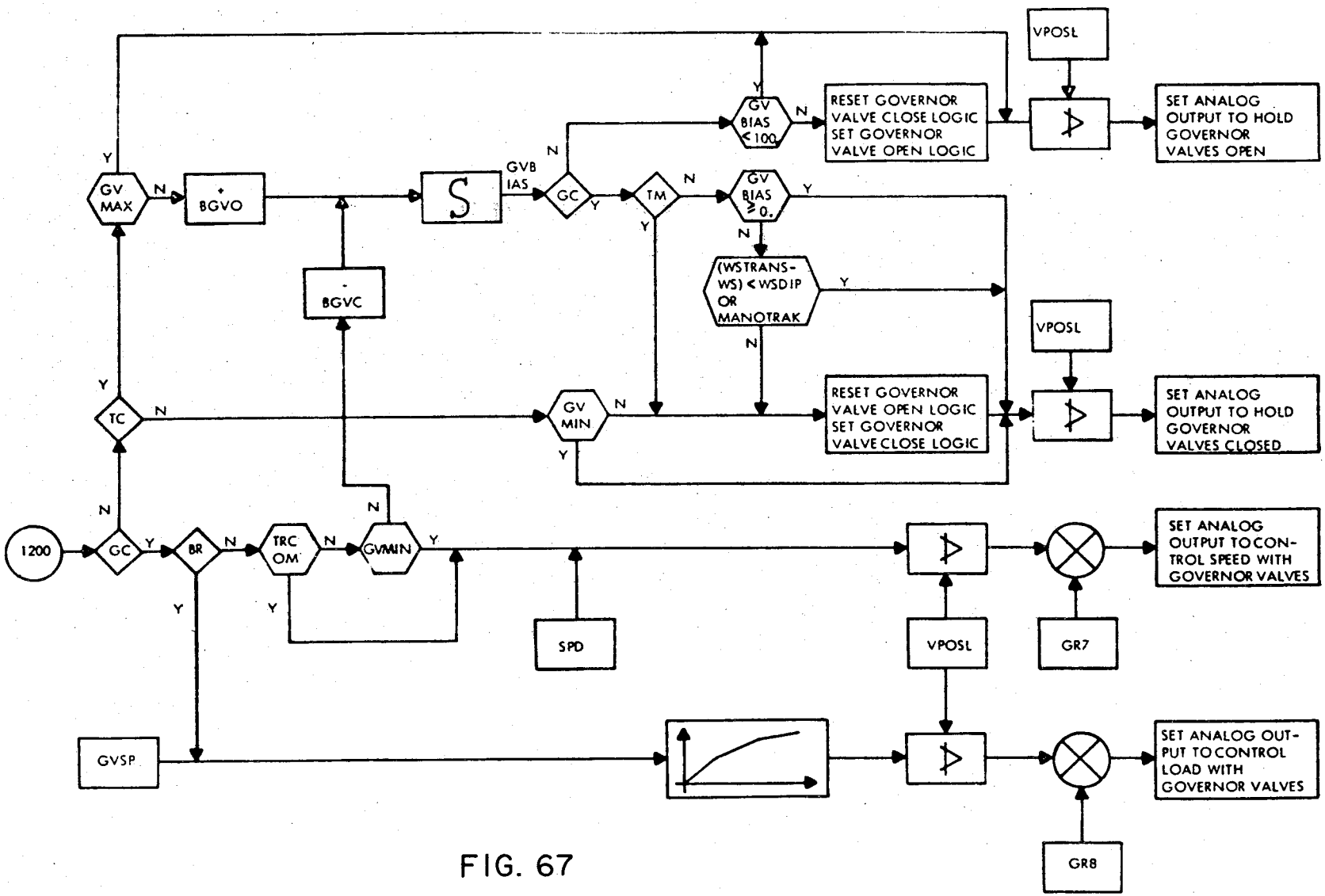
Figures 1, 67:
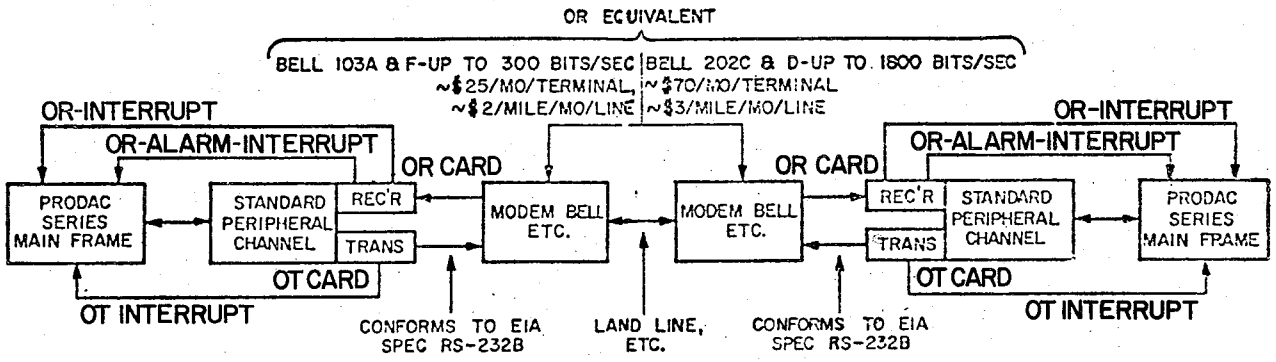
Figures 2, 67:
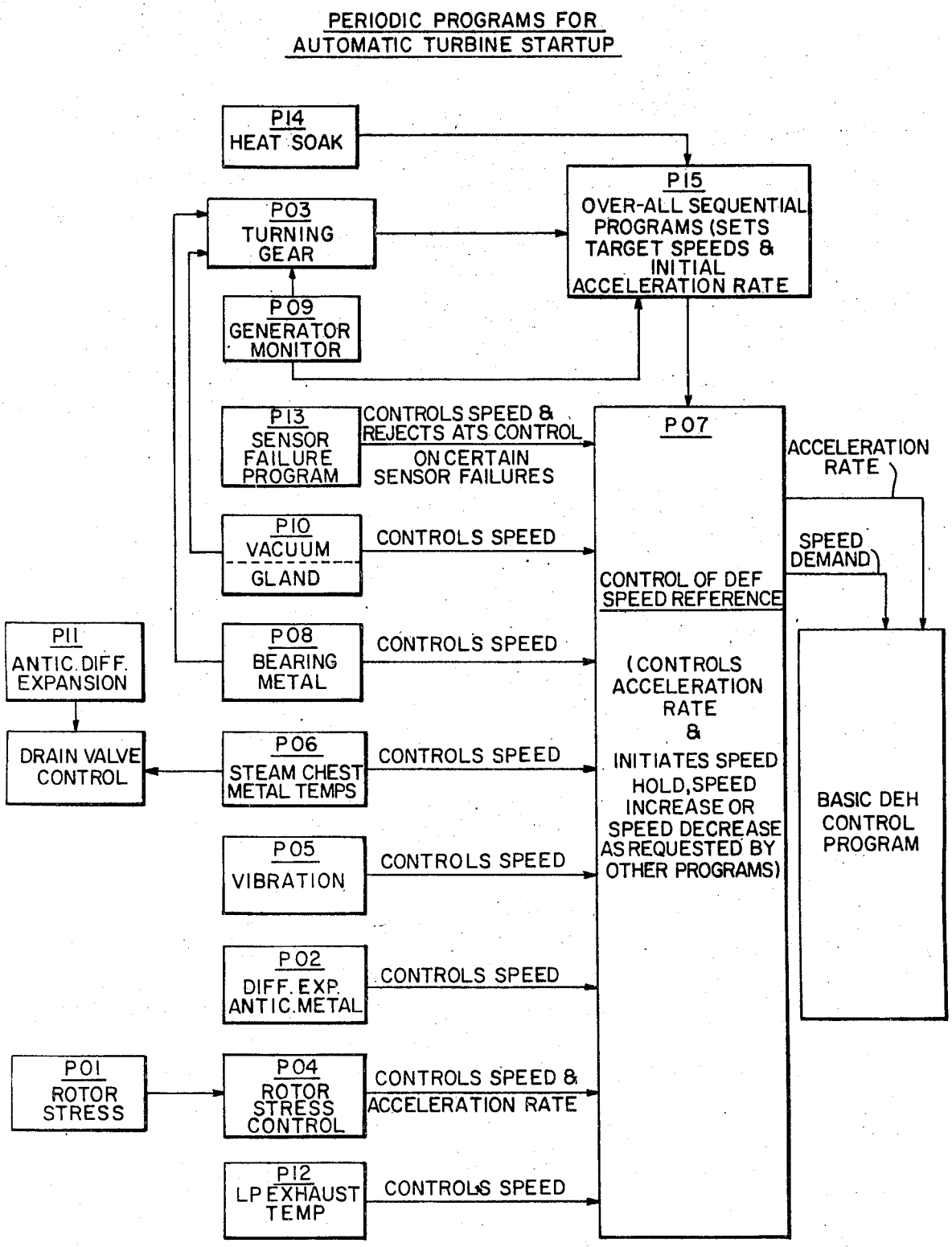
Figures 3, 67:
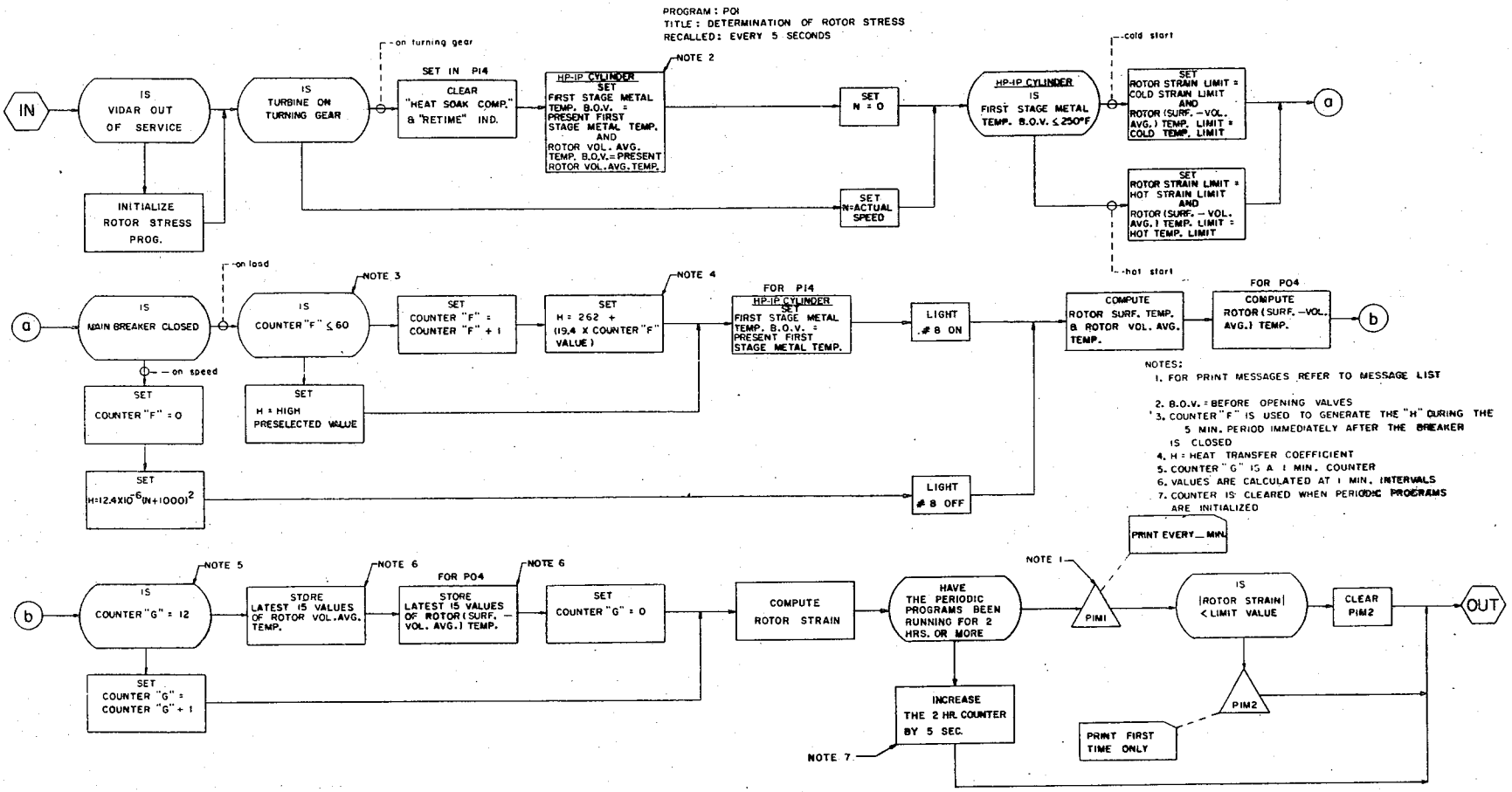
Figures 4, 67:
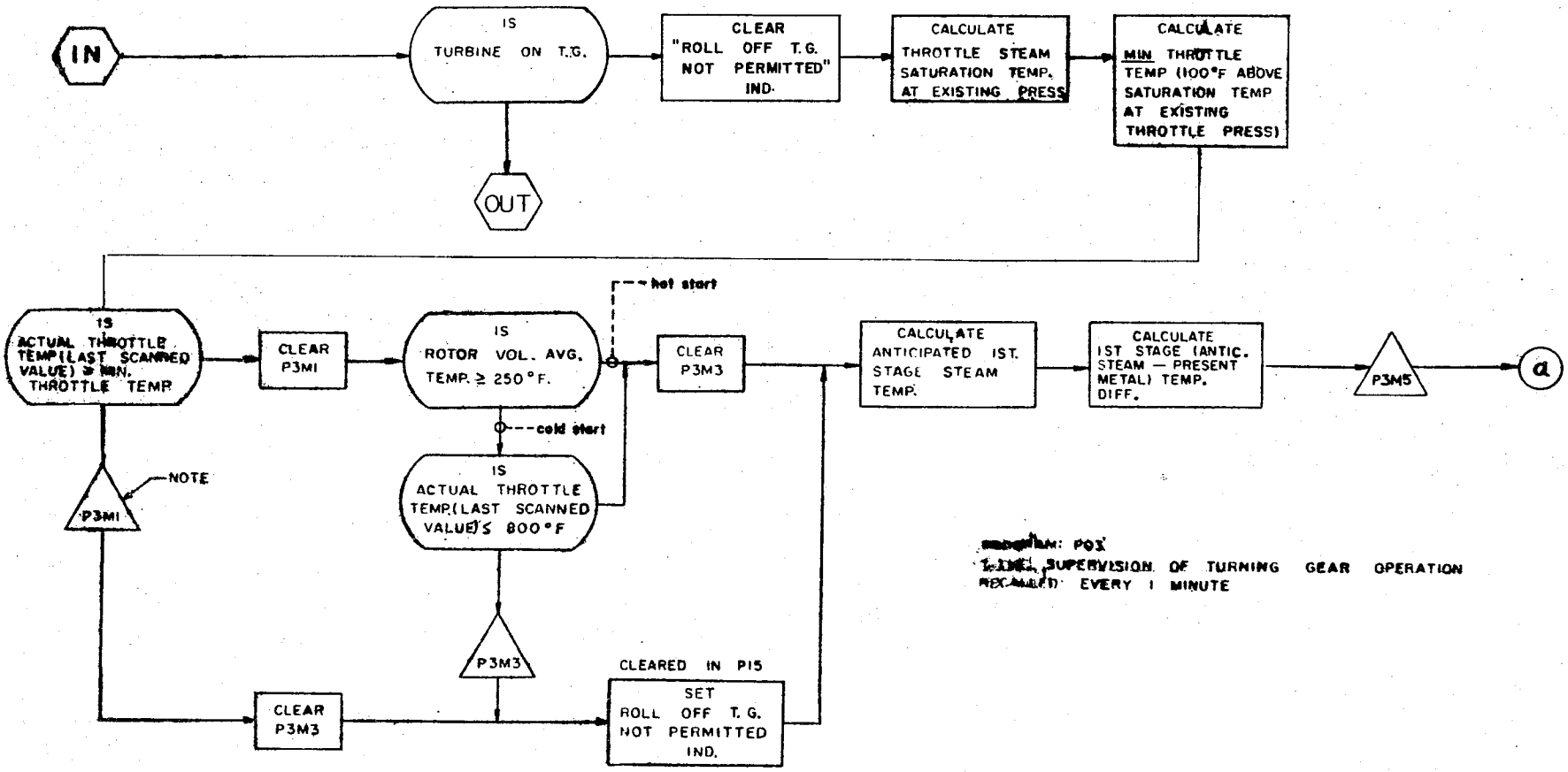
Figures 6A, 67:
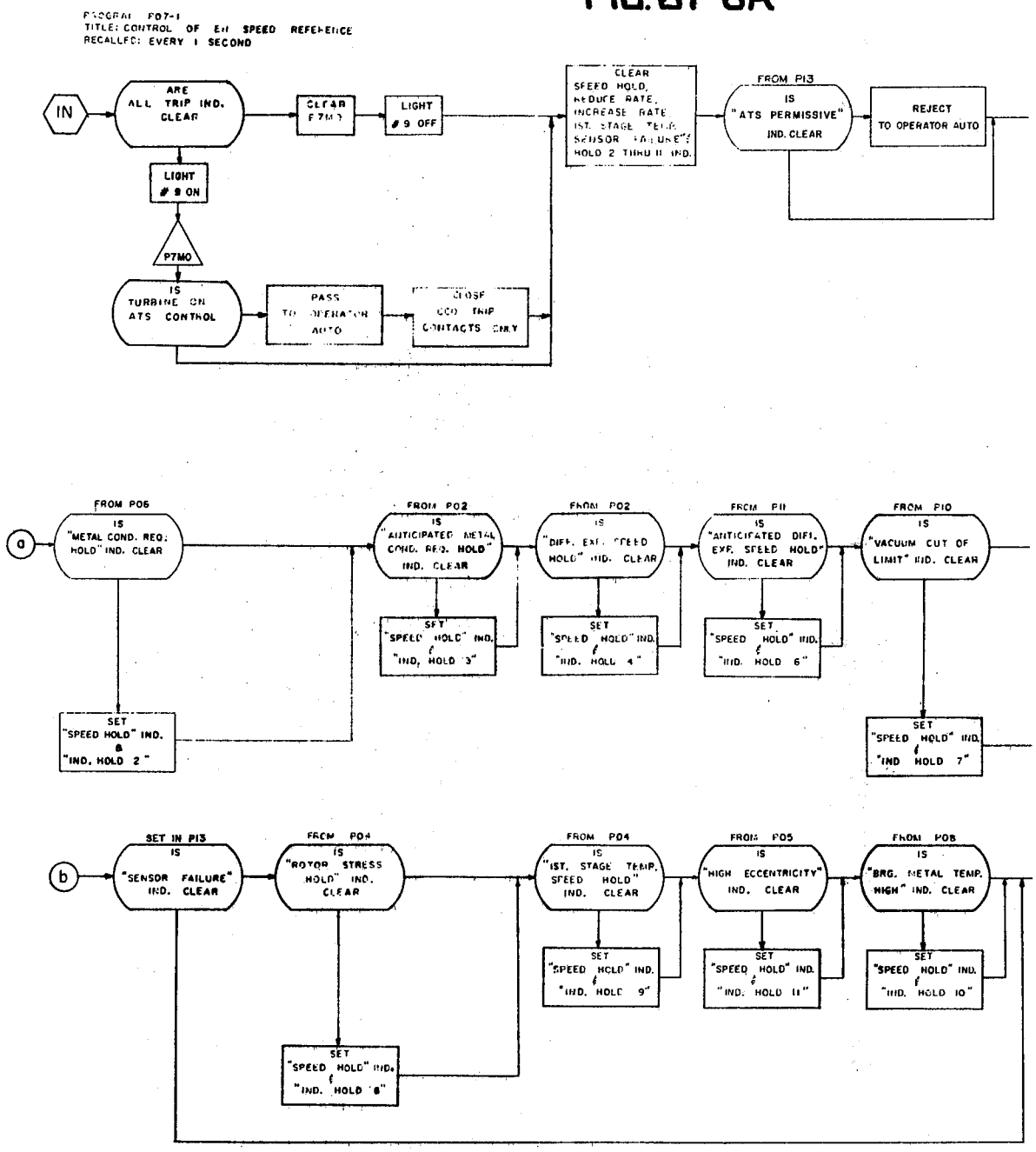
FIG. 6 shows a simplified block diagram of the digital Electro Hydraulic Control System in accordance with the principle of the invention.
Figures 6B, 67:
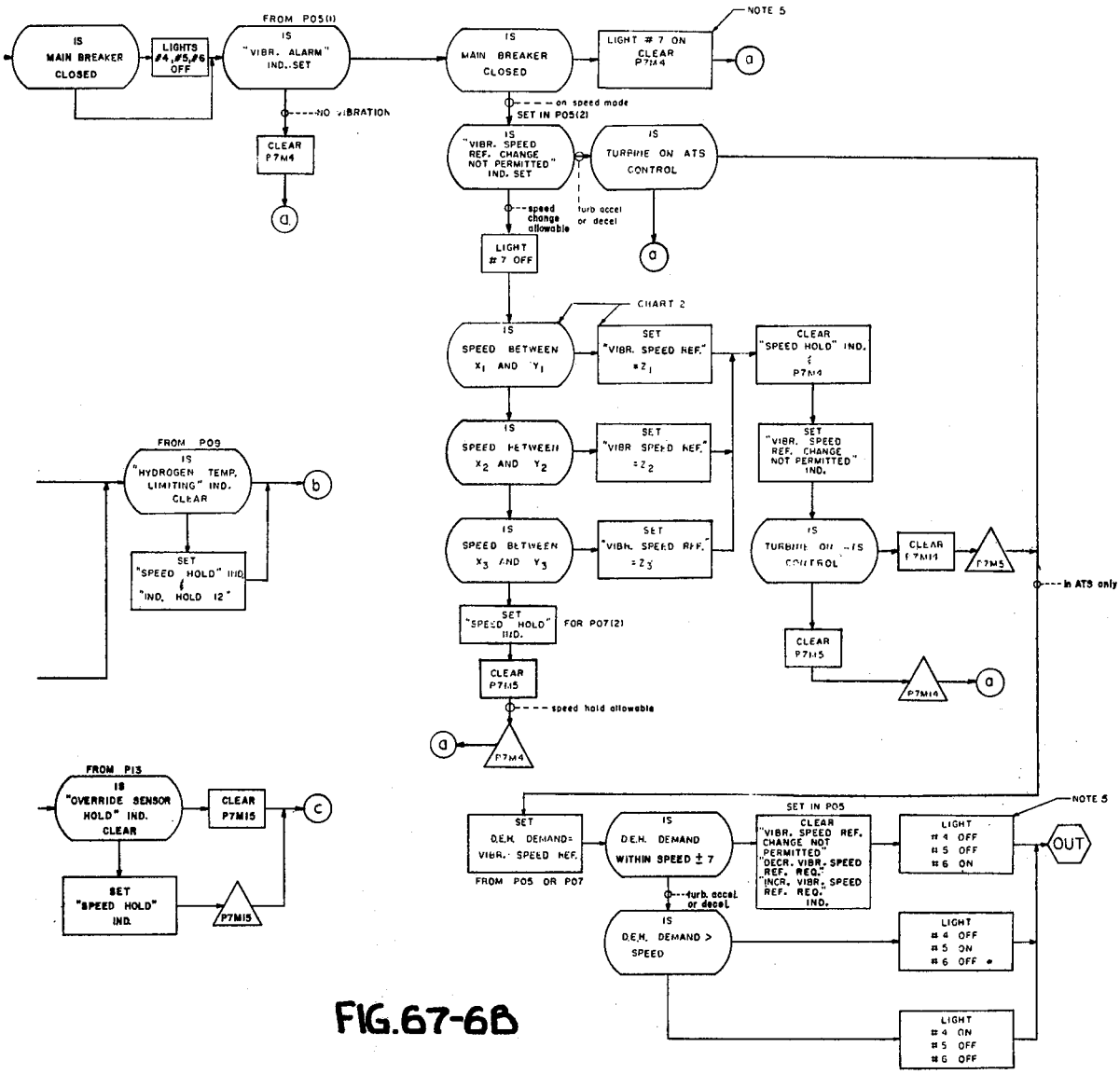
Figures 7, 67:
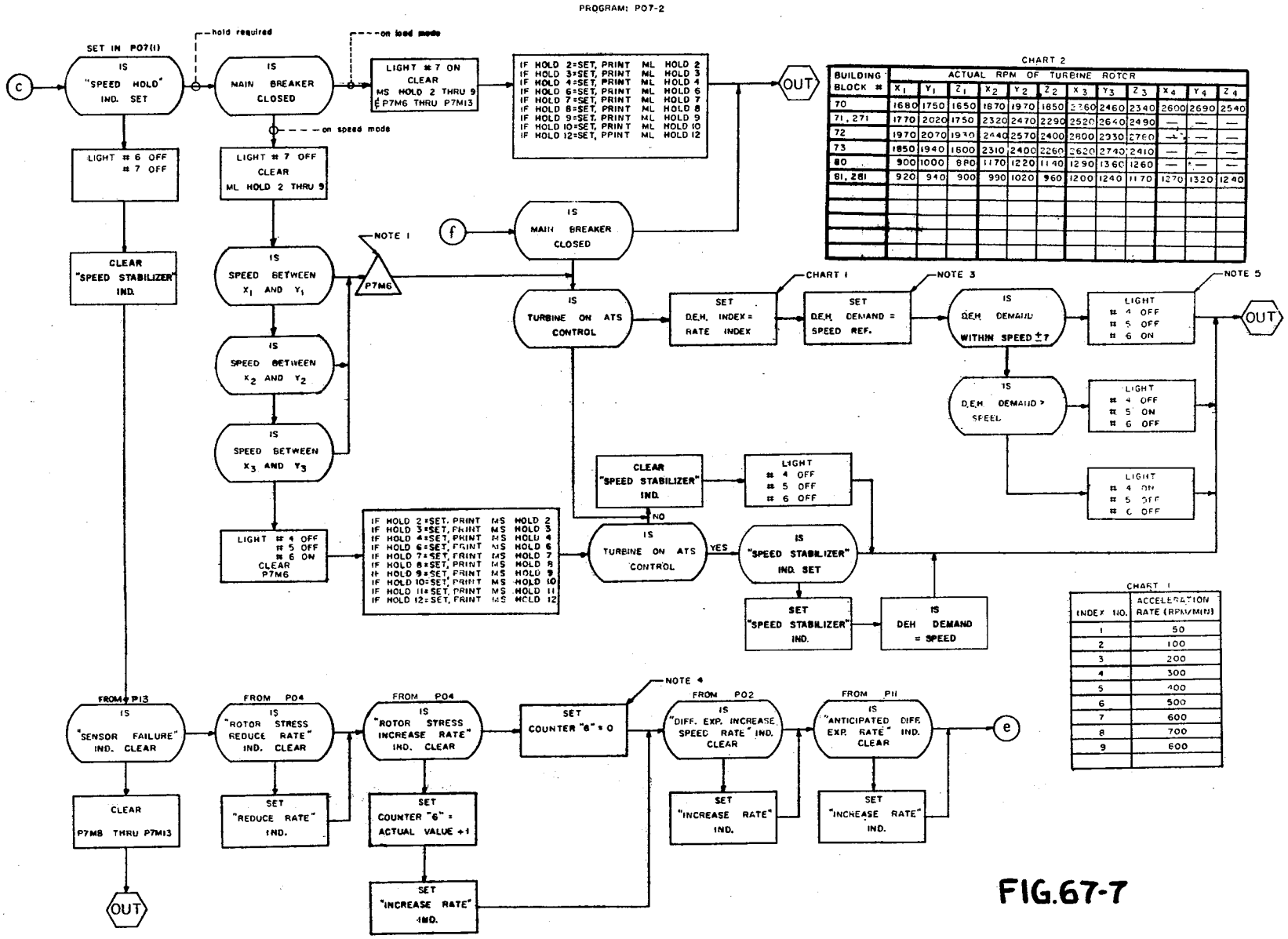
FIG. 7 shows a block diagram of a control program used in accordance with the principles of the invention.
Figures 8B, 67:
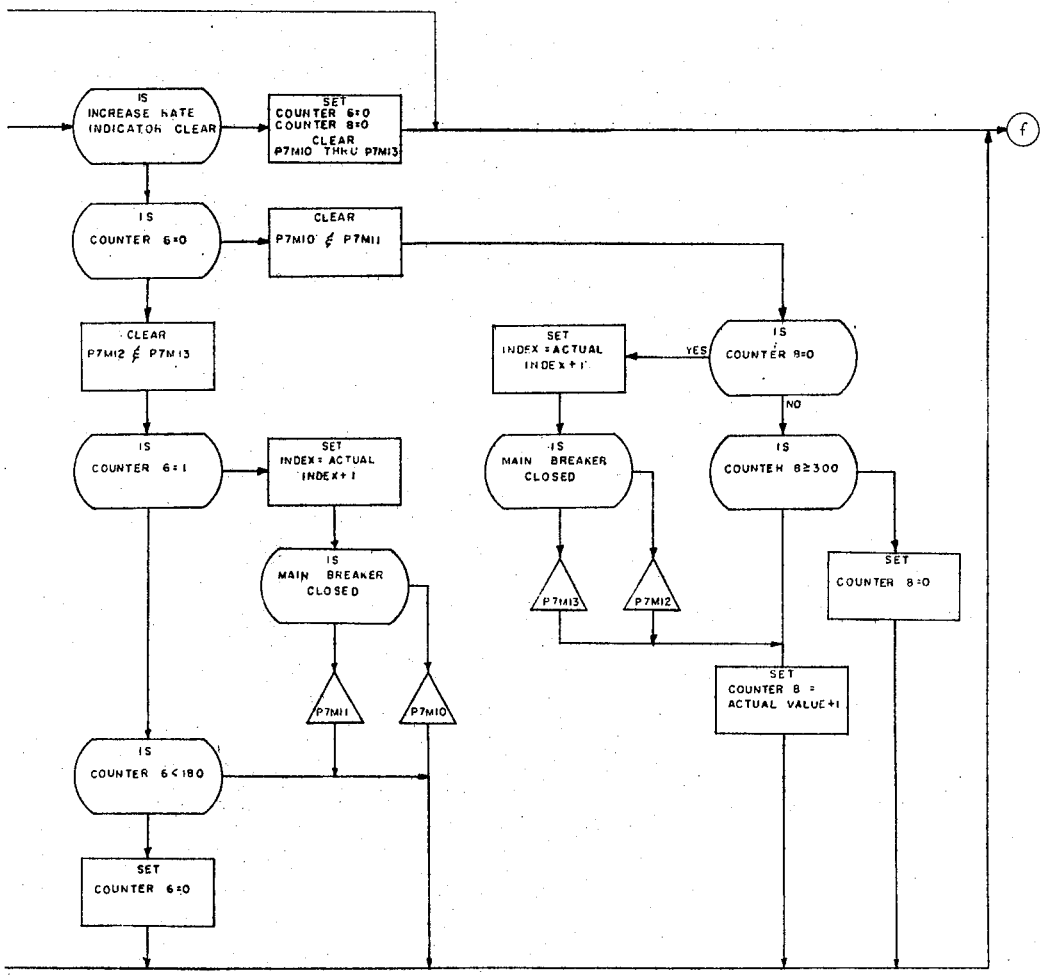
Figures 10A, 67:
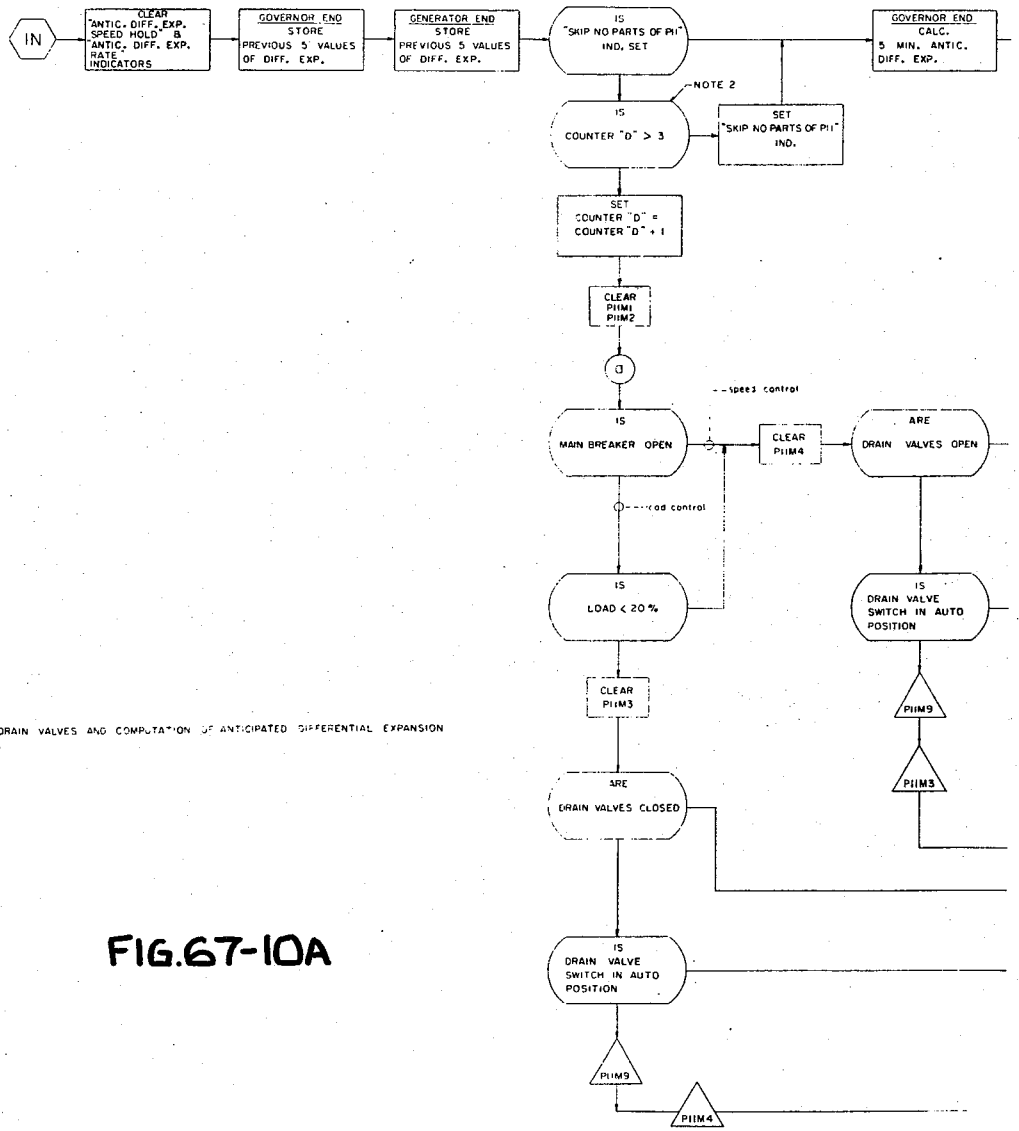
FIG. 10 shows the location of subroutines in accordance with the principles of the invention.
Figures 10B, 67:
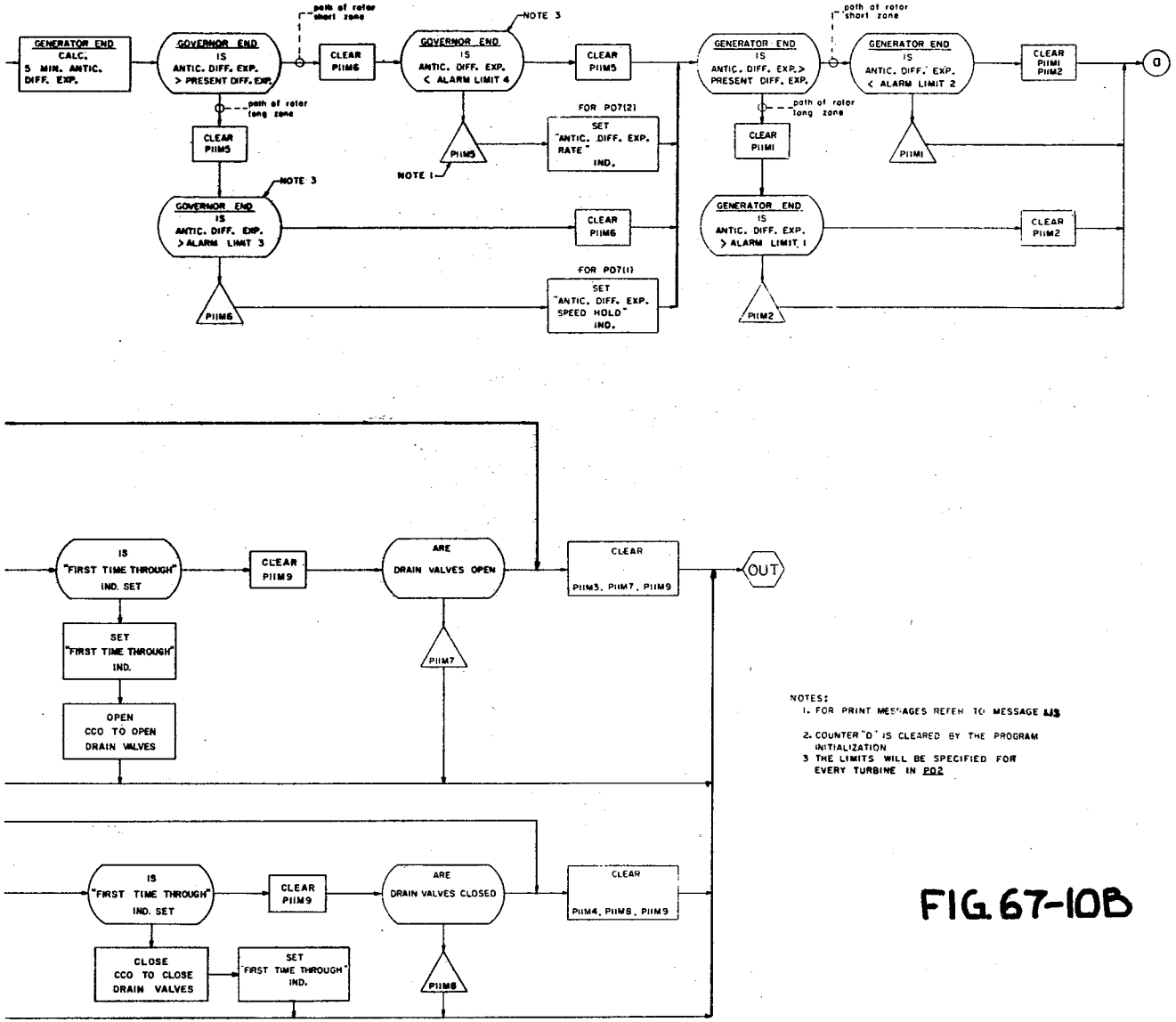
Figures 11A, 67:
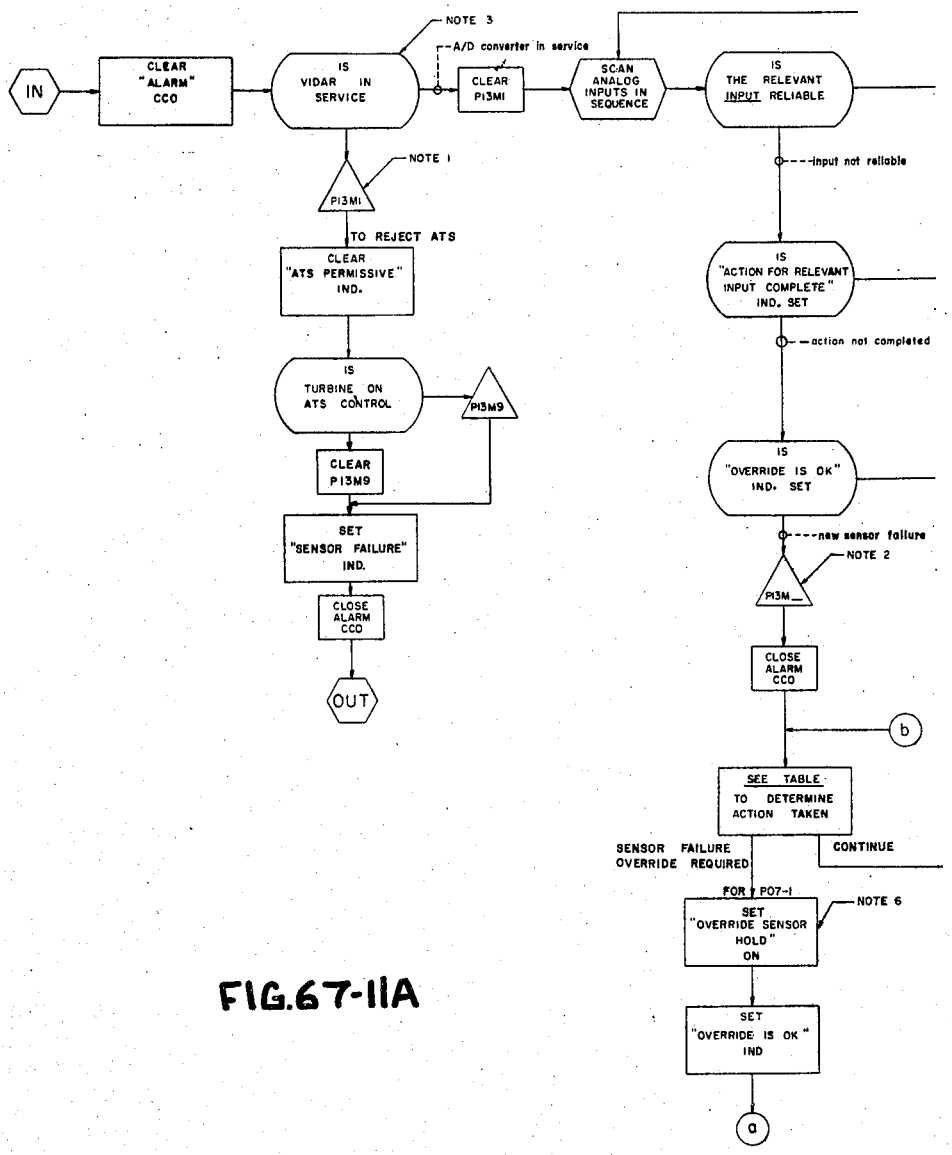
Figures 12A, 67:
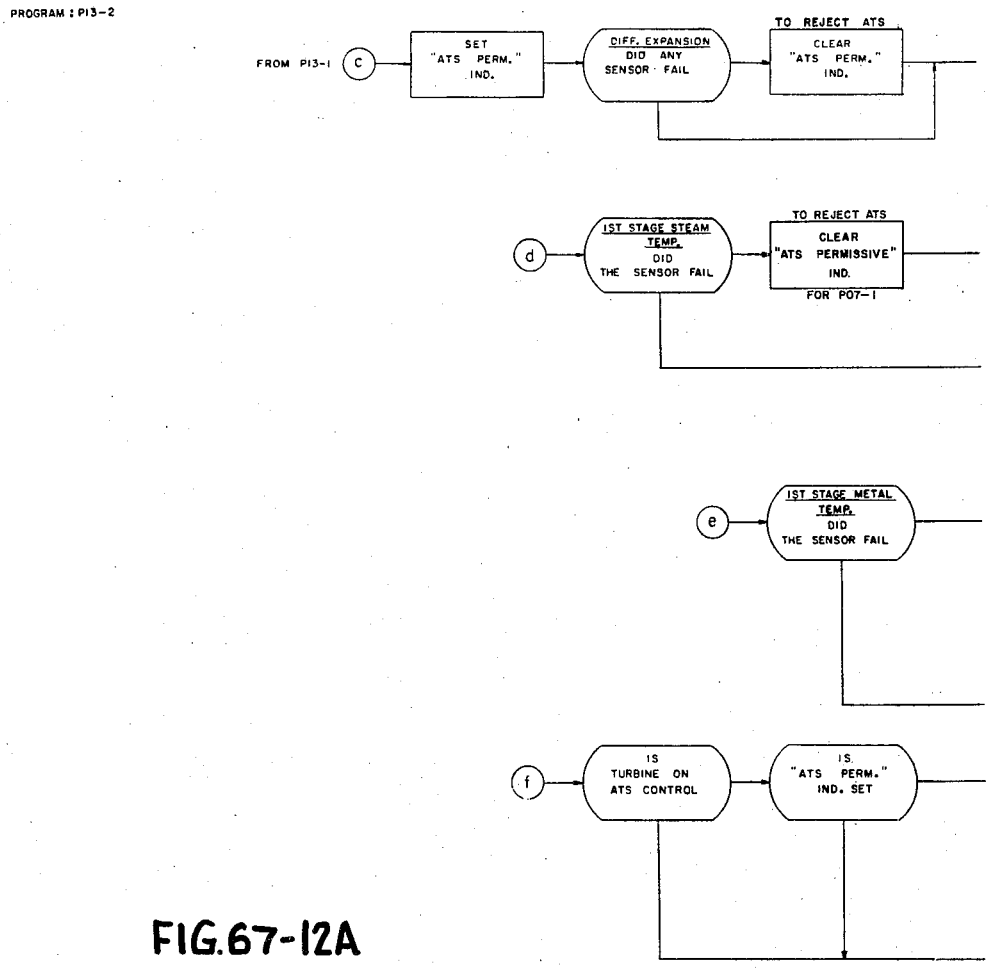
Figures 12B, 67:
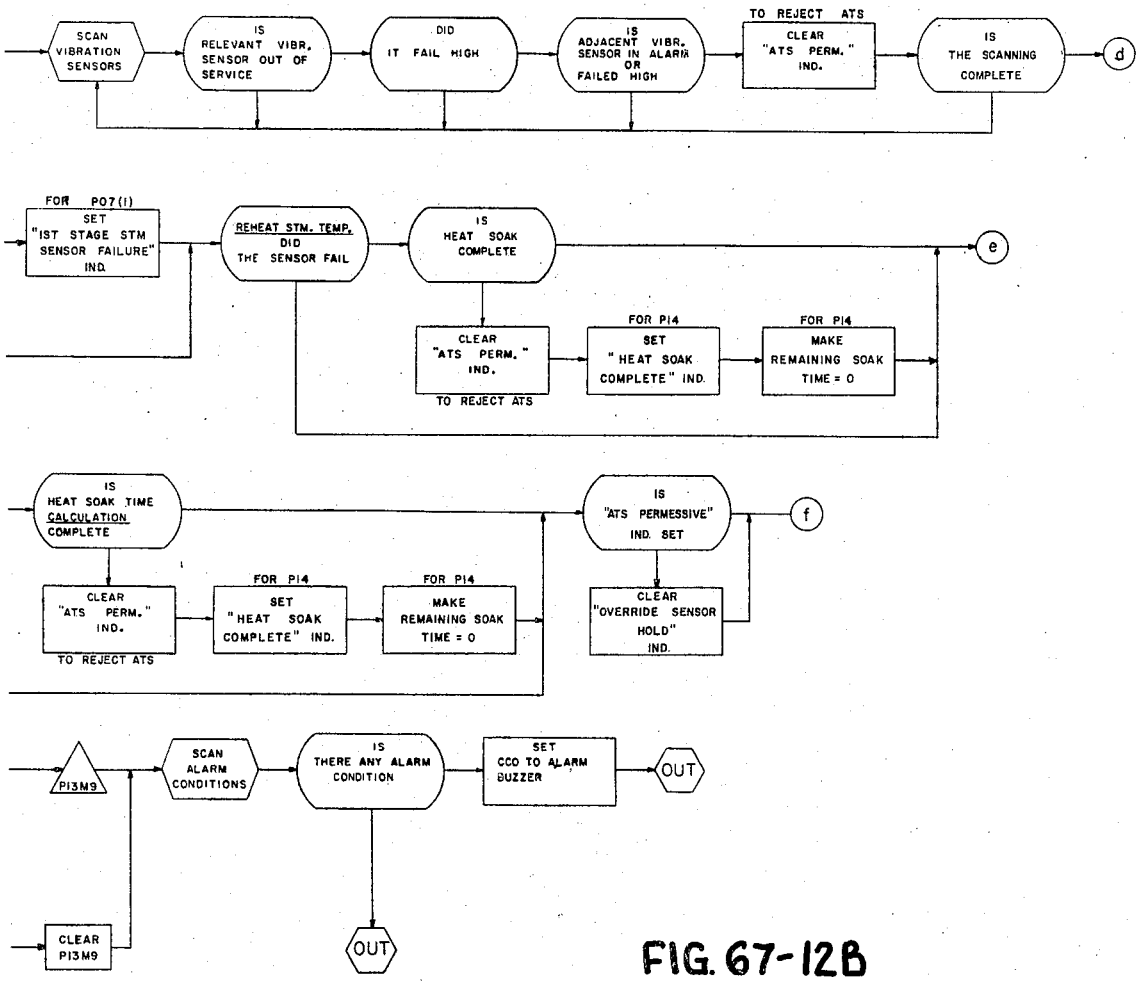
Figures 13A, 67:
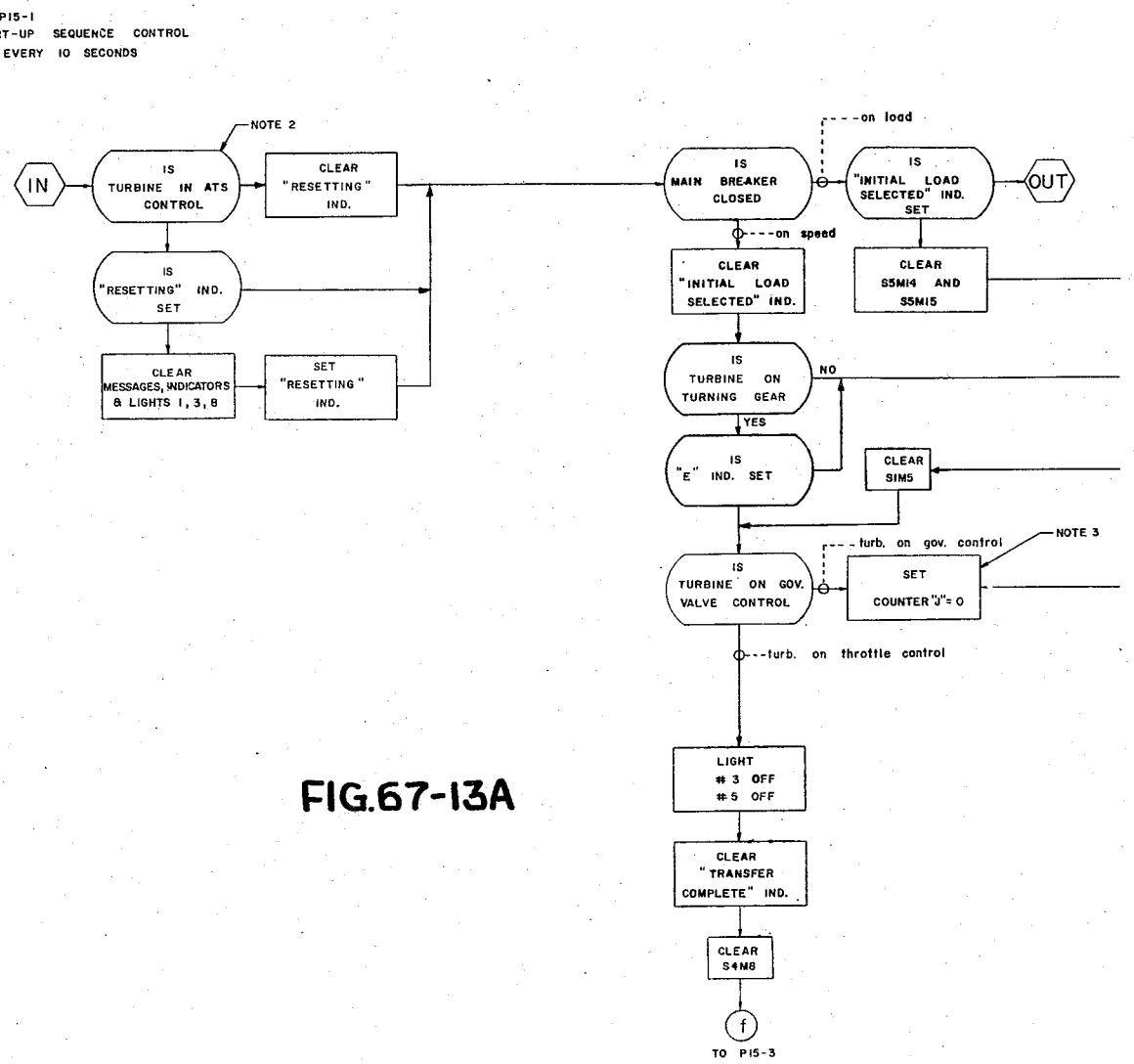
Figures 13B, 67:
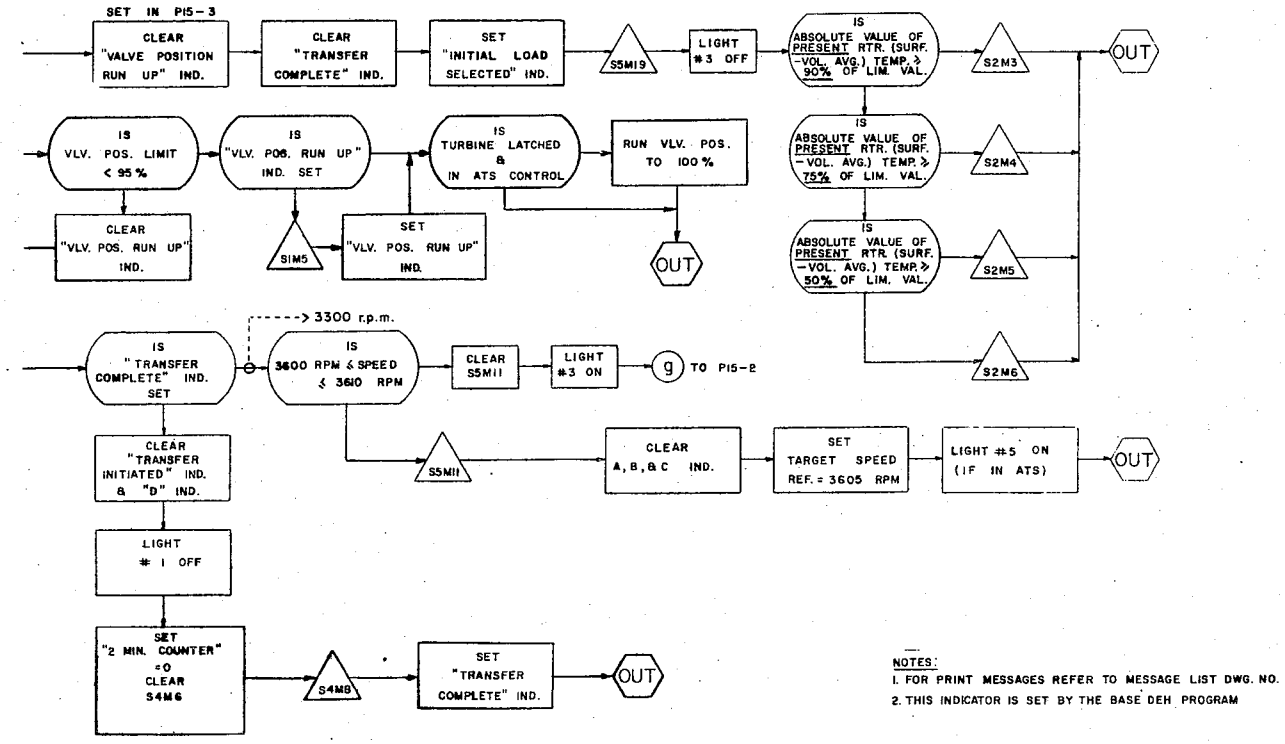
Figures 14A, 67:
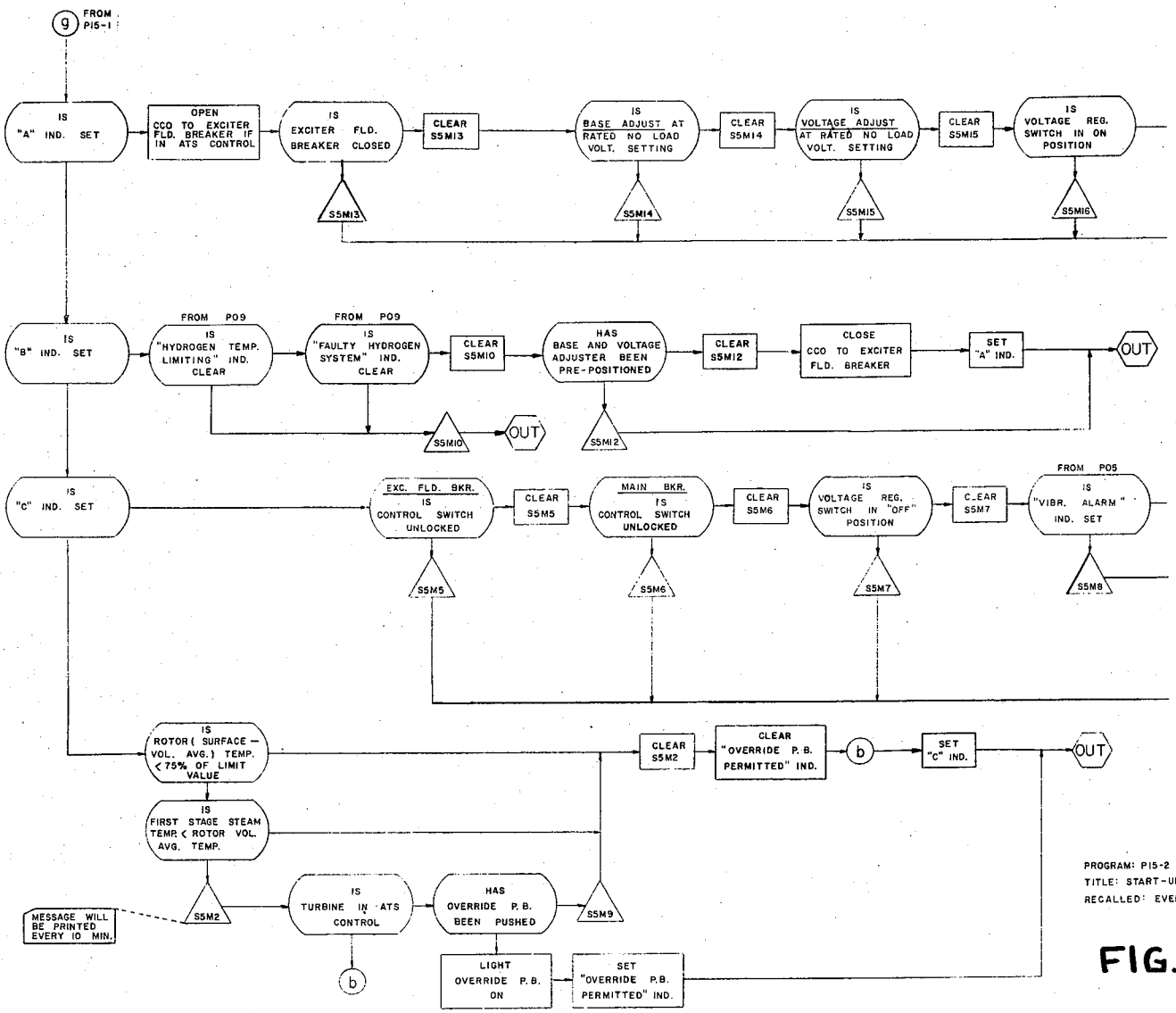
Figures 14B, 67:
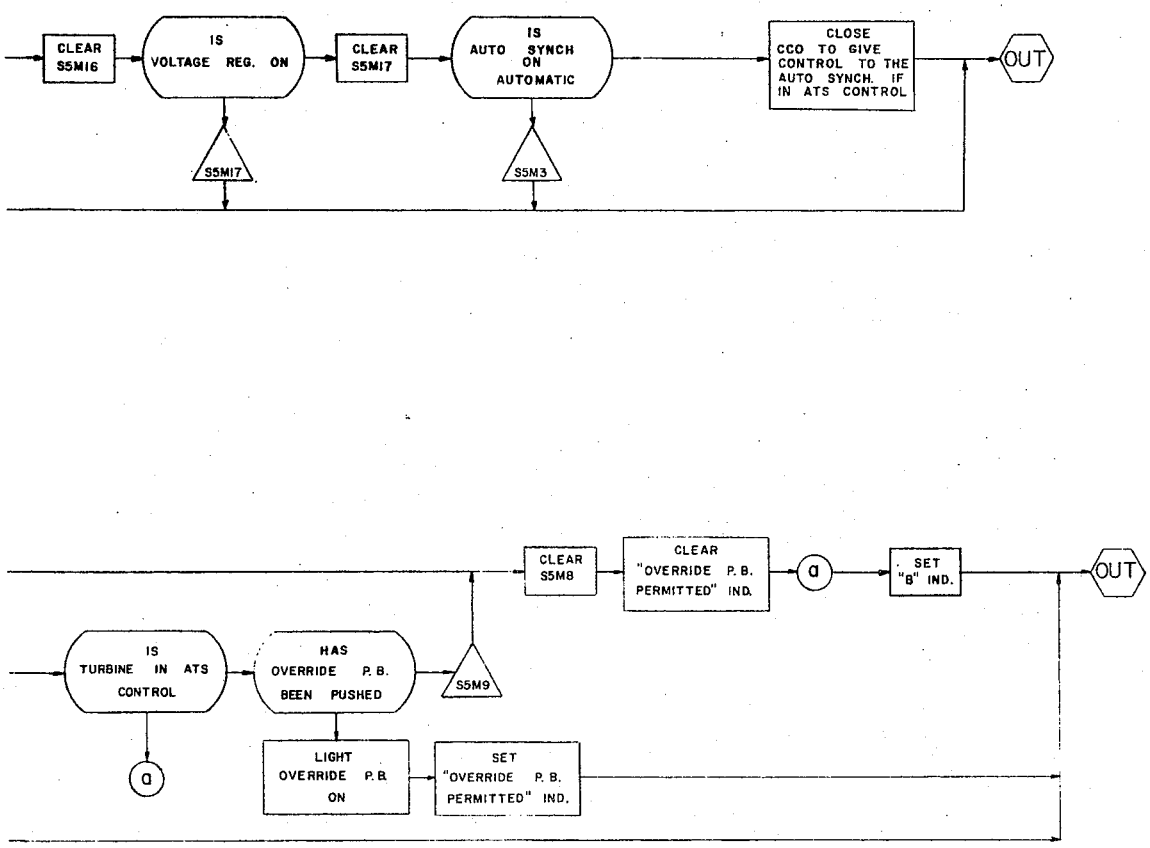
Figures 15A, 67:
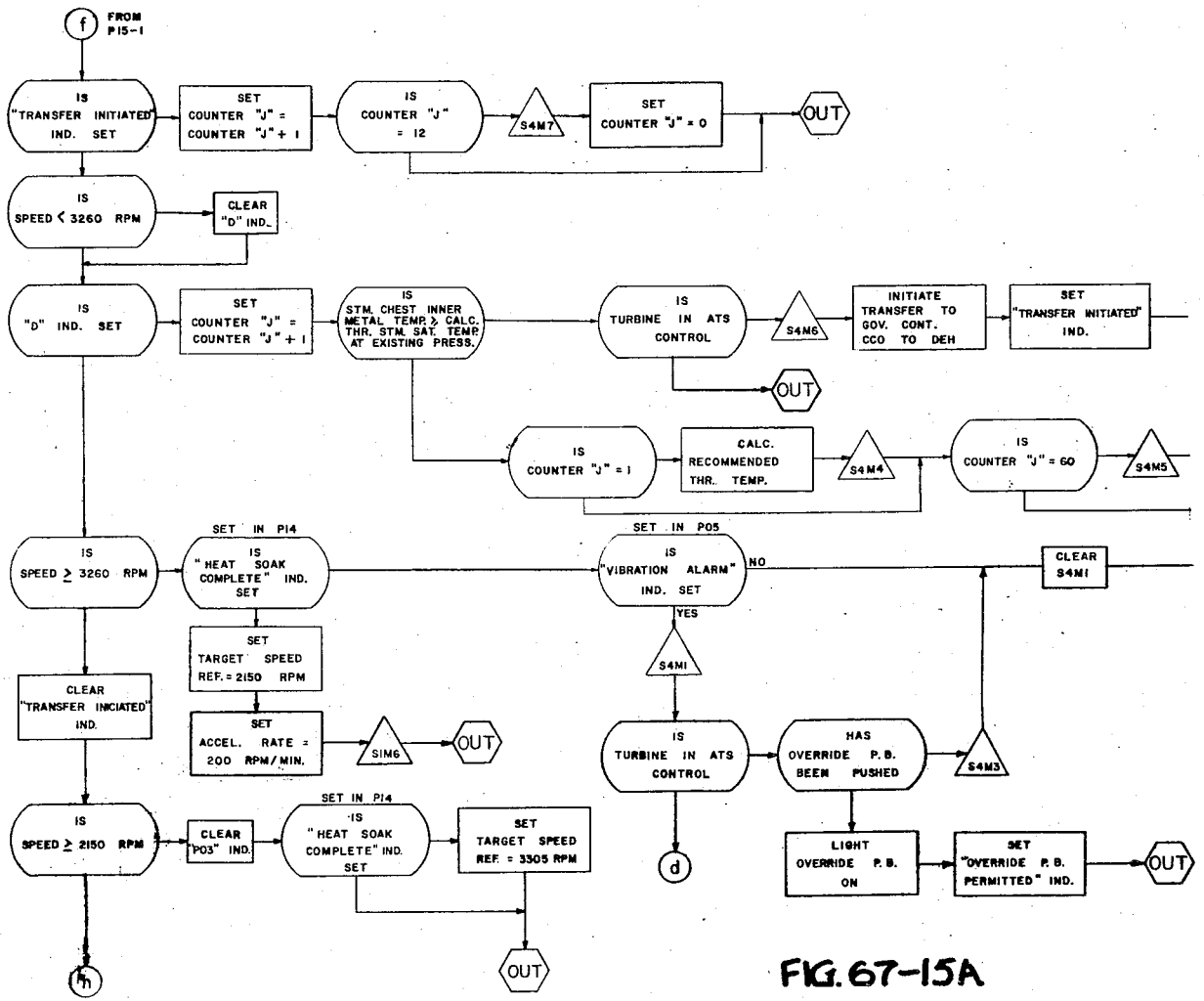
Figures 15B, 67:
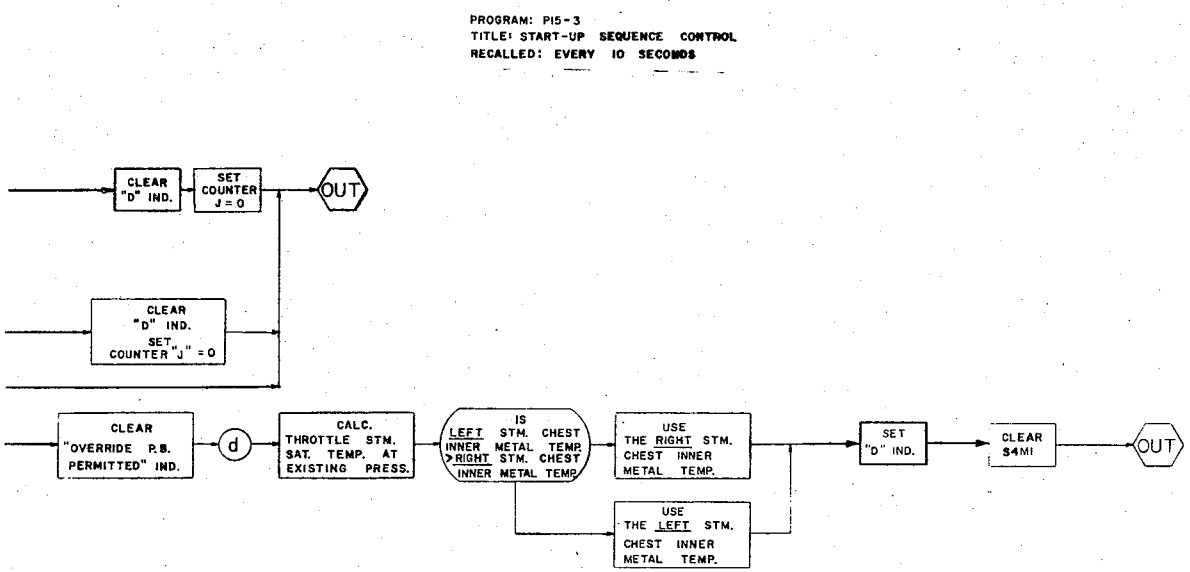
Figures 16A, 67:
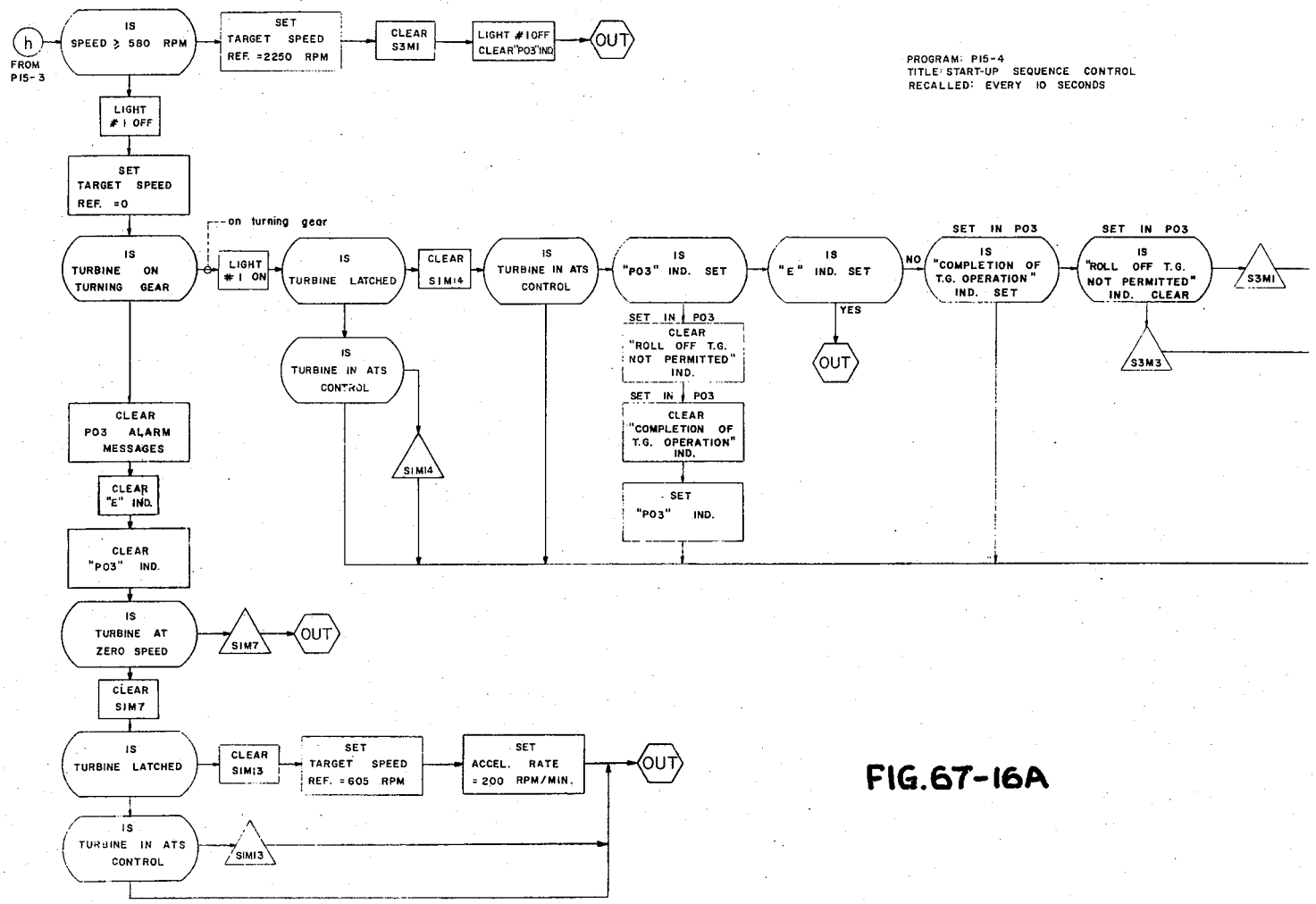
Figures 16B, 67:
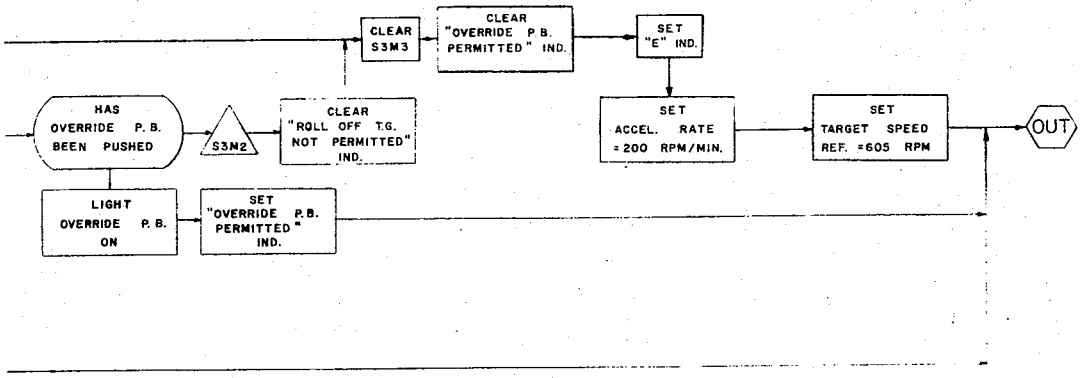
Figures 17, 67:
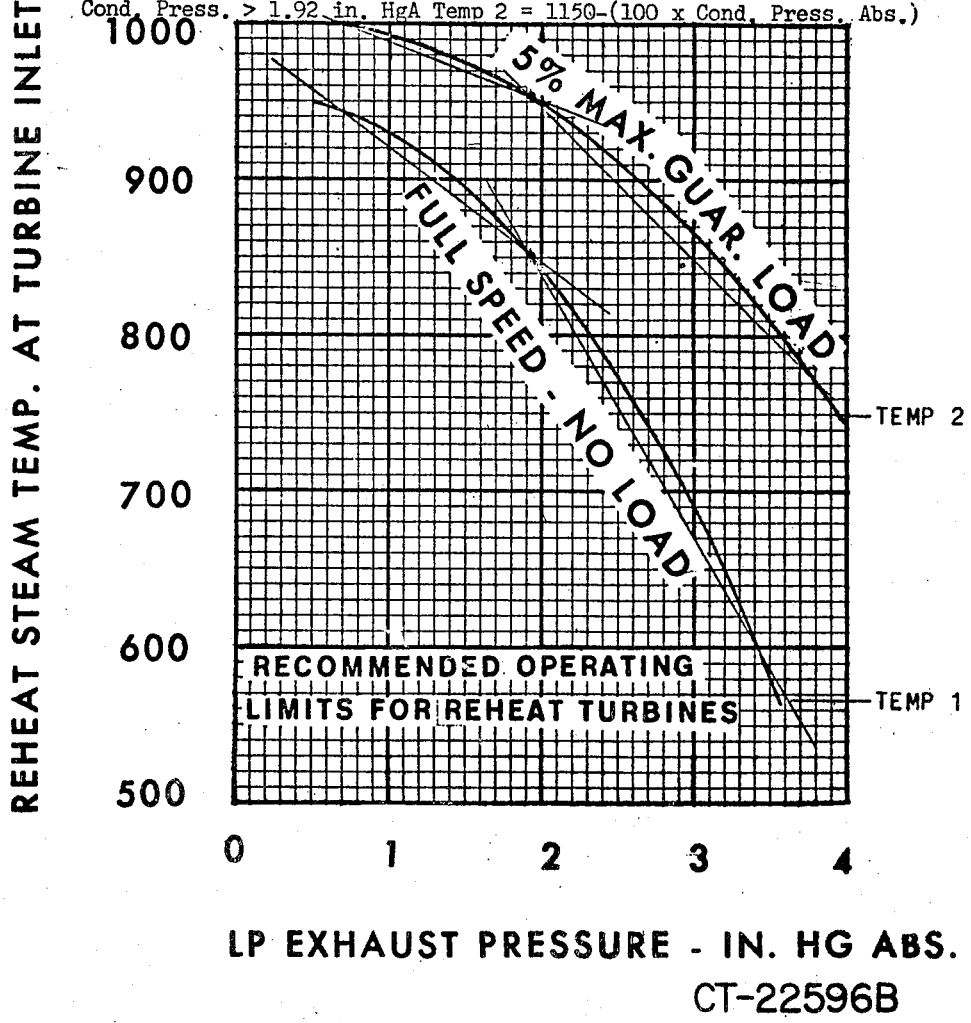
Figures 18, 67:
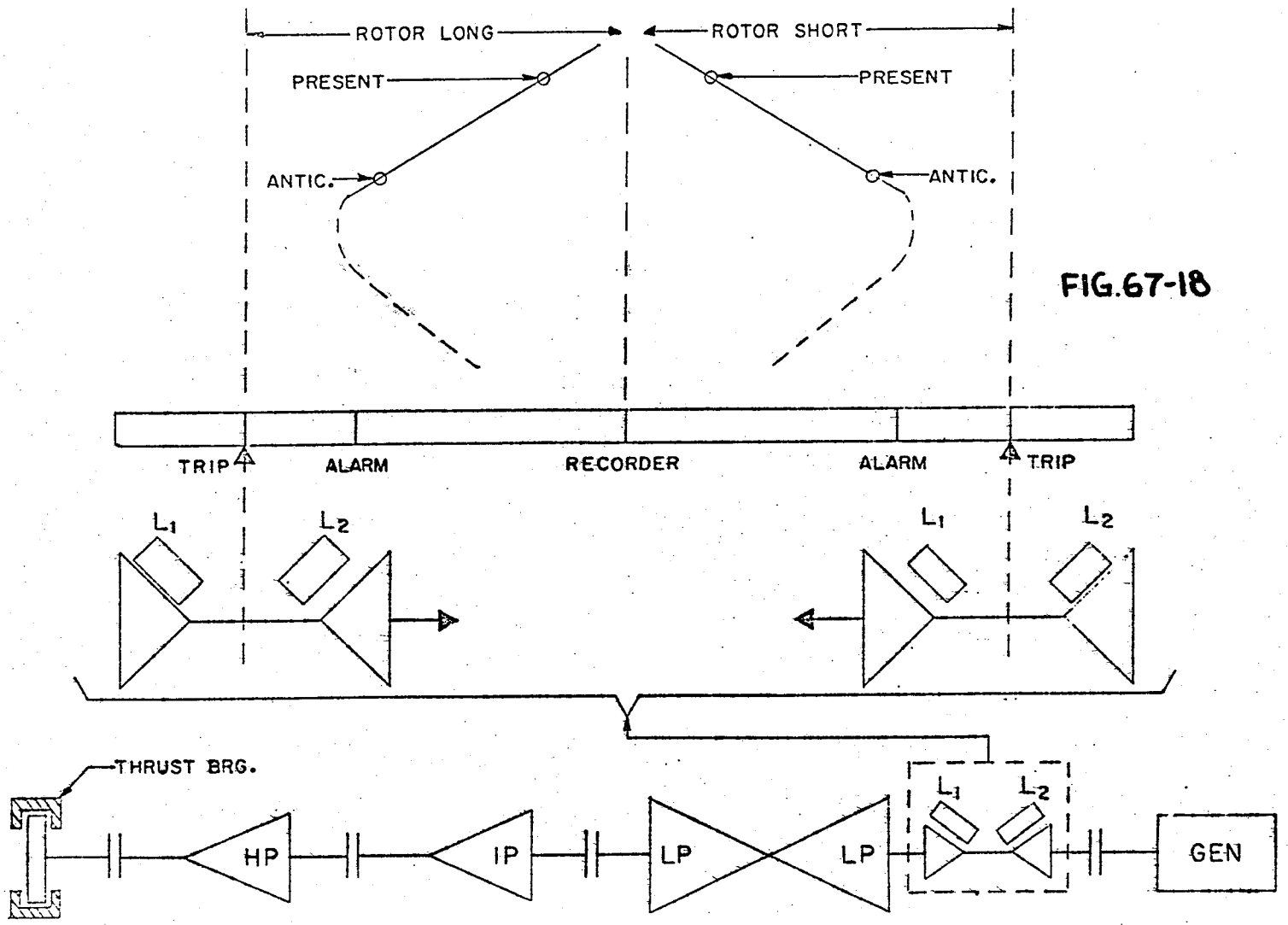
Figures 19, 67:
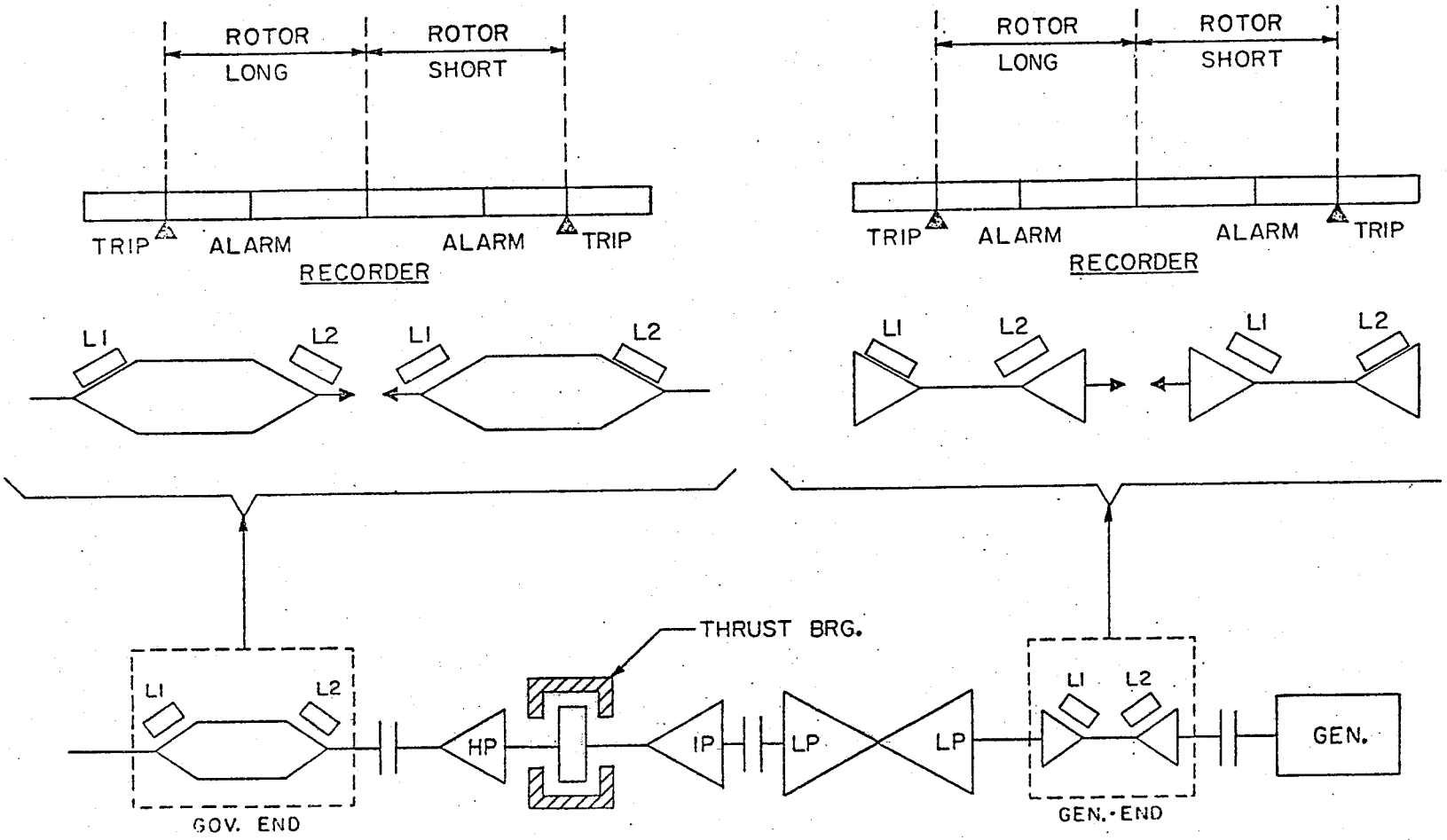
Figure 68:
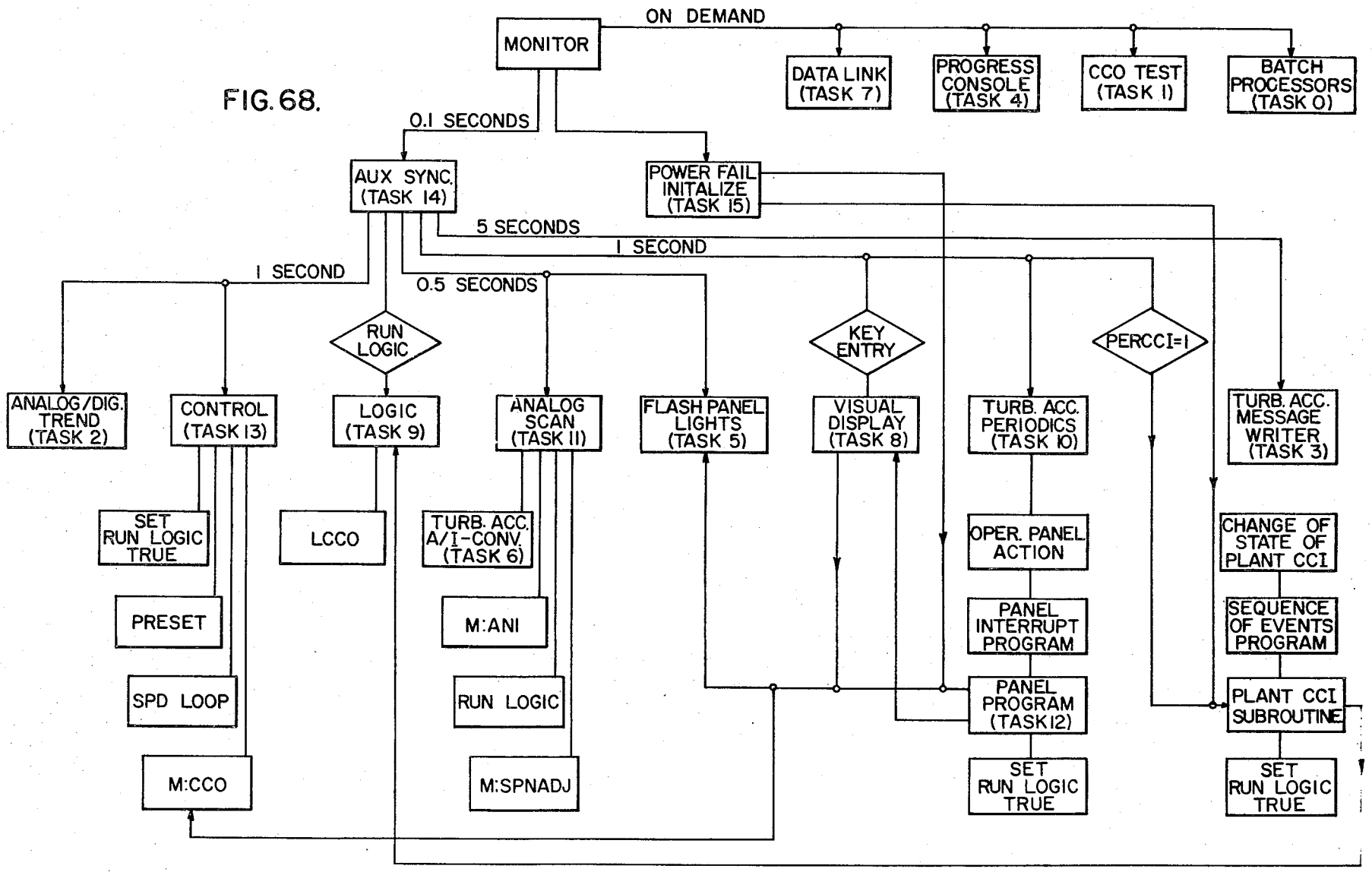

FIG. 17 shows a view of a part of an operator's control panel which is operable in accordance with the principles of the invention;

FIG. 18 shows a view of a part of the operator's control panel which is operable in accordance with the principles of the invention;

FIG. 19 shows a view of a portion of the operator's control panel which is operable in accordance with the principles of the invention;

FIG. 20 shows a flow chart of a flash task which is operable in accordance with the principles of the invention;

FIG. 21 is a flow chart of a contact closure output test program which is operable in accordance with the principles of the invention;

FIG. 22 is a block diagram of a contact input scan program with a sequence of events interrupt program therein which is operable in accordance with the principles of the invention;

FIG. 23 is a flow chart of the sequence of events interrupt program which is operable in accordance with the principles of the invention;

FIG. 24 is a block diagram of a breaker upon interrupt program which is operable in accordance with the principles of the invention;

FIG. 25 is a flow chart of the breaker open interrupt program which is operable in accordance with the principles of the invention;

FIG. 26 is a block diagram of error action with a task error program which is operable in accordance with the principles of the invention;

FIG. 27 is a block diagram of a turbine trip interrupt program which is operable in accordance with the principles of the invention;

FIG. 28 is a block diagram of a panel interrupt program which is operable in accordance with the principles of the invention;

FIG. 29 is a block diagram of a valve interrupt program which is operable in accordance with the principles of the invention;

FIG. 30 is a flow chart of a stop/initializer program which is operable in accordance with the principles of the invention;

FIG. 31 is a table of display buttons which is operable in accordance with the principles of the invention;

FIG. 32 is a block diagram of a visual display system which is operable in accordance with the principles of the invention;

FIG. 33 is a block diagram of the execution of a two-part visual display function which is operable in accordance with the principles of the invention;

FIG. 34 is a block diagram of an analog scan system which is operable in accordance with the principles of the invention;

FIG. 35 is a timing chart of the various programs and functions within the Digital Electro Hydraulic System which is operable in accordance with the principles of the invention;

FIG. 36 is a flow chart of a logic contact closure output subroutine which is operable in accordance with the principles of the invention;

FIG. 37 is a block diagram of conditions which cause initiation of a logic program which is operable in accordance with the principles of the invention;

FIG. 38 is a simplified block diagram of a portion of the logic function which is operable in accordance with the principles of the invention;

FIG. 39 is a block diagram of the logic program which is operable in accordance with the principles of the invention;

FIG. 40 is a flow chart of a maintenance test logic program which is operable in accordance with the principles of the invention;

FIG. 41 is a flow chart of a turbine supervision of logic program which is operable in accordance with the principles of the invention;

FIG. 42 is a flow chart of a transfer to manual operation subroutine which is operable in accordance with the principles of the invention;

FIG. 43 is a block diagram of a load control system which is operable in accordance with the principles of the invention;

FIG. 44 is a flow chart of a breaker logic program which is operable in accordance with the principles of the invention;

FIG. 45 is a flow chart of a logic pressure control logic subroutine which is operable in accordance with the principles of the invention;

FIG. 46 is a block diagram of a megawatt feedback loop subroutine which is operable in accordance with the principles of the invention;

FIG. 47 is a block diagram of an impulse pressure loop with megawatt loop in service which is operable in accordance with the principles of the invention;

FIG. 48 is a flow chart of an automatic synchronize logic program which is operable in accordance with the principles of the invention;

FIG. 49 is a flow chart of an automatic dispatch logic program which is operable in accordance with the principles of the invention;

FIG. 50 is a flow chart of an automatic turbine startup program which is operable in accordance with the principles of the invention;

FIG. 51 is a flow chart of a remote transfer logic subroutine which is operable in accordance with the principles of the invention;

FIG. 52 is a block diagram showing a panel task interaction function which is operable in accordance with the principles of the invention;

FIG. 53 is a block diagram of a panel program which is operable in accordance with the principles of the invention;

FIG. 54 is a block diagram showing a control task interface which is operable in accordance with the principles of the invention;

FIG. 55 is a block diagram showing a control program which is operable in accordance with the principles of the invention;

FIG. 56 is a block diagram showing a valve position limit function which is operable in accordance with the principles of the invention;

FIG. 56*a* is a block diagram showing a valve position limit adjustment function which is operable in accordance with the principles of the invention;

FIG. 57 shows an interaction between the DEH program and a valve test function which is operable in accordance with the principles of the invention;

FIG. 58 is a flow chart showing a valve contingency program which is operable in accordance with the principles of the invention;

FIG. 59 shows a block diagram of a speed instrumentation and computation interface with special speed sensing circuitry which is operable in accordance with the principles of the invention;

FIGS. 60*a* and 60*b* show flow charts of a speed selection function which is operable in accordance with the principles of the invention;

FIG. 61 shows a block diagram of an operating mode selection function which is operable in accordance with the principles of the invention;

FIG. 61*a* shows a flow chart of a select operating mode function which is operable in accordance with the principles of the invention;

FIG. 61*b* shows a flow chart of a select operating mode function which is operable in accordance with the principles of the invention;

FIG. 62 shows a symbolic diagram of the use of a speed/load reference function which is operable in accordance with the principles of the invention;

FIG. 63 shows a speed/load reference graph which is operable in accordance with the principles of the invention;

FIG. 64 is a block diagram showing a speed control function which is operable in accordance with the principles of the invention;

FIG. 65 shows a block diagram of the load control system which is operable in accordance with the principles of the invention;

FIG. 65*a* includes a flow chart of the load control system which is operable in accordance with the principles of the invention;

FIG. 66 shows a block diagram of the throttle valve control function which is operable in accordance with the principles of the invention;

FIG. 67 shows a mixed block diagram of a governor control function program which is operable in accordance with the principles of the invention;

FIG. 67-1 shows a block diagram of the data link program which is operable in accordance with the principles of the invention;

FIG. 67-2 shows a block diagram of the sense parameters in the automatic turbine startup and monitoring program which is operable in accordance with the principles of the invention;

FIG. 67-3 shows a flow chart of a program for determining the rotor stresses in the turbine rotor which is operable in accordance with the principles of the invention;

FIG. 67-4 shows a flow chart of the ATS roll-off subroutine which is operable in accordance with the principles of the invention;

FIG. 67-5 shows a flow chart of the ATS turbine latching and load references which are operable in accordance with the principles of the invention;

FIG. 67-6A and B show a portion of the flow chart of the ATS program which is operable in accordance with the principles of the invention;

FIG. 67-7 shows a flow chart of the ATS program with library charts which is operable in accordance with the principles of the invention;

FIG. 67-8A and B show the flow chart of the ATS acceleration program which is operable in accordance with the principles of the invention;

FIG. 67-9 shows a chart of generator conditions which is operable in accordance with the principles of the invention;

FIG. 67-10 shows a flow chart of the ATS program governor valve control and drain control which are operable in accordance with the principles of the invention;

FIG. 67-11A and B shows a flow chart of the ATS program sensor failure detection subroutine which is operable in accordance with the principles of the invention;

FIG. 67-12A and B shows a flow chart of the ATS vibration scan, reaheat temperature monitoring and heat soak time calculation which are operable in accordance with the principles of the invention;

FIG. 67-13A and B shows a flow chart of the ATS program resetting and clear functions which are operable in accordance with the principles of the invention;

FIG. 67-14A and B shows a flow chart of the ATS generator monitor which is operable in accordance with the principles of the invention;

FIG. 67-15A and B shows a flow chart of the ATS transfer logic front speed to load control which is operable in accordance with the principles of the invention;

FIG. 67-16A and B shows a flow chart of the ATS program turbine latch which is operable in accordance with the principles of the invention;

FIG. 67-17 shows a graph of no load and light load guides which are operable in accordance with the principles of the invention;

FIG. 67-18 shows a schematic representation of turbine generator differential expansion which is operable in accordance with the principles of the invention;

FIG. 67-19 shows a schematic representation of turbine generator differential expansion which is operable in accordance with the principles of the invention;

FIG. 67-20 shows a section with an indication of buildup of rotor stresses in the rotor of the turbine generator which is operable in accordance with the principles of the invention;

FIG. 68 shows a block diagram of the Digital Electro Hydraulic System which is operable in accordance with the principles of the invention.

DESCRIPTION OF THE PREFERRED EMBODIMENT

More specifically, there is shown in FIG. 1 a large single reheat steam turbine constructed in a well known manner and operated and controlled in an electric power plant 12 in accordance with the principles of the invention. As will become more evident through this description, other types of steam turbines can also be controlled in accordance with the principles of the invention particularly in accordance with the broader aspects of the invention. The generalized electric power plant shown in FIG. 1 and the more general aspect of the computer control system to be described in connection with FIG. 2 are like those disclosed in the aformentioned Giras and Birnbaum patent application Ser. No. 319,115. As already indicated, the present application is directed to general improvements in turbine operation and control as well as more specific improvements related to digital computer operation and control of turbines.

The turbine 10 is provided with a single output shaft 14 which drives a conventional large alternating current generator 16 to produce three-phase electric power (or any other phase electric power) as measured by a conventional power detector 18 which measures the rate of flow of electric energy. Typically, the generator 16 is connected through one or more breakers 17 per phase to a large electric power network and when so connected causes the turbo-generator arrangement to operate at synchronous speed under steady state conditions. Under transient electric load change conditions, system frequency may be effected and conforming turbo-generator speed changes would result. At synchronism, power contribution of the generator 16 to the network is normally determined by the turbine steam flow which in this instance is supplied to the turbine 10 at substantially constant throttle pressure.

In this case, the turbine 10 is of the multistage axial flow type and includes a high pressure section 20, an intermediate pressure section 22, and a low pressure section 24. Each of these turbine sections may include a plurality of expansion stages provided by stationary vanes and an interacting bladed rotor connected to the shaft 14. In other applications, turbines operating in accordance with the present invention may have other forms with more or fewer sections tandemly connected to one shaft or compoundly coupled to more than one shaft.

The constant throttle pressure steam for driving the turbine 10 is developed by a steam generating system 26 which is provided in the form of a conventional drum type boiler operated by fossil fuel such as pulverized coal or natural gas. From a generalized standpoint, the present invention can also be applied to steam turbines associated with other types of steam generating systems such as nuclear reactor or once through boiler systems.

The turbine 10 in this instance is of the plural inlet front end type, and steam flow is accordingly directed to the turbine steam chest (not specifically indicated) through four throttle inlet valves TV1–TV4. Generally, the plural inlet type and other front end turbine types such as the single ended type or the end bar lift type may involve different numbers and/or arrangements of valving.

Steam is directed from the admission steam chest to the first high pressure section expansion stage through light governor inlet valves GV1–GV8 which are arranged to supply steam to inlets arcuately spaced about the turbine high pressure casing to constitute a somewhat typical governor valving arrangement for large fossil fuel turbines. Nuclear turbines might on the other hand typically utilize only four governor valves.

During start-up, the governor valves GV1–GV8 are typically all fully opened and steam flow control is provided by a fully arc throttling valve operation. At some point in the start-up process, transfer is made from full arc or throttle valve control to partial arc or governor valve control because of throttling energy losses and/or throttling control capability. Upon transfer the throttle valves TV1–TV4 are fully opened, and the governor valves GV1–GV8 are individually operated in a predetermined sequence usually directed to achieving thermal balance on the rotor and reduced rotor blade stressing while producing the desired turbine speed and/or load operating level. For example, in a typical governor valve control mode, governor valves GV5–GV8 may be initially closed as the governor valves GV1–GV4 are jointly operated from time to time to define positions producing the desired corresponding total steam flows. After the governor valves GV1–GV4 have reached the end of their control region, i.e., upon being fully opened, or at some overlap point prior to reaching their fully opened position, the remaining governor valves GV5–GV8 are sequentially placed in operation in numerical order to produce continued steam flow control at higher steam flow levels. This governor valve sequence of operation is based on the assumption that the governor valve controlled inlets are arcuately spaced about the 360° periphery of the turbine high pressure casing and that they are numbered consecutively around the periphery so that the inlets corresponding to the governor valve GV1 and GV8 are arcuately adjacent to each other.

The preferred turbine start-up method is to raise the turbine speed from the turning gear speed of about 2 rpm to about 80% of the synchronous speed under throttle valve control and then transfer to governor valve control and raise the turbine speed to the synchronous speed, then close the power system breakers and meet the load demand. On shutdown, similar but reverse practices may be employed. Other transfer practice may be employed, but it is unlikely that transfer would be made at a loading point above 40% rated load because of throttling efficiency considerations.

After the steam has crossed past the first stage impulse blading to the first stage reaction blading of the high pressure section, it is directed to a reheater system 28 which is associated with a boiler or steam generating system 26. In practice, the reheater system 28 may typically include a pair of parallel connected reheaters coupled to the boiler 26 in heat transfer relation as indicated by the reference character 29 and associated with opposite sides of the turbine casing.

With a raised enthalpy level, the reheated steam flows from the reheater system 28 through the intermediate pressure turbine section 22 and the low pressure turbine section 24. From the latter, the vitiated steam is exhausted to a condenser 32 from which water flow is directed (not indicated) back to the boiler 26.

To control the flow of reheat steam, a stop valve SV including one or more check valves is normally open and closed only when the turbine is tripped. Interceptor valves IV (only one indicated), are also provided in the reheat steam flow path, and in this instance they are normally open and operate over a range of position control to provide reheat steam flow cutback modulation under turbine overspeed conditions. Further description of overspeed protection is represented in the aforementioned Birnbaum, Braytenbah and Richardson copending application.

In the typical fossil fuel drum type boiler steam generating system, the boiler control system controls boiler operations so that steam throttle pressure is held substantially constant. In the present description, it is therefore assumed as previously indicated that throttle pressure is an externally controlled variable upon which the turbine operation can be based. A throttle pressure detector 38 of suitable conventional design measures the throttle pressure to provide assurance of substantially constant throttle pressure supply, and, if desired as a programmed computer protective system override control function, turbine control action can be directed to throttle pressure control as well as or in place of speed and/or load control if the throttle pressure falls outside predetermined constraining safety and turbine condensation protection limits.

In general, the steady state power or load developed by a steam turbine supplied with substantially constant throttle pressure steam is determined as follows:

$$\text{power or load} = K_P P_i / P_O = K_F S_F \qquad \text{Equation (1)}$$

where $P_i$ = first stage impulse pressure
$P_O$ = throttle pressure
$K_P$ = constant of proportionality
$S_F$ = steam flow
$K_F$ = constant of proportionality Where the throttle pressure is held substantially constant by external control as in the present case, the turbine load is thus proportional to the first stage impulse pressure $P_i$. The ratio $P_i/P_O$ may be used for control purposes, for example to obtain better anticipatory control of $P_i$ (i.e. turbine load) as the boiler control throttle pressure $P_O$ undergoes some variation within protective constraint limit values. However, it is preferred in thy present case that the impulse pressure $P_i$ be used for feedback signalling in load control operation as subsequently more fully described, and a conventional pressure detector 40 is employed to determine the pressure $P_f$ for the assigned control usage.

Within its broad field of applicability, the invention can also be applied in nuclear reactor and other applications involving steam generating steams which produce steam without placement of relatively close steam generator control on the constancy of the turbine throttle pressure. In such cases, throttle control and operating philosophies are embodied in a form preferred for and tailored to the type of plant and turbine involved. In cases of unregulated throttle pressure supply, turbine operation may be directed with top priority to throttle pressure control or constraint and with lower priority to turbine load and/or speed control.

Respective hydraulically operated throttle valve actuators indicated by the reference character 42 are provided for the four throttle valves TV1–TV4. Similarly, respective hydraulically operated governor valve actuators indicated by the reference character 44 are provided for the eight governor valves GV1–GV8. Hydraulically operated actuators indicated by the reference characters 46 and 48 are provided for the reheat stop and interceptor valving SV and IV. A computer monitored high pressure fluid supply 50 provides the controlling fluid for actuator operation of the valves TV1–TV4, GV1–GV8, SV and IV. A computer supervised lubricating oil system (not shown) is separately provided for turbine plant lubricating requirements.

The respective actuators 42, 44, 46 and 48 of conventional construction, and the inlet valve actuators 42 and 44 are operated by respective stabilizing position controls indicated by the reference characters 50 and 52. If desired, the interceptor valve actuators 48 can also be operated by a position control 56 although such control is not employed in the present detailed embodiment of the invention. Each position control includes a conventional analog controller (not shown in FIG. 1) which drives a suitably known actuator servo valve (not indicated) in the well known manner. The reheat stop valve actuators 46 are fully open unless the conventional trip system or other operating means causes them to close and stops the reheat steam flow.

Since the turbine power is proportional to steam flow under the assumed control condition of substantially constant throttle pressure, steam valving position is controlled to produce control over steam flow as an intermediate variable and over turbine speed and/or load as an end control variable or variables. Actuator operation provides the steam valve positioning, and respective valve position detectors PDT1–PDT4, PDG1–PDG8 and PDI are provided to generate respective valve position feedback signals for developing position error signals to be applied to the respective position controls 50, 52 and 56. One or more contact sensors CSS provides status data for the stop valving SV. The position detectors ary provided in suitable conventional form, for example, they may make conventional use of linear variable differential transformer operation in generating negative position feedback signals for algebraic summing with respect to position setpoint signals SP in developing the respective input error signals. Position controlled operation of the interceptor valving IV would typically be provided only under a reheat steam flow cutback requirement.

The combined position control, hydraulic actuator, valve position detector element and other miscellaneous devices (not shown) form a local hydraulic electric analog valve position control for each throttle or governor inlet steam valve. The position setpoints SP are computer determined and supplied to the respective local loops and updated on a periodic basis. Setpoints SP may also be computed for the interceptor valve controls when the latter are employed. A more complete general background description of electrohydraulic steam valve positioning and hydraulic fluid supply systems for valve actuation is presented in the aforementioned Birnbaum and Noyes paper.

In the present case, the described hybrid arrangement including local loop analog electrohydraulic position control is preferred primarily because of the combined effects of control computer operating speed capabilities and computer hardware economics, i.e., the cost of manual backup analog controls is less than that for backup computer capacity at present control computer operating speeds for particular applications so for developed. Further consideration of the hybrid aspects of the turbine control system is presented subsequently herein. However, economic and fast operating backup control computer capability is expected and direct digital computer control of the hydraulic valve actuators will then likely be preferred over the digital control of local analog controls described herein.

A speed detector 58 is provided for determining the turbine shaft speed for speed control and for frequency participation control purposes. The speed detector 58 can for example be in the form of a reluctance pickup (not shown) magnetically coupled to a notched wheel (not shown) on the turbo-generator shaft 14. In the detailed embodiment subsequently described herein, a plurality of sensors are employed for speed detection. Analog and/or pulse signals produced by the speed detector 58, the electric power detector 18, the pressure detectors 38 and 40, the valve position detectors PDT1–PDT4, PDG1–PDG8 and PDI, the status contact or contacts CSS, and other sensors (not shown) and status contacts (not shown) are employed in programmed computer operation of the turbine 10 for various purposes including controlling turbine performance on an on-line real time basis and further including monitoring, sequencing, supervising, alarming, displaying and logging.

DEH—COMPUTER CONTROL SYSTEM

As generally illustrated in FIG. 2, a Digital Electro-Hydraulic control system (DEH) 1100 includes a programmed digital computer 210 to operate the turbine 10 and the plant 12 with improved performance and operating characteristics. The computer 210 can include conventional hardware including a central processor 212 and a memory 214. The digital computer 210 and its associated input/output interfacing equipment is a suitable digital computer system such as that sold by Westinghouse Electric Corporation under the trade name of P2000. In cases when the steam generating system 26 as well as the turbine 10 are placed under computer control, use can be made of a larger computer system such as that sold by Xerox Data Systems and known as the Sigma 5. Separate computers, such as P2000 computers, can be employed for the respective control functions in the controlled plant unit and interaction is achieved by interconnecting the separate computers together through data links or other means.

The digital computer used in the DEH control system 1100 is a P2000 computer which is designed for real time process control applications. The P2000 typically uses a 16 bit word length with 2's complement, a single address and fixed word length operated in a parallel mode. All the basic DEH system functions are performed with a 16,000 word (16K), 3 microsecond magnetic core memory. The integral magnetic core memory can be expanded to 65,000 words (65K). A repertoire of 32 instructions include multiply and loading and unloading of program registers.

The equipment interfacing with the computer 210 includes a contact interrupt system 124 which scans contact and other state variables representing the status of various plant and equipment conditions in plant wiring 1126. The status contacts might typically be contacts of mercury wetted relays (not shown) which operate by energization circuits (not shown) capable of sensing the predetermined condition associated with the various system devices. Data from status contacts is used in interlock logic functioning and control for other programs, protection analog system functioning, programmed monitoring and logging and demand logging, etc.

Operator's panel buttons 1130 transmit digital information to the computer 2010. The operator's panel buttons 1130 can set a load reference, a pulse pressure, megawatt output, speed, etc.

In addition, interfacing with plant instrumentation 1118 is provided by an analog input system 1116. The analog input system 1116 samples analog signals at a predetermined rate from predetermined input channels and converts the signals sampled to digital values for entry into the computer 210. The analog signals sensed in the plant instrumentation 1118 represent the impulse chamber pressure, the megawatt power or the valve positions of the throttle valves TV1 through TV4 and the governor valves GV1 through GV8 and the interceptor valve IV, throttle pressure, steam flow, various steam temperatures, miscellaneous equipment operating temperature, generator hydrogen cooling pressure and temperature, etc. A detailed list of all parameters is provided in the Appendix, infra. Such parameters include process parameters which are sensed or controlled in the process (turbine or plant) and other variables which are defined for use in the programmed computer operation. Interfacing from the external systems such as an automatic dispatch system is controlled through the operator's panel buttons 1130.

A conventional programmer's console and tape reader 218 is provided for various purposes including program entry into the central processor 212 and the memory 214 thereof. A logging typewriter 1146 is provided for logging printouts of various monitored parameters and signals and warnings, provided by an automatic turbine startup system (ATS) comprising programmed system blocks 1140, 1142, 1144 and the DEH control system 1100. A trend recorder 1147 continuously records predetermined parameters of the system. An interrupt system 124 is provided for controlling the input and output transfer of information between the digital computer 210 and the input/output equipment. The digital computer 210 acts on interrupts from the interrupt system 124 in accordance with an executive program. Interrupt messages from the interrupt system 124 stop the digital computer 210 by interrupting a program in operation. The interrupt signals are serviced immediately.

Figure 8:
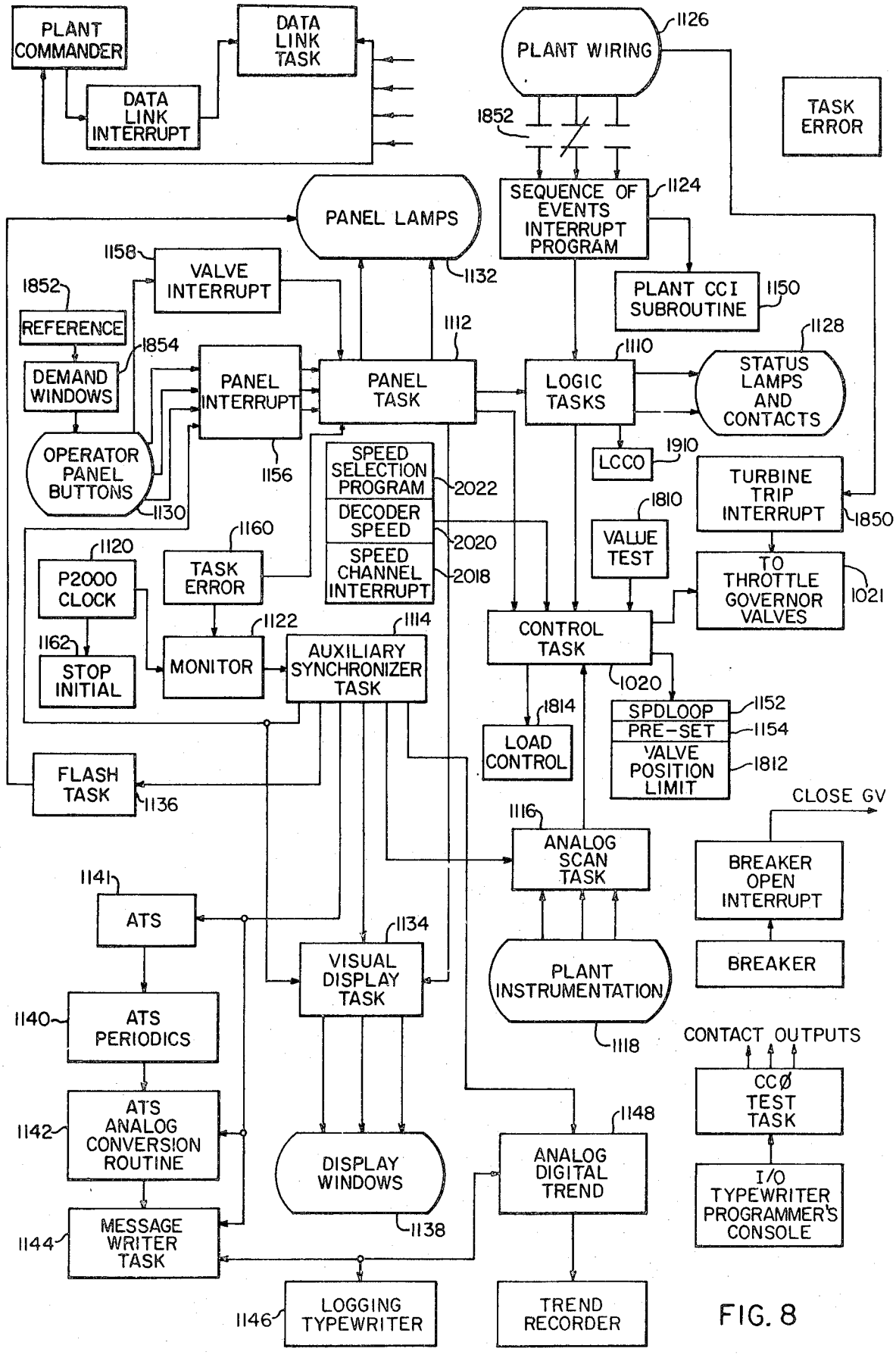
FIG. 8 shows a block diagram of the programs and subroutines of the digital Electro Hydraulic and the automatic turbine startup and monitoring program in accordance with the principles of the invention.

Output interfacing is provided by contacts 1128 for the computer 210. The contacts 1128 operate status display lamps, and they operate in conjunction with a conventional analog/output system and a valve position control output system comprising a throttle valve control system 220 and a governor valve control system 222. A manual control system, considered further in connection with FIG. 8 is coupled to the valve position control output system 220 and is operable therewith to provide manual turbine control during computer shutdown. The throttle and governor valve control systems 220 and 222 correspond to the valve position controls 50 and 52 and the actuators 42 and 44 in FIG. 1.

Digital output data from the computer 210 is first converted to analog signals in an analog output system 224 and then transmitted to a valve control system 220 and 222. Analog signals are also applied to auxiliary devices and systems, not shown, and interceptor valve systems, not shown.

SUBSYSTEMS EXTERNAL TO THE DEH COMPUTER

At this point in the description, further consideration of certain subsystems external to the DEH computer will aid in reaching an understanding of the invention. Making reference now to FIG. 3, a high pressure HP fluid supply system 310 for use in controlled actuation of the governor valves GV1 through GV8, the throttle valves TV1 through TV4 and associated valves is shown. The high pressure fluid supply system 310 corresponds to the supply system 49 in FIG. 1 and it uses a synthetic, fire retardant phosphate ester-based fluid and operates in the range of 1500 and 1800 psi. Nitrogen charged piston type accumulators 312 maintain a flow of fluid to the actuators for the governor valves GV1–GV8, the throttle valves TV1–TV4, etc. when pumps 314 and 316 are discharging to a reservoir 318 through unloader valves 320 and 321. In addition, the accumulators 312 provide additional transient flow capacity for rapid valve movements.

Referring now to FIG. 4, a typical electrohydraulic valve actuation system 322 is shown in greater detail for positioning a modulating type valve actuator 410 against the closing force of a large coil spring. A servo-valve 412 which is driven by a servo-amplifier 414 controls the flow of fluid therethrough. The servo-valve 412 controls the flow of fluid entering or leaving the valve actuator cylinder 416 relative to the HP fluid supply system 310. A linear voltage differential transformer LVTD generates a valve position indicating transducer voltage which is summed with a valve position demand voltage at connection 418. The summation of the two previously mentioned voltages produces a valve position error input signal to the servo-amplifier 414. The linear voltage differential transformer LVTD has a linear voltage characteristic with respect to displacement thereof in the preferred embodiment. Therefore, the position of the valve actuator 410 is made proportional to the valve position demand voltage at connection 418.

Making reference now to FIG. 5, a hardwired digital-/analog system 511 forms a part of the DEH control system 1100 (FIG. 2). Structurally, it embraces elements which are included in the blocks 50, 52, 42 and 44 of FIG. 1 as well as additional elements. A hybrid interface 510 is included as a part of the hardwired system 511. The hybrid interface 512 is connected to actuator system servo-amplifiers 414 for the various steam valves which in turn are connected to a manual controller 516, an overspeed protection controller, not shown, and redundant DC power supplies, not shown.

A controller shown in FIG. 5 is employed for throttle valve TV1–TV4 control in the TV control system 50 of FIG. 1. The governor valves GV1–GV8 are controlled in an analogous fashion by the GV control system 52.

While the steam turbine is controlled by the digital computer 210, the hardwired system 511 tracks an analog output 520 from the digital computer 210 in a manner similar to the operation of the arrangement described in the aforementioned Barnes and Giras patent and the aforementioned copending application. A comparator 518 compares a signal from a digital-to-analog converter 522 with the signal 520 from the digital computer 210. A signal from the comparator 518 controls a logic system 524, such that, the logic system 524 runs an up-down counter 526 to the point where the output of the up-down counter 526 is equal to the output signal 520 from the digital computer 210. Should the hardwired system 511 fail to track the signal 520 from the digital computer 210 a monitor light will flash on the operator's panel as shown in FIGS. 130A and 130B.

When the DEH control system reverts to the control of the backup manual controller 516 as a result of an operator selection or due to a contingency condition, such as loss of power on the automatic digital computer 210, or a stoppage of a function in the digital computer 210, or a loss of a speed channel in the wide range speed control all as described in greater detail infra, the input of the valve actuation system 322 (FIG. 4) is switched by switches 528 from the automatic controllers in the blocks 50, 52 (FIG. 1) or 220, 222 (FIG. 2) to the control of the manual controller 516. Bumpless transfer is thereby accomplished between the digital computer 210 and the manual controller 516.

Similarly, tracking is provided in the computer 210 for switching bumplessly from manual to automatic turbine control. As previously indicated, the presently disclosed hybrid structural arrangement of software and hardware elements is the preferred arrangement for the provision of improved turbine and plant operation and control with backup capability. However, other hybrid arrangements can be implemented within the field of application of the invention.

DEH PROGRAM SYSTEM

DEH Program System Organization, DEH Control Loops And Control Task Program

With reference now to FIG. 6, an overall generalized control system of this invention is shown in block diagram form. The digital electrohydraulic (DEH) control system 1100 (FIG. 2) is identified by the reference character 1100 and it controls a steam turbine 1012 (corresponding to the turbine 10 in FIG. 1). The digital electrohydraulic control system 1100 comprises a digital computer 1014, corresponding to the digital computer 210 in FIG. 2 interconnected with a hardwired backup system 1016. The digital computer 1014 and the backup system 1016 are connected to electronic servo system 1018 corresponding to blocks 220 and 222, in FIG 2. The digital computer control system 1014 and the analog backup system 1016 track each other during turbine operations in the event it becomes necessary or desirable to make a bumpless transfer of control from a digital computer controlled automatic mode of operation of a manual analog backup mode or from the manual mode to the digital automatic mode.

In order to provide plant and turbine monitor and control functions and to provide operator interface functions, the DEH computer 1014 is programmed with a system of task and task support programs. The program system is organized efficiently and economically to achieve the end operating functions. Control functions are achieved by control loops which structurally include both hardware and software elements, with the software elements being included in the computer program system. Elements of the program system are considered herein to a level of detail sufficient to reach an understanding of the invention. More functional detail on various programs is presented in Appendix 2. Further, a detailed listing of a DEH system program substantially conforming to the description presented herein is presented in Appendix 3 in symbolic and machine language. Most of the listing is compiled by a P2000 compiler from instructions written in Fortran IV. A detailed dictionary of system parameters is presented in Appendix 1, and a detailed computer input/output signal list is presented in Appendix 4. Appendix 5 mainly provides additional hardware information related to the hardwired system previously considered as part of the DEH control system.

As previously discussed, a primary function of the digital electrohydraulic (DEH) system 1100 is to automatically position the turbine throttle valves TV1 through TV4 and the governor valves GV1 through GV8 at all times to maintain turbine speed and/or load. A special periodically executed program designated the CONTROL task is utilized by the P2000 computer along with other programs to be described in greater detail subsequently herein.

With reference now to FIG. 7, a functional control loop diagram in its preferred form includes the CONTROL task or program 1020 which is executed in the computer 1010. Inputs representing demand and rate are two of the input parameters applied to the control task 1020 to determine the turbine operating setpoint. The demand is typically either in specified revolutions per minute of the turbine systems during startup or shutdown operations or in megawatts of electrical output to be produced by the generating system 16 during load operations. The demand enters the block diagram configuration of FIG. 7 at the input 1050 of a compare block 1052.

The rate input either in specified RPM per minute or specified megawatts per minute, depending upon which input is to be used in the demand function, is applied to an integrator block 1054 where an integration algorithm is executed. In order to limit the buildup of stresses in the rotor of the turbine-generator 10 the rate inputs in RPM and megawatts of loading per minute must be determined in order to keep the stress within safe values. An output of the compare block 1052 is also applied to the integrator block 1054. The demand value is compared with a reference corresponding to the present turbine operating setpoint in the compare block 1052. The reference value is representative of the setpoint RPM applied to the turbine system or the setpoint generator megawatts output, depending upon whether the turbine generating system is in the speed mode of operation or the load mode of operation. In the prior art an analog integrator with a limited number of fixed feedback capacitors which are selected by an operator is replaced in the present invention by the integrator block 1054 which integrates at a virtually infinite number of different rates limited only by the resolution of the digital computer 210. The demand and the reference are compared in the compare block 1052 and an output from the compare block 1052 is generated which represents the difference between the demand and the reference. A polarity error is applied to the integrator 1054 whereby a negative error drives the integrator 1054 in one sense and a positive error drives it in the opposite sense. The polarity error normally drives the integrator 1054 until the reference and the demand are equal or if desired until they bear some other predetermined relationship with each other. The rate input to the integrator 1054 varies the rate of integration, i.e. the rate at which the reference or the turbine operating setpoint moves toward the entered demand.

Demand and rate input signals can be entered by a human operator from a keyboard. Inputs for rate and demand can also be generated or selected by automatic synchronizing equipment, by automatic dispatching system equipment external to the computer, by another computer automatic turbine startup program or by a boiler control system. The inputs for demand and rate in automatic synchronizing and boiler control means are preferably discrete pulses. However, time control pulse widths or continuous analog input signals may also be utilized. In the automatic startup mode, the turbine acceleration is controlled as a function of detected turbine operating conditions including rotor thermal stress. Similarly, loading rate can be controlled as a function of detected turbine operating conditions.

The output from the integrator 1054 is directed by a breaker decision block 1060. The breaker decision block 1060 checks the state of the main generator circuit breaker 17 and whether speed control or load control is to be used. The breaker block 1060 them makes a decision as to the use of the reference value. The decision made by the breaker block 1060 is placed at the earliest possible point in the control task 1020 thereby reducing computational time and subsequently the duty cycle required by the control task 1020. If the main generator circuit breaker 17 is open whereby the turbine system is in wide range speed control the reference is applied to the compare block 1062 and compared with the actual turbine generator speed in a feedback type control loop. A speed error value from the compare block 1062 is fed to a proportional plus reset controller block 1068, to be described in greater detail later herein. The proportional plus reset controller 1068 provides an integrating function in the control task 1060 which reduces the speed error signal to zero. In the prior art, control systems limited to proportional controllers are unable to reduce an error signal to zero. During manual operation an offset in the required setpoint is no longer required in order to maintain the turbine speed at a predetermined value. Great accuracy and precision of turbine speed whereby the turbine speed is held within one RPM over tens of minutes is also accomplished. The accuracy of speed is so high that the turbine 10 can be manually synchronized to the power line without an external synchronizer typically required. An output from the proportional plus reset controller block 1068 is then processed for external actuation and positioning of the appropriate throttle and/or governor valves in a manner described in greater detail later herein.

If the main generator circuit breaker 17 is closed, the CONTROL task 1020 advances from the breaker block 1060 to a summer 1072 where the REFERENCE acts as a feedforward variable in a combined feedforward-feedback control system. If the main generator circuit breaker 17 is closed, the turbine generator system 10 is being loaded by the electrical network connected thereto. The mode of operation when the generator 16 is connected to a load 19 by the breaker 161 is called load control.

In the control task 1020 of the DEH system 1100 utilizes the summer 1072 to compare the reference value with the output of speed loop 1310 in order to keep the speed correction independent of load. A multiplier function has a sensitivity to varying load which is objectionable in the speed loop 1310.

During the load mode of operation the DEMAND represents the specified loading of the generator 16. During the load mode the power load in MW is to be held at a predetermined value of the DEH system 1100. However, the actual load will be modified by deviations in system frequency in accordance with a predetermined regulator value. In box 1078, a rated speed value in box 1074 is compared with a "two signal" speed value represented by box 1076. The two signal speed system has high reliability to be described infra herein. An output from the compare function 1078 is fed through a function which is similar to a proportional controller which converts the speed value to reference units and is represented by a proportional controller program box 1080. The speed error from the proportional controller 1080 is proportionalized to megawatts operates as a feedback trim on the feedforward megawatt reference, i.e., the speed error and the megawatt reference are summed in summation function or box 1072 to generate a combined speed compensated reference signal.

The speed compensated load reference is compared with actual megawatts in a compare box or function 1082. The resultant error is then run through a proportional plus reset controller represented by program box 1084 to generate a feedback megawatt trim. The proportional plus reset controller 1084 performs analogous functions to the controller 1068 during speed control. The proportional and proportional plus reset controller programs 1080 and 1084 will be discussed in fuller detail later herein.

The speed compensated reference is trimmed by the megawatt feedback variable multiplicatively, i.e. they are multiplied together in the feedforward turbine reference path by multiplication function 1086. Multiplication is utilized as a safety feature such that if one signal e.g. MW should fail a large value would not result which could cause an overspeed condition but instead the DEH system 1100 would switch to a manual mode.

The megawatt loop comprising in part 1082 and 1084 may be switched out of service leaving the speed loop 1310 and the impulse pressure input 1088 controlling the DEH system 1100. The resulting speed compensated and megawatt trimmed reference is then compared with a feedback impulse chamber pressure representation obtained from an impulse pressure input 1088.

Impulse pressure responds very quickly to changes of load and steam flow and therefore provides a signal with minimum lag which smooths the output response of the turbine generator 10 because the lag dynamics and subsequent transient response is minimized. The impulse pressure input may be switched in and out from compare function 1090.

As an alternative embodiment feedforward control with feedback trim is applicable. The difference between the feedforward reference and the impulse pressure is developed by a comparator function 1090, and the error output therefrom functions in a feedback impulse pressure control loop. Thus, the impulse pressure error is applied to a proportional plus reset controller function 1092 which is similar in operation to the proportional plus reset controller function 1084.

Between block 1092 and the governor valves GV1–GV8 a value characterization function for the purpose of linearizing the response of the values is interposed. The value characterization function described in detail in Appendix III infra herein is utilized in both automatic modes and manual modes of operation of the DEH system 1100. The output of the proportional plus reset controller function 1092 is then ultimately coupled to the governor valves GV1–GV8 through electrohydraulic position control loops implemented by equipment considered elsewhere herein. The proportional plus reset controller output 1092 causes positioning of the governor valves GV1–GV8 in load control to achieve the desired megawatt demand while compensation is made for speed, megawatt and impulse pressure deviations from desired setpoints.

Since the impulse pressure especially and other parameters may vary rapidly in order to prevent sudden changes of position of the governor valves GV1–GV8 the proportional plus reset controller 1092 is included after the compare function 1090.

Making reference to FIG. 8, the control program 1020 is shown with interconnections to other programs in the program system employed in the Digital Electro Hydraulic (DEH) system 1100. The periodically executive program 1020 receives data from a logic task 1110 where mode and other decisions which affect the control program are made, a panel task 1112 where operator inputs may be determined to affect the control program, an auxiliary synchronizer program 1114 and an analog scan program 1116 which processes input process data. The analog scan task 1116 receives data from plant instrumentation 1118 external to the computer as considered elsewhere herein, in the form of pressures, temperatures, speeds, etc. Generally, the auxiliary synchronizer program 1114 measures time for certain important events and it controls the sequencing of bids for execution of the control program 1020. A clock function 1120 and a monitor program 1122 control the sync rate of the auxiliary synchronizer program 1114.

The monitor program or executive package 1122 also provides for controlling certain input/output operations of the computer and, more generally, it schedules the use of the computer to the various programs in accordance with assigned priorities. For more detail on the P2000 computer system and its executive package, reference is made to Appendix 4. In the appendix description, the executive package is described as including analog scan and contact closure input routines, whereas these routines are considered as programs external to the executive package in this part of the disclosure.

The logic task 1110 is fed from outputs of a contact interrupt or sequence of events program 1124 which monitors contact variables in the power plant 1126. The contact parameters include those which represent breaker state, turbine auto stop, tripped/latched state interrogation data states, etc. to be described in greater detail infra. Within the executive program 1111 bids from the interrupt program 1124 are requested with and queued for execution by the executive program 1111. The control program 1110 also receives data from the panel task 1112 and transmits data to status lamps and output contacts 1128. The panel task 1112 receives data instruction based on supervision signals from the operator panel buttons 1130 and transmits data to panel lamps 1132 and to the control program 1020. The auxiliary synchronizer program 1114 synchronizes through the executive program 1111 the bidding of the control program 1020, the analog scan program 1116, a visual display task 1134 and a flash task 1136. The visual display task transmits data to display windows 1138. The details of the various programs will be presented in more explicit form infra, as varying parts of the entire DEH control system 1100 for controlling the turbine system 10.

The control program 1020 receives numerical quantities representing process variables from the analog scan task program 1116. As already generally considered, the control program 1020 utilizes the values of the various feedback variables including turbine speed, impulse pressure and megawatt output in order to calculate the position of the throttle valves TV1–TV4 and governor valves GV1–GV8 in the turbine system 10, thereby controlling the megawatt load and the speed of the turbine 10.

To interface the control and logic programs efficiently, a special interrupt program 1124 is used in conjunction with the logic task 1110. The logic task 1110 computes all logical states, to be discussed in more detail infra, according to predetermined conditions and transmits this data to the control program 1020 where this information is utilized in determining the positioning control action for valves TV1–TV4, the throttle and the governor valves GV1–GV8. The logic task 1110 also controls the state of various lamps and relay type contact outputs in a predetermined manner.

An operator supervises the DEH system 1100 and the turbine 10 by pressing various pushbutton switches on an operator's panel 1130 thereby entering various control or monitoring actions or various values for system parameters into the computer for processing by the panel task 1112. The flash task 1136 monitors various conditions within the DEH system 1100 and the turbine 10 thereby alerting the operator by flashing appropriate lamps to be described infra.

TASK PRIORITY ASSIGNMENTS

With reference now to FIG. 9, a table of program priority assignments is shown as employed in the executive monitor. A program with the highest priority is run first under executive control if two or more programs are ready to run. The stop-initializer program function has top priority and is run on startup for the computer or after the computer has been shut down momentarily and is being restarted. The control program 1020 is next in order of priority. The operator's panel program 1130, which generates control data, follows the control task 1020 in priority. The analog scan program 1116 also provides information to the control task 1020 and operates at a level of priority below that of the operator's panel 1130. The automatic turbine starting (ATS) periodic program 1140 is next in the priority list. ATS stands for automatic turbine startup and monitoring program, and is shown as a major task program 1140 of FIG. 8 for the operation of the DEH system 1100. The ATS-periodic program 1140 monitors the various temperatures, pressures, breaker states, rotational velocity, etc. during start-up and during load operation of the turbine system.

The logic task 1110, which generates control and operating mode data, follows in order of operating priority. The visual display task program 1134 follows the logic task program 1110 and makes use of outputs from the latter. A data link program for transmitting data from the DEH system to an external computer follows. An ATS-analog conversion task program 1142 for converting the parameters provided by the ATS-periodic program 1142 to usable computer data follows in order of priority. The flash task program 1136 is next, and it is followed by a programmer's console program which is used for maintenance testing and initial loading of data tapes. The next program is an ATS-message writer 1144 which provides for printout of information from the ATS analog conversion program 1142 on a suitable typewriter 1146. The next program in the priority list is an analog/digital trend which monitors parameters in the turbine system 10 and prints or plots them out for operator perusal. The remaining two programs are for debugging and special applications.

In the preferred embodiment, the stop/initialize program is given the highest priority in the table of FIG. 9 because certain initializing functions must be completed before the DEH system 1100 can run. The auxiliary synchronizer program 1114 provides timing for all programs other than the stop/initialize program while the DEH system 1100 is running. Therefore, the auxiliary synchronizer task program 1400 has the second order of priority of the programs listed. The control program 1020 follows at the third descending order of priority since the governor valves GV1 through GV8 and the throttle valves TV1 through TV4 must be controlled at all times while the DEH system 1100 is in operation.

The operator's panel program 130 is given the next order of priority in order to enable an operator to exercise direct and instantaneous control of the DEH system 1100. The analog scan program 1116 provides input data for the control program 1020 and, therefore, is subordinate only to the initialize function, synchronizer function, control and operator function.

In the preferred embodiment the ATS-periodic program 1140 is next in order of priority. During automatic turbine startup, the scanning of inputs by the ATS-periodic program 1140 is almost on the same order of priority as the inputs to the DEH system 1100. However, the ATS program 1140 in alternative embodiments, could be reduced in its priority, without any considerable adverse effect, because of the relatively limited duty cycle problems in the ATS system.

The logic task 1110 which control the operations of some of the functions of the control task program 1020 is next in order of priority. The visual display task 1134 follows in order of priority in order to provide an operator with a visual indication of the operation of the DEH program 1100. The visual display program 1134 is placed in the relatively low eighth descending order of priority since the physical response of an operator is limited in speed to 0.2 to 0.5 sec. as to a visual signal. The rest of the programs are in essentially descending order of importance in the preferred embodiment. In alternative embodiments of the inventions, alternate priority assignments can be employed for the described or similar programs, but the general priority listing described is preferred for the various reasons presented.

Figure 13:
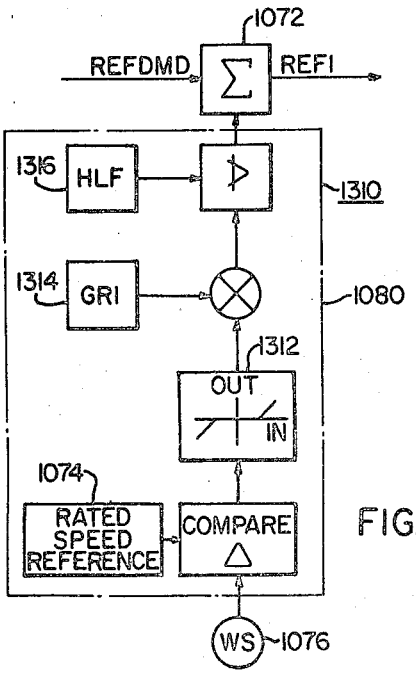
FIG. 13 shows a block diagram of a proportional controller function with dead band which is operable in accordance with the principles of the invention.

A series of interrupt programs which interrupt the action of the computer and function outside the task priority assignments to process interrupts is shown in FIG. 13. One such program in FIG. 8 is the sequence events or contact interrupt program 1124 which suspends the operation of the computer for a very short period of time to process an interrupt. Between the operator panel buttons 1130 and the panel task program 1112 a panel interrupt program 1156 is utilized for signalling any changes in the operator's panel buttons 1130. A value interrupt program 1158 is connected directly between the operator's panel buttons 1130 and the panel task program 1112 for operation during a valve test or in case of valve contingency situations to be discussed infra. The various interrupt programs will be discussed in greater detail infra.

Proportional plus reset controller subroutine 1068 is called by the control task program 1020 of FIG. 7 as previously described when the turbine control system is in the speed mode of control and also, for computer use efficiency, when the turbine 10 is in the load mode of control with the megawatt and impulse pressure feedback loops in service. Utilizing the proportional plus reset function 1068 during speed control provides very accurate control of the angular velocity of the turbine system.

In addition to previously described functions, the auxiliary synchronizer program 1114 is connected to and triggers the ATS periodic program 1140, the ATS analog conversion routine 1142 and the message writer 1144. The ATS program 1140 monitors a series of temperature, vibration, pressures, speed, etc. in the turbine system and also contains a routine for automatically starting the turbine system 10. The ATS analog conversion routine 1142 converts the digital computer signals from the ATS periodic program 1140 to analog or digital or hybrid form which can be typed out through the message writer task 1144 to the logging typewriter 1146 or a similar recorder.

The auxiliary synchronizer program 1114 also controls an analog/digital trend program 1148. The analog digital trend program 1148 records a set of variables in addition to the variables of the ATS periodic program 1140.

Ancillary to a series of other programs is a plant CCI subroutine 1150 where CCI stands for contact closure inputs. The plant CCI subroutine 1150 responds to changes in the state of the plant contacts as transmitted over the plant wiring 1126. Generally, the plant contacts are monitored by the CCI subroutine 1150 only when a change in contact state is detected. This scheme conserves computer duty cycle as compared to periodic CCI monitoring. However, as subsequently described herein, other triggers including operator demand can be employed for a CCI scan.

The control task 1020 calls ancillary thereto a speed loop task 1152 and a preset or proportional plus reset controller program 1154. Ancillary to the executive monitoring program 1122 is a task error program 1160. In conjunction with the clock program 1120 a stop/initialize program 1162 is used. There are various other functions in FIG. 8 which will be described in greater detail infra.

PRESET SUBROUTINE PROGRAM

Figure 11:
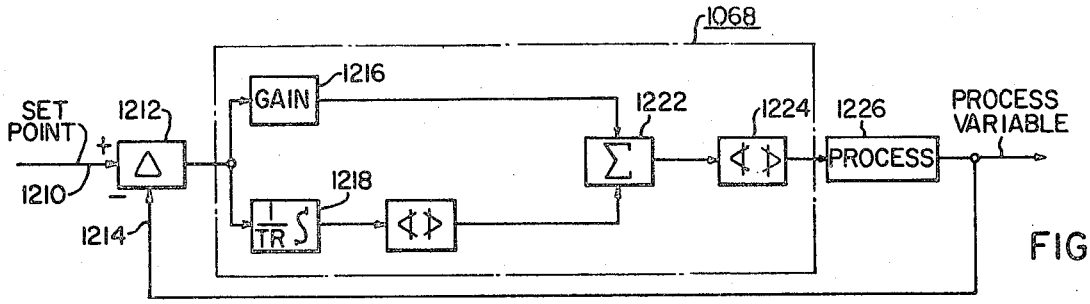
FIG. 11 shows a block diagram of a proportional-plus-reset controller program which is operable in accordance with the principles of the invention.

Making reference now to FIG. 11, a functional diagram of the proportional plus reset controller task program 1068 of FIG. 7 is shown in greater detail. The proportional plus reset controller subroutine 1068 is called by the control program 1020 of FIG. 7 when the DEH turbine control system 1100 is in the speed mode of control and also when the DEH turbine control system 1100 is in the load mode of control with the megawatt and impulse pressure feedback loops in service. As already indicated utilizing a proportional plus reset function during speed control provides very accurate control of the angular velocity of the turbine system.

The proportional plus reset controller 1068 provides an output which is composed of the sum of two parts. One part of the output is proportional to an input and the other part is an integral of the input. Therefore, instantaneous response is available as well as the capability of zero input error. A setpoint or dynamic reference from a demand source is applied to an input 1210 of a difference function 1212. The difference function 1212 compares the input and the actual controlled process value. An output from the difference function 1212 is fed to a gain function 1216 and to an input of an integrator or integrating function 1218. An output from the integrator 1218 is limited by the program as represented by the reset windup prevention function 1220. In an analog system, reset windup is the saturation of the integrating amplifier and therefore the locking out of that amplifier until the integrating capacitor connected thereto is discharged. In a software system, reset windup is prevented more easily because of the inherent digital nature of the computer which allows for a limitation of any digital number at a predetermined value.

Outputs from the gain function 1216 and the integrator 1218 and the reset windup prevention function 1220 are summed in a summing function 1222. An output from the summing function 1222 is limited by another function 1224 thereby limiting an output therefrom to a useful output range which is fed to a process function 1226.

Figure 12:
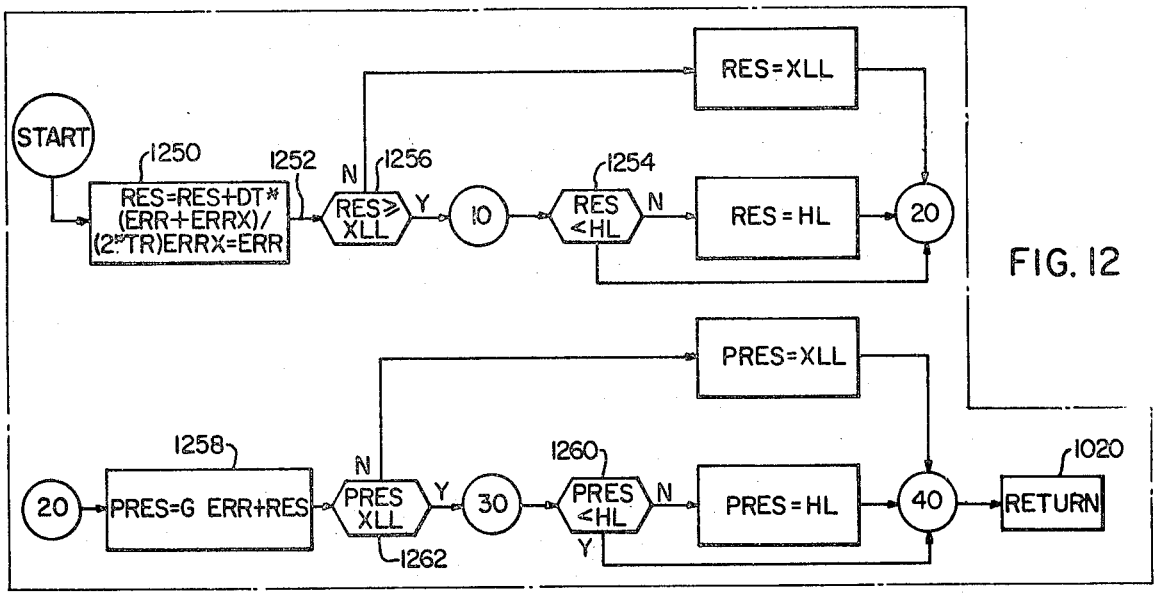
FIG. 12 shows a flow chart of the proportional-plus-reset subroutine (PRESET) which is operable in accordance with the principles of the invention.

Making reference now to FIG. 12, a pictorial representation of a flow chart for the proportional plus reset controller program is shown. In the preferred embodiment the Preset program is designed such that a call from the control program 1030 provides a list of variables necessary to evaluate the controller 1068 output. The structure of the subroutine is indicated by the Fortran statement given below.

SUBROUTINE PRESET (ERR, ERRX, G, TR, HL, XLL, RES, PRES)

The variables in the above equation are defined as follows:

| FORTRAN Variables | English Language Equivalents |
|---|---|
| ERR | The current input |
| ERRX | The last input |
| G | The controller proportional gain |
| TR | The controller reset time |
| HL | The controller high limit |
| XLL | The controller low limit |
| RES | The controller integral output |
| PRES | The controller total output. |

Again making reference to FIG. 12, where a flow chart diagram of the operation of the Preset subroutine 1068 is shown and standard FORTRAN notation is used. The Preset subroutine 1068 first evaluates the integral part of the controller output according to equation:

$$Y(N) = Y(N-1) + \frac{DT}{2*TR} *[X(N) + X(N-1)].$$

The subroutine 1068 next saves the current input ERR in storage location ERRX 1250 for the following call to the subroutine 1068. The controller integral output RES 1252 is then checked against the high limit 1254 and the low limit 1256 to prevent reset/windup. The proportional part of the output is computed and added to the integral part of the output integrator 1218 to form the total output PRES 1258. PRES 1258 is checked against high limit 1260 and low limit 1262 after which the proportional plus reset controller subroutine 1068 returns to the control task 1020.

As previously considered, the proportional plus reset controller subroutine 1068 is used by the control task program 1020 during three different phases of operation of the turbine system. During startup of the turbine system 10, the proportional plus reset controller subroutine program 1068 is used as a speed controller in order to regulate and hold the speed of the turbine 10 at a predetermined value or at a predetermined acceleration rate. Because of the integral function of the proportional plus reset controller subroutine program 1068 the speed of the turbine system 10 can be held to within 1 rpm. Also, in order for an operator to keep the speed of the turbine system 10 at a predetermined value, an error offset input signal typical of a purely proportional system is not required. Therefore, the reference and the controlled variable, both turbine speed in this case, will be equal. The proportional plus reset controller subroutine program 1068 is also used in the megawatt controller feedback loop and the impulse chamber pressure controller feedback loop.

Reset Integrator Algorithm

To perform the mathematical function of integration in a digital computer it is desirable to use numerical techniques to approximate the exact value of the integral. In the preferred embodiment, the algorithm uses the trapezoidal rule for integration and it is simple in format, requires little computer storage and is executed very rapidly. The algorithm uses one value of input past history to achieve a high degree of accuracy.

The following algorithm is used in the computer:

$$Y(N) = Y(N-1) + \frac{DT}{2*TR} [X(N) + X(N-1)].$$

Definition of the terms in Equation (2) follows:

(N)—The current instant of real time (N−1)—The last instant of real time.

DT—The sampling interval, or the time duration between evaluations of the integration algorithm. In the DEH Control System this is normally 1 sec.

TR—The controller reset time in sec.

X(N)—The current value of the input.

X(N−1)—The last value of the input. Y(N)—The current value of the output.

Y(N−1)—The last value of the output.

SPEED LOOP SUBROUTINE

Making reference now to FIG. 13, a speed loop program 1310 which functionally is part of the arrangement shown in FIG. 7 is shown in greater detail. The speed loop (SPDLOOP) program 1310 computes data required in the functioning of the speed feedback loop comprising as shown in FIG. 7 the rated speed reference 1074, the actual turbine speed 1076, the compare function 1078, the proportional controller 1080 and the summing function 1072. The speed loop subroutine 1310 is called upon to perform speed control loop functions by the control program 1020. In FIG. 13, the functioning of the proportional controller 1080 is shown in detail. The error output from the compare function 1078 is fed through a deadband function 1312. A proportionality constant (GR1) 1314 and a high limit function(HLF) 1316 are included in the computation.

The speed loop (SPDLOOP) subroutine is called during operation of the speed control mode and the load control mode. Subroutine form reduces the requirement for memory 214 storage space thereby reducing the expense of the digital computer 210 required for operation of the DEH system 1100.

The deadband function 1312 provides for stopping any small noise variations in the speed error generated by the compare function 1078 from changing the speed of the turbine system 10. Systems without a deadband continuously respond to small variations which are random in nature resulting in undue stress in the turbine 10 and unnecessary, time and duty cycle consuming operation of the control system. A continuous hunting about the rated speed due to the gain of the system would occur without the deadband 1312. GR1, the speed regulation gain 1314, is set to yield rated megawatt output power speed correction for a predetermined turbine speed error. The high limit function 1316, HLS, provides for a maximum speed correction factor.

The turbine speed 1076 is derived from three transducers. The turbine digital speed transducer arrangement is that disclosed in greater element and system implementation detail in the aforementioned Reuther Westinghouse Case No. 41,775. Briefly, in the preferred embodiment for determining the speed of the turbine, the system comprises three independent speed signals. These speed signals consist of a very accurate digital signal generated by special electronic circuitry from a magnetic pickup, an accurate analog signal generated by a second independent magnetic pickup, and a supervisory analog instrument signal from a third independent pickup. The DEH system compares these signals and through logical decisions selects the proper signal to use for speed control or speed compensated load control. This selection process switches the signal used by the DEH control system 1100 from the digital channel signal to the accurate analog channel signal or vice versa under predetermined dynamic conditions. The speed sensing system is described in greater detail infra. In order to hold the governor valves at a fixed position during this speed signal switching the control program 1020 uses the speed loop subroutine 1310 and performs a computation to maintain a bumpless speed signal transfer, to be discussed in greater detail infra.

Figure 14:
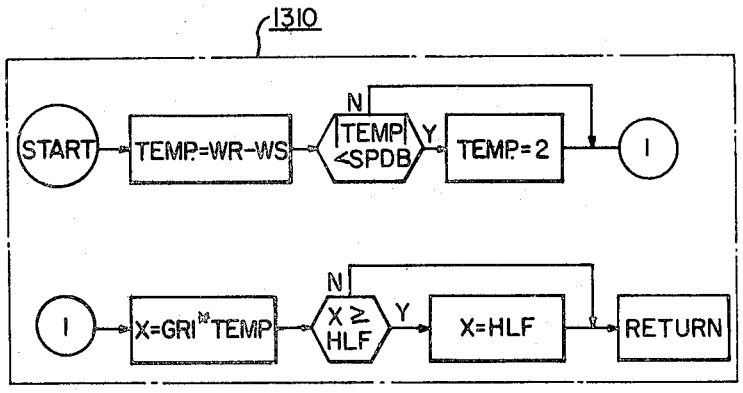
FIG. 14 shows a flow chart of a speed loop (SPDLOOP) subroutine which is operable in accordance with the principles of the invention.

Making reference to FIG. 14, the speed loop (SPDLOOP) subroutine flow chart 1310 is shown in greater detail. Two FORTRAN statements signify the operations of the speed loop subroutine program flow chart 1310. These statements are:

```
CALL SPDLOOP

REF1=REFDMD+X
```

Variables in the flow chart 1310 are defined as follows:

| FORTRAN VARIABLES | ENGLISH LANGUAGE EQUIVALENT |
|---|---|
| WR | The turbine rated speed reference |
| WS | The turbine speed |
| TEMP | Temporary Storage Location variable |
| SPDB | The speed deadband |
| GR1 | The speed regulation gain |
| X | Speed value |
| HLF | The high limit function |

PLANT CONTACT CLOSURE INPUT (PLANTCCI) SUBROUTINE PROGRAM

Figure 15:
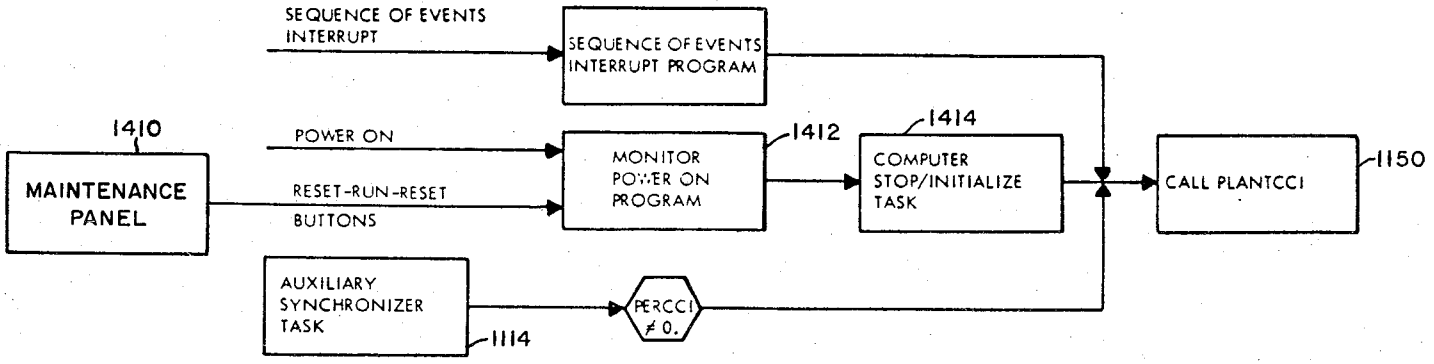
FIG. 15 shows a block diagram of a subroutine for scanning contact close inputs of the Digital Electro Hydraulic System which is operable in accordance with the principles of the invention.

A plant contact closure input subroutine 1150 as shown in FIG. 8, scans all the contact inputs tied to the computer through the plant wiring 1126 and sets logic data images of these in designated areas within the memory 214 of the computer 210. The CCI scan occurs on demand such as by the Sequence of Events program. The details cf the plant contact closure input subroutine 1150 is presented in greater detail in the computer readout of the entire DEH program in Appendix 3. A block diagram of the various functions of the plant contact closure input subroutine 1150 is shown in FIG. 15. The plant contact closure input subroutine 1150 is also utilized when power to the computer 210 is turned on or when the computer buttons reset-run-reset are pressed on a maintenance panel 1410. Under these circumstances, a special monitor power-on routine program 1412 is called upon. This program executes the computer STOP/INITIALIZE task progrom 1414 described previously, which in turn calls the plant contact closure input subroutine 1150 for performance of the initializing procedure.

The operator can also call the plant contact closure input subroutine 1150 through the auxiliary synchronizer program 1114, if desired, whereby a periodic scan of the entire computer CCI system is implemented for checking the state of any one or group of relays in the CCI system.

AUTOMATIC TURBINE START-UP PROGRAM FOR FOSSIL UNITS

A digital computer is a powerful tool for achieving a better and more efficient control of a turbo-generator unit. To take advantage of the computer's ability to scan, memorize, calculate, make decisions and take executive actions, the computer program should go further than the operating instructions, normally provided with each turbine, by scanning additional parameters if necessary, determining the trends in the parameter changes and performing computations beyond the capacity and duties of a human operator.

The general objective of the starting and load changing recommendations is the protection of the turbine parts against thermal-fatigue cracking caused by internal temperature variations. In the large turbines of present design the critical element is the H.P. rotor due to its relatively large diameters and high number of temperature variations at the first stage zone produced during startups and load changes. The operating procedures provided with each turbine, in the form of charts, assume that the machine is normally passing from one steady state to another, during a transient period, and the transition between the two selected states should be performed in a determined time to keep the thermal stresses below the allowable limit.

With the help of the computer, the thermal stresses in the rotor can be calculated minute by minute based on the actual temperature at the first stage provided by a thermocouple. The assumption that the turbine was in a steady state condition is no longer necessary. Once the thermal stress (or strain) is calculated, it can be compared with the allowable value, and the difference used as the index of the permissible first stage temperature variation, translated in the computer program as a variation of speed or load or rate of speed or load change.

Using the memory of the computer, values of some parameters can be stored for use in the estimation of their future values or rate of change, which in turn are used to take corrective measures before alarm or trip points are reached. Such is the case with metal temperature differentials and differential expansions.

Bearing vibration is another of the parameters for which the computer capacity is used in making logical decisions. Each bearing is under close supervision and when one of the vibrations reaches an alarm limit, its behavior is studied and a decision is made according to the estimated future value of the vibrations, and whether it is an increasing, steady or decreasing function. A priority system is also inserted due to the possibility that two or more bearings may be in a different stage of alarm.

Under the approach used in the program, the rotor stress (or strain) calculations, sub-program P01, and its decision-making counterpart, sub-program P04, are the main controlling sections. They will allow the unit to roll with relatively high acceleration until the anticipated value of strain or other controlling parameters predict that limiting values are to be reached in the near future. Then a lower rate is selected and, if the condition persists, a speed hold is generated.

The following describes the Automatic Turbine Start-Up Program (ATS) in the DEH-P2000 Controller. The ATS program employs general concepts including the rotor stress control concepts described in the aforementioned Berry patent. In providing automatic control and monitoring, the ATS provides improvements over the Berry patent and earlier control systems in which digital computers have been used to provide supervisory startup control over analog EH controls.

The ATS Program is stored and executed in the same Central Processing Unit (CPU) as the basic DEH Programs. Both Programs work directly together by means of shared core locations. They also share the same input/output hard-and software, which is needed to communicate with the outside world, i.e., to read and operate contacts. The ATS Program is capable of rolling the turbine from turning gear to synchronous speed. It will check the pre-roll conditions, determine if a soak period is required, transfer from throttle valve (TV) to governor valve (GV), check the presynchronizing conditions and allow the automatic synchronizer to put the unit on line or otherwise allow synchronization to occur, i.e. under accurate speed loop control.

During the operation of the turbine, whether during the acceleration period or under load, the computer will monitor the various parameters of the turbine, compare their values with limit values and print messages to inform the operator about the conditions of the machine to guide him in the operation of the unit.

The modes of operation are ATS Control and ATS supervision. If both the "turbine auto-start" and the "turbine supervision off" pushbuttons are not backlighted the ATS Program is in ATS Supervision and messages are printed out. Pressing the "turbine auto start" button brings the ATS Program into ATS control. Pressing the "turbine supervision off" button stops the messages from being printed out while the ATS Programs are still running. If the "turbine supervision off" button is pushed the second time, all current alarm messages and all subsequent messages are printed.

In ATS Control, the computer will control the unit from turning gear to synchronization and application of initial load.

The computer performs the following evaluations and control actions:

(a) Every minute prior to rolling off turning gear, the program checks and compares with allowable limits, the following parameters: Throttle temperature, differential expansions, metal temperature differentials, vacuum, exhaust temperatures, eccentricity, bearing metal temperatures, drain valve positions.

(b) Requests a change in throttle steam conditions to match impulse chamber steam temperature to metal temperature within $-100°$ & $+200°$ F.

(c) Allows the turbine to roll off turning gear.

(d) Sets the target speed and selects the acceleration in the DEH controller.

(e) Determines the heat soak time at 2200 RPM and counts it down.

(f) Accelerates the turbine to 3300 RPM at controlled rates.

(g) Commands the DEH controller to transfer from throttle to governor control.

(h) Accelerates the turbine to synchronous speed.

Allows the Automatic Synchronizer and DEH Controller to put the turbine on the line and apply minimum load.

(j) Calls for a "Load hold" at initial load if required by the thermal conditions of the turbine.

Under ATS Supervision, the function of the computer is limited to monitoring the various parameters and generating appropriate messages to assist the operator in the control of the turbine. The strain calculation is continuously performed to advise the operator about the thermal condition of the rotor. It is the operator's responsibility to match steam and metal temperatures, set demands, select rates of speed and load changes, determine the heat soak requirements and take all the necessary sequential steps to bring the turbine up to speed and load it.

All programs are called periodically and will run to completion depending on conditions set by a higher priority program when there is any Program P15 determines the appropriate action to be performed in a sequential operational order. Programs P01 through P14 check the turbine and generator parameters. They compute rotor temperatures and strain at impulse chamber zone; they calculate anticipated metal temperature differentials and differential expansions. Depending on the mode of operation these programs set or advise to set new DEH demands or holds.

| PROGRAM LIST | |
|---|---|
| P01 | Determination of rotor thermal conditions. |
| P02 | Periodic computation and supervision of anticipated steam chest wall, bolt flange temperature differentials |

-continued

| PROGRAM LIST | |
|---|---|
| | and differential expansion. |
| P03 | Supervision of turning gear operation. |
| P04 | Control of rotor stress at first stage. |
| P05 | Supervision of eccentricity and vibration. |
| P06 | Turbine metal temperature supervision. |
| P07 | Control of EH speed reference. |
| P08 | Supervision of bearing temperatures. |
| P09 | Supervision of generator. |
| P10 | Supervision of gland seal, turbine exhaust and condenser vacuum conditions. |
| P11 | Supervision of drain valves and computation of anticipated differential expansion. |
| P12 | Supervision of LP exhaust temperatures. |
| P13 | Sensor failure action. |
| P14 | Computation and timing of heat soak time. |
| P15 | Acceleration sequence. |

AUXILIARY SYNCHRONIZER PROGRAM

Figure 16:
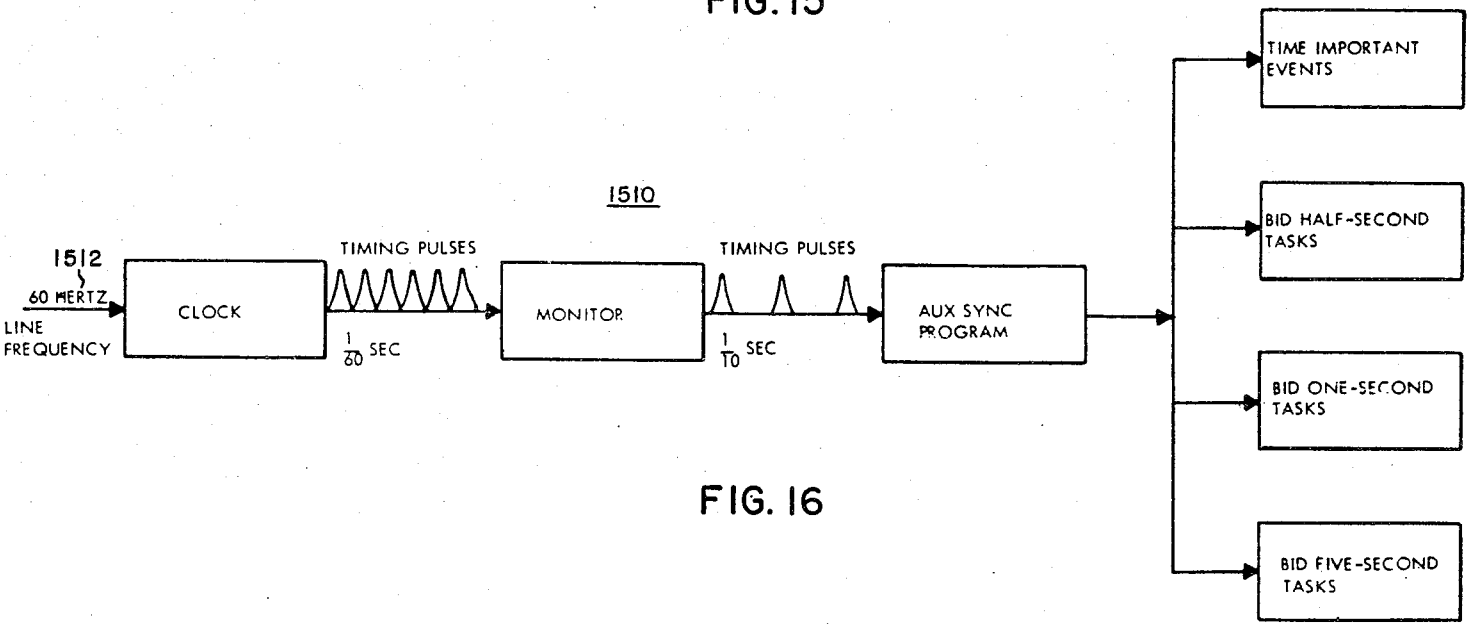
FIG. 16 shows a block diagram of an auxiliary synchronizer computer program which is operable in accordance with the principles of the invention.

With reference to FIG. 16, the block diagram shows an overall scheme for the auxiliary synchronizer program 1510. The auxiliary synchronizer program 1510 has two functions. It performs accurate counting to determine the time duration of important events to be described in more detail and it synchronizes the bidding for execution of all periodic programs in the digital electrohydraulic system 1100 on a predetermined schedule. The auxiliary synchronizer program 1510 utilizes a power line frequency 1512 of 60 hertz for timing the various tasks.

OPERATOR'S PANEL AND FLASH PROGRAM

Referring now to FIGS. 17, 18 and 19, the control panel 1130 for the digital electrohydraulic system 1100 is shown in detail. Specified functions have control panel buttons which flash in order to attract the attention of an operator. Buttons reference low limit 1610, reference high limit 1612, valve position limit 1614, throttle pressure limit 1616, DEH 1100 ready for automatic or operator auto 1618, valve status contingency 1620, governor valve contingency 1622, throttle valve contingency 1624, and invalid request 1626 flash if any of the contingency limits or functions assigned to these operations is not in a proper predetermined state or value.

FIG. 20 shows the flow chart of the flash task program 1136. The flash task is included in FIG. 8 as the flash task block 1136.

The control of the operation of the DEH control system 1100 is greatly facilitated for the operator by the operator by the novel layout of the operator's panel 1130, the flashing and warning capabilities thereof, and the interface provided with the turbine control and monitor functions through the pushbutton switches. In addition, simulated turbine operation is provided by the DEH system for operator training or other purposes through the operation of the appropriate panel switches during turbine down time. Further, it is noteworthy that manual and automatic operator controls are at the same panel location for good operator interface under all operating conditions. More detail on the functioning of the panel pushbuttons is presented in Appendix 2 and implicatively elsewhere in the description of the DEH programs herein.

In addition the panel 1130 layout of FIGS. 17, 18 and 19 is unique and very efficient from operation and operator interface considerations. The control of the DEH system 1100 by the buttons of the panel 1130 and the software programs thereto provides improved operation of the computer 210 and turbine generator 10.

The software details of the panel 1130 interface are available in the appendices III, IV, V and VI.

CONTACT CLOSURE OUTPUT TEST PROGRAM

In FIG. 21, a flow chart of a contact closure output test task program 1610 is shown. The contact closure output test program 1610 provides a mechanism for setting any contact output or any group of consecutive contact outputs in the plant 1126. The contact closure output test task facilitates debugging of programs and testing computer hardware and plant wiring in field installations of the digitial electrohydraulic system 1100.

SEQUENCE OF EVENTS INTERRUPT PROGRAM

The sequence of events interrupt program 1124 shown in block form in FIG. 22 and in flow chart form in FIG. 23 is activated if any one of the contacts in the plant 1126 of FIG. 8 changes state. The sequence of events program of FIG. 22 through the action of an executive program activates the CC1 scan thereby scanning all contacts which are inputted into the digital electrohydraulic system 1100 upon the changing of state of one of such contacts. The sequence of events program of FIG. 22 interrupts the operation of the digital computer 1014 of FIG. 6 thereby stopping the operation of any program in progress. The plant condition that changes state and activates the sequence of events program 1124 of FIG. 22 initiates the execution of the appropriate function program. Upon the completion of execution of a short interrupt program, the computer 1014 of FIG. 6 resumes execution of the interrupted program. The sequence of priorities of the various interrupt functions is shown in FIG. 10. Contact inputs scanned by the CC1 subroutine are set forth in the input/output signal list in Appendix 4.

BREAKER OPEN INTERRUPT PROGRAM

Referring now to FIG. 1, if the breaker 17 opens thereby removing electrical load 19 from the generator 16, the turbine system 10 will begin to accelerate. The acceleration will overspeed the turbine generator system 10 and damage the turbine generator system 10 if it is not checked. In order to minimize overspeed problem when the breaker 17 opens a breaker open interrupt program 1710 shown in FIG. 24 begins to function through the executive program upon sensing the opening of the breaker 17. Therefore, the breaker open interrupt program 1710 activates the governor valves GV1 through GV8 and thereby tends to close them. FIG. 25 shows in detail the breaker open interrupt program 1710 flow chart. An independent hydraulic overspeed protection system shown in Serial No. 189,322, W. E. Case No. 42,433 by Fiegbein and Csanady also acts directly under predetermined conditions to close the governor valves GV1–GV8 and the throttle valves TV1–TV4 by dumping the hydraulic fluid in the valve actuators thereby giving additional protection to the turbine system 10. When the hydraulic overspeed protection system reacts to a breaker open operation (i.e. a full load rejection), the turbine steam valves are directly and immediately closed and the DEH system functions on a following basic to update its valve position outputs to call for valve closure. When a partial load rejection occurs, i.e. the breaker remains closed, a control strategy like that described in the aforementioned Braytenbah and Richardson patent application is effected by the DEH system.

TASK ERROR PROGRAM

A task error program 1810 shown in FIG. 8 has supervisory control over all the other programs in the DEH system 1100. If any program is not functioning properly the task error program 1810 will switch the DEH system 1100 to manual control thereby preventing any accident, overload, underload, overspeed, or underspeed from happening. An example of the operation of the task error program 1810 would be when a turbine operating program such as the panel task 1112 calls to use an input/output system such as the panel lamp program 1132. The panel task 1112 calls the monitor program 1122 with a set of arguments describing the function to be performed. The monitor program 1122 then carries out the request and returns to the panel task program 1112 at the completion of the function. However, if the monitor program 1122 finds erroneous information in the arguments or data passed along by the panel task 1112 then the input/output request for the panel lamp 1132 is ignored and the panel task 1112 is disabled. An example of such an error is a zero, negative or non-existent register number when calling the contact output information of the monitor program 1122. If an error should occur the task error program 1810 transfers the DEH system 1100 to manual control. A monitor reference manual, TP043, of the Computer and Instrumentation Division of the Westinghouse Electric Corporation describes in detail all possible error conditions.

FIG. 26 shows a block diagram of the task error program 1810. High safety and high reliability of operation of the DEH system 1100 are assured by the linking of the taks error program 1810 to other DEH programs.

TURBINE TRIP INTERRUPT PROGRAM

In FIG. 8, a turbine trip interrupt program 1850 is shown coupled to the plant wiring 1126 and to the throttle valves TV1–TV4 and the governor valves GV1–GV8 1021. If the turbine system 10 begins to accelerate and reaches a predetermined speed for example 105% of synchronous speed, a contact 1852 connected to the plant wiring changes state and indicates overspeed to the turbine trip interrupt program 1850. The turbine trip interrupt program 1850 immediately signals the panel 1112 and control task 1020 which move all valves to the closed position in the turbine system 19. The valves to be closed are the throttle valve, TV1 through TV4, the governor valves GV1 through GV8. By closing all the valves in the turbine system 10, a dangerous overspeed and possibly even a runaway condition is avoided. A block diagram of the turbine trip interrupt system 1850 is shown in FIG. 27.

PANEL INTERRUPT PROGRAM

A block diagram of the panel interrupt program 1156 is shown in FIG. 28. The panel interrupt program 1156 responds to pushbutton requests from the operator's panel 1130 and decodes any instructions therefrom. Then, the panel interrupt program 1156 bids or puts itself in a queue along with other panel requests for the panel task program 1112 in order to carry out the proper response. The operator's instructions from the operator's panel 1130 are routed to the proper location within the panel task program 1112 which calls upon a predetermined program for execution of a specific command.

VALVE TEST, VALVE POSITION LIMIT AND VALVE INTERRUPT PROGRAM

Referring again to FIG. 8, a valve test program 1810 and a valve position limit program 1812 are subroutines of the control task program 1020. The valve test program 1810 tests the operation of any predetermined valve or valves such as the throttle valves TV1 through TV4 by the operator pressing a valve test button 1814 of FIG. 18 on the operator's panel 1130. The on-line testing of throttle valves TV1 through TV4 on a periodic basis detects potential malfunctions in the mechanism thereof which could become dangerous if not corrected.

The valve position limit program 1812 of the control task 1020 operates when an operator presses either of the two buttons, valve position limit lower 1816 or valve position limit raise 1818 of FIG. 18. The valve position limit program 1812 provides the operator with a means for incrementally changing the limit on steam flow through the turbine system 10.

Referring again to FIG. 18, upon the release of the valve test button 1814, the valve position limit lower button 1816 or the valve position limit raise button 1818 by an operator, the valve interrupt program 1158 shown in FIG. 8, is run by the monitor program 1122. The monitor program 1122 runs the valve interrupt program 1158 and thereby resets various flags and counters. The monitor program 1122 to the control task 1020 that manual action has ceased and that the next program waiting in line is free to run. In FIG. 29 a block diagram of the valve interrupt program is shown.

STOP/INITIALIZER PROGRAM

In FIG. 8, a stop/initializer program 1162 is shown ancillary to the clock program 1020. Should the DEH system 1100 have a power failure or be turned off, the stop/initializer program 1162, which has the highest priority (FIG. 9) of any program in the DEH system 1100, starts to run. Within the time that the voltages of the power supplies, not shown, decay to an unusable limit, the stop/initializer program 1162 sets the DEH system 1100 into a known state for the impending stop. Upon restarting, the stop/initializer program 1162 is able to set all contact and analog outputs to the throttle valves TV1 through TV4 and the governor valves GV1 through GV8 shown in box 1021 at reset position; all internal counters and logic states are reset; certain systems counters are set to starting values; a scan of all contact inputs from the plant wiring 1126 is carried out and the logic program 1110 is executed to align the DEH system 1100 to existing plant conditions. Finally, the controller reset lamp 1820 on the operator's panel 1130 as shown in FIG. 18 is turned on and the DEH system 1100 is ready to restart. A flow chart of the stop/initializer program is shown in FIG. 30.

VISUAL DISPLAY PROGRAM

The visual display program 1134 as shown in FIG. 8 is connected with the panel interrupt program 1156 and the auxiliary synchronizer program 1114. The visual display program 1134 controls the display windows 1138 with a reference window 1852 and a demand window 1854. The demand window 1854 and the reference window 1852 are also shown in FIG. 18 as part of the operator's panel 1130. The visual display task 1134 aids in communication between an operator of the control panel 1130 of FIG. 18 and the digital electrohydraulic system 1100. By pressing an appropriate button such as the reference button 1856 a reference value will be displayed in the reference window 1852 and a demand value will be displayed in the demand window 1854. Similarly, for example, if a valve position limit display button 1858 is pressed a valve position limit valve will be displayed in the reference window 1852 and the corresponding valve variable being limited is displayed in the demand window 1854. Upon pressing the load rate button 1858 the load rate will be displayed in the reference window 1852. In addition, a keyboard 1860 has the capability through an appropriate program to be described further infra to select virtually any parameter or constant in the DEH system 1100 and display that parameter in the reference window 1852 and the demand window 1854. Referring now to FIG. 31 a table of the display buttons and their functions is given in greater detail. In FIG. 32 a block diagram of the visual display program system is shown. FIG. 33 shows a block diagram of the execution of a two-part visual display function.

ANALOG SCAN PROGRAM

The analog scan program 1116, shown in FIG. 8 periodically scans all analog inputs to the DEH system 1100 for control and monitoring purposes. The analog inputs include impulse chamber pressure from the turbine impulse chamber pressure detector 110 of FIG. 1, the electric power detector 18 and the speed detector(s) 58. The following variables are measured for computer input but not shown in the figures: throttle pressure, shaft vibrations, speed and the position of: the throttle valves TV1 through TV4 and the governor valves GV1 through GV8.

The function of the analog scan program 1116 is performed in two parts. The first part of the analog scan program 1116 comprises the scanning of a first group of analog inputs. Values of scanned inputs are converted to engineering units and checked the values against predetermined limits as required for computations in the DEH computer.

The second part of the function of the analog scan program 1116 comprises the scanning of the analog inputs required for the automatic turbine startup program as shown in FIG. 8. The automatic turbine startup program is shown in FIG. 8 as the ATS periodic program 1140, the ATS analog conversion routine 1142 and the ATS message writer program 1144. In FIG. 34 a block diagram of the analog scan program 1116 is shown. In FIG. 35 a timing chart for the analog scan program 1116 is shown.

LOGIC CONTACT CLOSURE OUTPUT SUBROUTINE

The logic task 1110 includes a subroutine called a logic contact closure output subroutine 1910 therein. The logic contact closure output subroutine 1910 updates all the digital outputs to the status lamps and contacts 1128 for transmission thereto. The logic program 1110 handles a great number of contact or level outputs thereby keeping the output logic states of the DEH computer current. The logic contact closure output subroutine 1910 reduces the total storage requirements otherwise required for the logic program 1110. Additionally, the logic contact closure output subroutine 1910 is called by the logic program 1110 to provide a list of variables which are updated. A flow chart for the logic contact closure output subroutine 1910 is shown in FIGS. 36 and 37.

LOGIC TASK

The logic task 1110, as shown in FIG. 8 selects proper operating states status lamps and contacts 1128, control functions 1020, go logic, throttle pressure logic, breaker logic, interface logic, etc. in the DEH system 1100 in response to signals from the operator's panel 1130, internally generated decisions and changing conditions in the turbine system 10. Referring now to FIGS. 36 and 37, a block diagram representing the operation of the logic task 1100 is shown. A contact input from the plant wiring 1126 triggers the sequence of events or interrupt program 1124 which calls upon the plant contact closure input subroutine 1150 which in turn requests that the logic program 1110 be executed by the setting of a flag called RUNLOGIC 1151 in the logic program 1110. The logic program 1110 may also be run by an operator depressing button on the operator's panel 1130. The logic program 1110 is also run by the panel interrupt program 1156 which calls upon the panel task program 1112 to run the logic program 1110. The control task program 1020 after performing its various computations and decisions will request the logic program 1110 to run in order to update conditions in the control system. In FIG. 38, the functioning of the logic program 1110 is shown. FIG. 39 shows a more explicit block diagram of the logic program 1110.

The logic program 1110 controls a series of tests which determine the readiness and operability of the DEH system 1100. One of these tests is that for the overspeed protection controller which is part of the analog backup portion of the hardwired system 1016 shown in FIG. 6. Generally, the logic program 1110 is structured from a plurality of subroutines which provide the varying logic functions for other programs in the DEH program system, and the various logic subroutines are all sequentially executed each time the logic program is run.

MAINTENANCE TEST

In order to take advantage of the full flexibility, adjustability and dynamic response of the DEH system 1100 a maintenance test system 1810 is provided, a logic flow chart of which is shown in FIG. 40. The maintenance test program 1810 allows an operator to change, adjust or tune a large number of operational parameters and constants of the DEH system 1100. The constants of the DEH system 1100 can therefore be modified without extensive adjustment or reprogramming. An operator is able to optimize the DEH system 1100 from the control panel 1130 as shown in FIGS. 17 and 18 which allows for an essentially infinite variability in the choice of constants. Great flexibility and control is therefore available to an operator.

In addition, the maintenance test program 1810 of FIG. 40 allows an operator to use a simulation mode for operator training purposes. The simulator mode is described infra herein.

ANALOG/DIGITAL SPEED FAILURE MONITOR

As part of the logic task 1110 the analog turbine speed channels 58 and digital turbine speed channel 59 are monitored. The logic task program 1110 monitoring is described in detail in Speed Selector Function in FIG. 59.

TURBINE SUPERVISION OFF LOGIC

During speed control the automatic turbine startup program 1141 automatically accelerates the turbine 10. In order to monitor the variables such as metal and steam temperatures, steam pressures, turbine mechanical vibrations and speed, the ATS program 1141 has an ATS periodic portion 1140. The turbine supervision off program 1812 turns off the supervisory programs if the analog scan task 1116 or inputs thereto malfunctions.

COMPUTER SET MANUAL LOGIC

FIG. 42 shows a flow chart of a transfer to manual operation subroutine. In the event of specific malfunctions in the DEH system 1100 or the turbine system 10, the logic program 1110 transfers the DEH system 1100 back to the manual control of an operator. The malfunctions which initiate the transfer of the DEH system 1110 back to manual control include but are not limited to the failure of the speed signal while in speed control. Details of the speed control mode are covered herein infra under Speed Selector Function in FIG. 59.

BREAKER LOGIC

Referring again to FIG. 1, upon synchronization of the turbine system 10 with a power grid, not shown, the governor valves GV1 through GV8 must allow sufficient steam to flow through the turbine system 10 to overcome turbine system losses. Otherwise, upon synchronization of the generator 16 with other generators in the power grid by closing the breakers 17, the turbine system 10 would have a tendency to motor. The DEH control system 1100, in order to prevent motoring and subsequent damage to the low pressure turbine section 24, automatically opens the governor valves GV1 through GV8 such that a predetermined load is picked up by the generator 16 upon synchronization thereby preventing motoring.

The value of the initial megawatt pickup upon synchronization is entered from the keyboard 1860 in FIG. 18 and is typically set at about 5% of the rating of the turbine-generator 10. In the load control system 1814, as shown in FIG. 43, the actual megawatt pickup is modified by a factor which is the ratio of the rated throttle pressure to the existing throttle pressure at synchronization. This factor is utilized by the DEH system 1100 in maintaining approximately the same initial megawatt load pickup whether the turbine system 10 is synchronized at rated throttle pressure or at some lower or even higher throttle pressure. Referring again to FIG. 43, the upper part of the diagram shows the governor valve control before synchronization, when the turbine-generator system 10 is in the speed mode. The lower part of the diagram shows of the operation the governor valves GV1 through GV8 after synchronization.

Therefore, at synchronization with the transfer from speed to load control the governor valves GV1 through GV8 must initially have the same value of analog signal applied thereto. The relationship above is expressed as $GVAO_{LOAD}=GVAO_{SPEED}$. Referring again to FIG. 43, the path taken by the load control system 1814 as part of a control task program 1020 would be with megawatt and impulse pressure feedbacks out of service, the governor valve GV outputs are given as follows:

$$GVAO_{LOAD}=GR8*GVPOS$$

$$GVAO_{SPEED}=GR7*SPD$$

where:

GVPOS is the governor valve position, and

SPD is the governor valve speed position, and

GR7 and GR8 are ranging gains.

The required governor valve position GVPOS is in turn related to the governor setpoint GVSP and a governor valve nonlinear characterization curve 1816. Therefore, $$GVPOS = \frac{POS(2)}{SP(2)} * GVSP$$

where:

POS(2) and SP(2) are points on the valve characterization curve 1816 and represent the slope of a segment of that characterization curve 1816. By substitution the governor valve setpoint is $$GVSP = \frac{SP(2)}{POS(2)} * \frac{GR7}{GR8} * SPD$$

Similarly the equation for calculating the value of reference demand (REFDMD) 1818 which gives the required increase in the demand signal 1818 when the main breaker 17 is closed on transfer from speed to load control is given thereby. When this quantity is added to the throttle pressure modified initial megawatt pickup, the DEH system 1100 will make a smooth transfer from speed control to load control without any motoring action by the turbine-generator 10.

THROTTLE PRESSURE CONTROL LOGIC

The throttle pressure detector 112 of FIG. 1, transmits a signal to the DEH computer which is compared to a predetermined pressure set by keyboard 1816 entry on the operator's panel 1130. In the event that the throttle pressure falls below the predetermined throttle pressure setpoint, the turbine reference 1818 of FIG. 43 is run back or decreased at a preselected rate until the throttle pressure equals the setpoint. The throttle pressure control logic shown in FIG. 45 allows the throttle pressure control to be placed in service or taken out of service by an operator when the turbine 10 is in automatic control. In addition, the throttle pressure control loop is automatically removed from service under contingency conditions, such as descrepancies between valve position and valve signal, lags in the valve positions during transfer from throttle to governor valve control, large changes in load rates to be described in greater detail herein infra, when the turbine 10 is in speed control.

MEGAWATT FEEDBACK LOGIC

Referring to FIG. 46, a block diagram of the megawatt feedback loop is shown in greater detail than in FIG. 7. It should be noted that the speed compensated reference 1087, at the input of multiplication function 1086, is multiplied by the megawatt compensation 1089. The multiplication of the signals instead of a differencing provides an additional safety feature since the loss of either of the signals 1087 or 1089 will produce a zero output rather than a runaway condition.

IMPULSE PRESSURE FEEDBACK LOGIC

The impulse pressure feedback logic which includes the compare function 1090 and the impulse pressure 1088 of FIG. 7 is shown in greater detail in FIG. 47. The impulse pressure feedback loop (IMP loop) and the megawatt pressure feedback loop as shown in FIG. 46 adapt the DEH system 1100 by taking into account valve non-linearities and also assure that the megawatt setting selected by an operator is truly being supplied by the turbine 10 and the generator 16. The impulse pressure feedback logic 1816 provides the capability for the IMP loop to be bumplessly removed from service and placed in service. With a digital computer, bumpless transfer is achieved without the use of elaborate external circuitry because of the digital computational nature of the machine. A value can be computed instantaneously and inserted in the integrator 1218 of the proportional plus reset controller subroutine 1068 as shown in FIG. 11. In the preferred embodiment of the Digital Electro-Hydraulic control system 1100, the proportional plus reset controller 1168 is utilized by the following functions; the megawatt feedback loop 1091, the impulse pressure feedback loop 1816 and the speed feedback loop made up of the rated speed reference 1074, the compare function 1076 and the actual turbine speed function 1076.

SYNCHRONIZER LOGIC

The DEH control system 1100 can provide an interface with conventional automatic synchronizer equipment by accepting signals from the synchronizer for the turbine reference and demand values. The automatic synchronizing equipment provides input pulses to the DEH computer to indicate whether the turbine 10 has a speed and the generator 10 has a voltage and phase angle which is too high or too low for synchronization of the generator 16 to the line. The turbine 10 operates in accordance with actions generated by the DEH control program in response to the synchronizer signals. FIG. 48 shows a flow chart of the automatic synchronizer logic program.

Because of the extreme accuracy of the ATS program 1141 in controlling the speed of the turbine 10 the preferred method for synchronization will be described herein infra.

AUTOMATIC DISPATCH LOGIC

The DEH control system 1100 and the turbine 10 may, in the preferred embodiment, be controlled and operated from a remote location. Referring again to FIG. 18, an automatic dispatch system (ADS) button 1870 is depressed by an operator thereby turning over the demand and reference inputs to a remote location, such as, a central dispatching office, which can allocate total utility loads on an economic basis to all units in a power system. A flow chart for the automatic dispatch program is shown in FIG. 49. It is triggered into operation on demand for automatic dispatch in order to interface the remote data with the DEH system.

AUTOMATIC TURBINE STARTUP (ATS)

Referring now to FIG. 50, a flow chart of the automatic turbine startup program is shown. In order to improve the performance of a turbine 10 at startup and thereby decrease startup time and allow the turbine 10 to go to line at the earliest possible moment without undesired adverse effect on turbine life, the DEH system 1100 includes an automatic startup program. The automatic turbine startup and monitoring programs 1140, 1141, 1142 monitor large numbers of analog signals representing various turbine parameters including bearing, coolant, steam temperature, bearing vibration, speed, valve phases, and others included in the input/output signal list in Appendix 5. In addition, the automatic startup programs 1140, 1141, 1142 calculate complex heat distribution equations which describe temperature variations in critical metal parts of the steam turbine 10 as generally considered in the aforementioned Berry patent. The automatic turbine startup program 1141 types out the variables and associated warnings through ATS periodic program 1140, ATS conversion routine 1142 and the message writer 1144 on the logging typewriter 1146.

The ATS automatic startup program 1141 is able to control the speed of the turbine generator 10 to well within a maximum deviation of 1 rpm over tens of minutes. Because of the extreme accuracy with which the ATS program 1141 can hold the speed of the turbine generator 10, a preferred method for synchronization in the present embodiment is the use of manual synchronization of the generator 16 to the line. The automatic dispatch system as shown in FIG. 49 sends signals to the ATS program 1141 thereby allowing the ATS program to hold the speed of the turbine generator system 10 to well within 1 rpm. By the use of simple lamps to indicate the differential phase between the generator 16 and the line an operator is conveniently able to manually synchronize the system.

A more common approach, in the prior art, is the use of conventional automatic synchronizer equipment. However, because of the high degree of accuracy which the ATS program 1141 controls the turbine generator 10 the present system is easily synchronized without conventional automatic synchronizer equipment.

REMOTE TRANSFER LOGIC

In order to allow the DEH system 1100 to provide for automatic turbine operation from an independent source or a remote location, a remote transfer logic program shown in flow chart form in FIG. 51 is provided. In the preferred embodiment of the DEH system 1100, the available remote modes place the DEH system under control of the external automatic synchronizer system previously considered the external automatic dispatching system or the automatic turbine startup system which is implemented within the DEH computer. An operator has the capability of choosing whichever mode is permissible and desired at a particular moment.

PANEL TASK

The panel task 1112 responds to the bottons pressed on the operator's panel 1130 by an operator of the DEH control system 1100. The control panel 1130 is shown in FIGS. 17 and 18. Referring now to FIG. 52, the interactions of the panel task 1112 are shown in greater detail. Pushbuttons 1110 are decoded in a diode decoding network 1912 which activates the panel interrupt program 1156 through a combination of panel interrupts generated by diode matrix outputs. The panel interrupt program activates the panel task 1112 whereby either the panel task 1112 carries out the desired action or the logic task 1110 is bid or the visual display task 1134 is called to carry out the desired command. In FIG. 52 the panel task 1112 is shown in block diagram form.

CONTROL PROGRAM

The control program 1012 is shown in greater detail in FIG. 54. In the computer program system, the control program 1012 is interconnected with the analog scan program 1116, the auxiliary sync program 1114, the sequence of events interrupt program 1124 and the logic task 1110. FIG. 55 shows a block diagram of the control program 1012. The control program 1012 accepts data from the analog scan program 1116, the sequence events interrupt program 1124 and is controlled in certain respects by the logic program 1110 and the auxiliary synchronizing program 1114. The control program 1012, upon receiving appropriate inputs, computes the throttle valve TV1–TV4 and the governor valve GV1–GV8 outputs.

The control program 1012 of the DEH control system 1100 functions, in the preferred embodiment, under three modes of DEH system control. The modes are manual, where the valves GV1–GV8 and TV1–TV4 are positioned manually through the hardwired control system and the DEH control computer tracks in preparation for an automatic mode of control. The second mode of control is the operator automatic mode, where the valves GV1–GV8 and TV1–TV4 are positioned automatically by the DEH computer in response to a demand signal entered from the keyboard 1130, of FIG. 18. The third mode of control is remote automatic mode, where the valves GV1–GV8 and TV1–TV4 are positioned automatically as in the operator automatic mode but use the automatic turbine startup program 1141 or an automatic synchronizer or an automatic dispatch system for setting the demand value.

VALVE POSITION LIMIT FUNCTION SUBROUTINE

Referring now to FIGS. 56 and 56*a*, a block diagram of the valve position limit function subroutine 1950 is shown in detail. The valve position limit function subroutine 1950 is active in both the speed and load control modes of the turbine-generator 10. A speed control signal is limited by limit function 1952 which is controlled by the valve position limit function 1954 (VPOSL); similarly the governor valve speed signal (GVPOS) signal is limited by limiting function 1956. The valve position limit function 1954 may be raised by a raise function 1960 and by a lower function 1958. The valve position limit function subroutine 1950 provides an operator with the capability of limiting the flow of steam through the turbine 10 to any predetermined value.

VALVE TEST FUNCTION

In FIG. 57, a block diagram shows interactions provided for the DEH system 1100 by the valve test function 1962. The valve test function is available with the turbine generator system 10 to enable any controlled valves to be tested on line.

VALVE CONTINGENCY FUNCTION

A valve contingency function 1964 is shown in the flow chart of FIG. 58. In the automatic control mode, the valve contingency function subroutine 1964 continuously checks for discrepancies between the positions of the governor valves GV1 to GV8 called for by the DEH controller system 1100 and the actual valve positions sensed by a linear variable differential transformer LVDT of FIG. 4. If the discrepancy between the sensed and actual positions exceeds a predetermined value set on the keyboard 1860 of the operator's panel 1130, shown in FIG. 18, a valve status lamp 1966 warns the operator of this discrepancy situation. In normal operation the valve status lamp 1966 will flicker briefly and go out after the valve has caught up with the step input command of the DEH system 1100.

The valve contingency function subroutine 1964 has a second feature which alerts the operator to situations in which the manual analog backup system 1016 is not tracking the DEH controller valve analog outputs. Therefore, the operator is warned to transfer from an automatic mode of operation to a manual mode of operation, if bumpless transfer is desired. In the latter case, a manual not tracking monitor lamp is flashed on the operator's panel 1130, of FIG. 18. In the preferred embodiment, the tracking deadband or discrepancy is a keyboard entered constant individually selectable for each throttle valve TV1, TV2, TV3, TV4 and each governor valve GV1 through GV8. The discrepancy valves or deadbands are normally set at about 1%. The valves contingency subroutine 1964 provides an interface for the DEH computer through the analog scan program 1116 and the operator's panel 1130 of FIG. 8.

SPEED SELECTOR FUNCTION

Referring now to FIG. 59, a block diagram of the DEH speed instrumentation and computation interface is shown. A digital counting and shaping circuit 2010 described in the copending Ruether application, referred to supra, and entitled, generates a highly accurate digital signal. The digital shaping and counting circuitry 2010 includes a magnetic pickup, a shaping and counting circuit which passes the data to the DEH computer in the form of a digital numerical value. A second speed signal is generated by high accuracy analog processing circuitry 2012. A third signal is generated by analog supervisory instrumentation processing circuitry 2014 and transmitted to an analog to digital converter 2016 with the signal from the high grade analog processing circuitry 2012. The digital signal from the digital shaping and counting circuitry 2010 passes through a speed channel interrupt program 2018 to a speed channel decoding program 2020. In this speed counting program 2020 an output quantity designated ICOURSE is a low range course value which is used from about 0 to 1600 rpm, while the IFINE quantity is a high range fine value having high accuracy which is used between about 1600 to 4500 rpm. An analog to digital converter 2016 makes both the high precision analog signals from the analog processing circuitry 2012 and the supervisory circuitry 2014 available to the analog scan program 1116 which in turn provides the represented speed values available to the speed selection program 2022. The speed selection program 2022 compares the digital speed value and the high grade analog speed value with the supervisory analog speed value in order to determine whether both the digital value and the high grade analog value are accurate or whether there is any discrepancy between the two. The supervisory speed value is generally not accurate enough for speed control. Therefore, the speed selection program 2022 makes use of the supervisory speed value to determine which of the high grade speed values is accurate if they are not equal. The digital speed value from the digital shaping and counting circuitry 2010 is used as a reference for WS1076 if it is found to be accurate enough for control purposes. The high grade analog speed value from the analog processing circuitry 2012 is utilized if the digital speed value is not accurate enough for control purposes. If either of the high grade signals becomes unreliable, appropriate monitor lamps on the control panel 1130 alert an operator to this fact.

If both the high grade analog and the high grade digital speed values become reliable and if the DEH system 1100 is on wide range speed control then a transfer takes place to the manual mode of control. However, if the turbine system 10 is on load control the DEH system 1100 opens the speed feedback loop bumplessly and continues on automatic control with the remaining feedback loops intact. A flow chart for the speed selection subroutine is shown in FIGS. 60A and 60B.

SELECT OPERATING MODE FUNCTION

Input demand values of speed, load, rate of change of speed, and rate of change of load are fed to the DEH control system 1100 from various sources and transferred bumplessly from one source to another. Each of these sources has its own independent mode of operation and provides a demand or rate signal to the control program 1020. The control task 1020 responds to the input demand signals and generates outputs which ultimately move the throttle valves TV1 through TV4 and/or the governor valves GV1 through GV8.

With the breaker 17 open and the turbine 10 in speed control, the following modes of operation may be selected:

1. Automatic synchronizer mode—logic type level or contact input for adjusting the turbine speed reference and speed demand and moving the turbine 10 to synchronizing speed and phase.

2. Automatic turbine startup program mode—provides turbine speed demand and rate.

3. Operator automatic mode—speed, demand and rate of change of speed entered from the keyboard 1860 on the operator's panel 1130 shown in FIG. 18.

4. Maintenance test mode—speed demand and rate of change of speed are entered by an operator from the keyboard 1860 on the operator's control panel 1130 of FIG. 18 while the DEH system 1100 is being used as a simulator or trainer.

5. Manual tracking mode—the speed demand and rate of change of speed are internally computed by the DEH system 1100 and set to track the manual analog back-up system 1016 as shown in FIG. 6 in preparation for a bumpless transfer to the operator automatic mode of control.

With the breaker 17 closed and the turbine 10 in the level mode control, the following modes of operation may be selected:

1. Throttle pressure limiting mode—a contingent mode in which the turbine load reference is run back or decreased to a predetermined value as long as a predetermined condition exists such that the load is kept at a predetermined minimum.

2. Run-back mode—a contingency mode in which the load reference is run back or decreased at a predetermined rate as long as a predetermined condition exists.

3. Automatic dispatch system mode—input pulses are supplied from an automatic dispatch system when the automatic dispatch system button 1870 on the operator's panel 1130 is depressed. The automatic dispatch system adjusts the turbine load reference and load demand.

4. Operator automatic mode—the load demand and the load rate are entered from the keyboard 1830 on the control panel 1130 in FIG. 18.

5. Maintenance test mode—load demand and load rate are entered from the keyboard 1860 of the control panel 1130 in FIG. 18 while the DEH system 1100 is being used as a simulator or trainer.

6. Manual tracking mode—the load demand and rate are internally computed by the DEH system 1100 and set to track the manual analog back-up system 1016 preparatory to a bumpless transfer to the operator automatic mode of control.

Referring now to FIG. 61, a block diagram is shown illustrating the select operating mode function 2050. Contact inputs from plant wiring 1126 activate the sequence of events interrupt program 1124 which calls the plant contact input subroutine 1150, to scan the plant wiring 1126 for contact inputs. Mode pushbuttons such as automatic turbine startup 1141, automatic dispatch system 1170 and automatic synchronizer 1871 activate the panel interrupt program 1156 which calls tqe panel task program 1112 for classification and which in turn calls upon the logic task program 1110 to compute the logic states involved. The logic task program 1110 calls the control task program 1020 to select the operating mode in that program.

In FIGS. 61A and 61B a flow chart of the select operating mode logic is shown. As one example of mode selection referring to a path 2023, after a statement 7000, provisions are made for a bumpless transfer from an automatic or test mode to an operator mode. The bumpless transfer is accomplished by comparing the computer outputs and the operator mode output signals for the governor valve GV1–GV4 positions. The DEH system 1110 inhibits any transfer until the error between the transferring output and the output transferred is within a predetermined deadband (DBTRKS). Bumpless transfer is accomplished by the DEH control system 1100 by comparing output from one mode of control of the governor valves GV and the throttle valves TV and the same output from another output mode controlling the same parameters. The flow chart of FIGS. 61A and 61B shows a complete operating system. In a hardwired or analog control system, the analog parameter output, to be transferred to must continuously track the parameter output to be transferred from. This tracking method is expensive and cumbersome since it has to be done continuously and requires complex hardware. However, in a digital system, such as the DEH control system 1100, the equating of the two parameter outputs need be performed only on transfer. Therefore, great economy of operation is achieved.

SPEED/LOAD REFERENCE FUNCTION

Referring now to FIG. 62, a block diagram of the operation of the speed/load reference function is shown. The decision breaker function 1060, of FIG. 7, is identical to the speed/load reference function 1060, of FIG. 62. A software speed control subsystem 2092 of FIG. 62, corresponds to the compare function 1062, the speed reference 1066 and the proportional plus reset controller function 1068, of FIG. 7. The software load control subsystem 1094, of FIG. 62, corresponds to the rated speed reference 1074, the turbine speed 1076, the compare function 1078, the proportional controller 1080, the summing function 1972, the compare function 1082, the proportional plus reset controller function 1084, the multiplication function 1086, the compare function 1090, the impulse pressure transducer 1088 and the porportional plus reset controller 1092, of FIG. 7. The speed/load reference 1060 is controlled by, depending upon the mode, and automatic synchronizer 1080, the automatic turbine starter program 1141, and operator automatic mode 1082, a manual tracking mode 2084, a simulator/trainer 2086, an automatic dispatch system 2088, or a run-back contingency load 2090. Each of these modes increments the speed/load reference function 1060 at a selected rate to meet a selected demand. A typical demand/reference rate is shown in FIG. 63 drawn as a function of time.

SPEED CONTROL FUNCTION

FIG. 64 is essentially a combination of FIG. 7 and FIG. 11 with an additional program path which generates a simulated speed signal in the maintenance test mode of operation. The simulated speed signal is generated by feeding back the speed signal to a first order lag transfer function, described supra and in Appendix 3, thereby approximating the initial response of the turbine-generator 10.

LOAD CONTROL FUNCTION

The load control function block diagram shown in FIGS. 65 and 65A is an expansion of the load control, shown in FIG. 7, incorporating the speed loop subroutine and porportional control of function diagram of FIG. 13.

THROTTLE VALVE CONTROL FUNCTION

The throttle valve control function shown in block diagram form in FIG. 66 computes the value of the throttle valve analog signal to the throttle valves TV1 through TV4.

GOVERNOR VALVE CONTROL FUNCTION

FIG. 67 shows a block diagram of the governor valve control function which computes the position of the governor valve output at all times.

TURBINE OPERATION SIMULATION

In order to allow operators to become proficient in the operation of the DEH system 1100 without risking damage to a multimillion dollar turbine-generator system 10 a simulation subroutine 2110, in FIG. 64, is provided during speed control. A similar subroutine 2111 is provided for simulation of the turbine-generator system dynamics during load control.

MANUAL TRACKING

The select operating mode flow chart of FIG. 61A includes a speed tracking function 2010 for transferring bumplessly from one mode to another.

In FIG. 61B, a load tracking function 2012 provides for manual tracking during load control.

BUMPLESS TRANSFER

FIG. 68 shows a flow chart of the governor valve control function. A flow chart path 2100 allows for the smooth and bumpless transfer from governor valve control to throttle valve control and vice versa. A function 2102 tests whether a governor valve bias integrator GVBIAS has reached zero. By forcing the DEH system 1100 to wait until the governor valve bias integrator GVBIAS has reached zero a bumpless transfer from governor to throttle valve control and vice versa is effectuated.

DEH DATALINK

A DEH DATALINK shown in FIG. 8 allows the DEH control system 1100 to communicate with other computers such as the plant commander. In the preferred embodiment, the communication is initiated by the other computer, the plant commander. The DEH DATALINK waits for requests to send or receive information. In the operation of the DEH DATALINK any core location can be interrogated and numerous setpoint values can be changed. The format of the DATALINK is such that information as to a starting address in the memory 214, and a code indicating the number of words to be interrogated or changed. The following eight-bit control words are used for DATALINK transmission and reception.

| CONTROL-WORD SYMBOL | 8-BIT PATTERN | HEXADECIMAL AQUIVALENT | Meaning |
|---|---|---|---|
| DAT | $0011\ 1010_2$ | $3A_{16}$ | DATA Transmission-Mode |
| SPT | $00111011_2$ | $3B_{16}$ | SETPOINT-Transmission Mode |
| ACK | $00000110_2$ | $06_{16}$ | ACKNOWLEDGE-Word |
| NAK | $10010101_2$ | $G5_{16}$ | NOT ACKNOWLEDGE-Work |
| ENQ | $00000101_2$ | $05_{16}$ | ENQUIRY to DEH |
| ETX | $00000011_2$ | $03_{16}$ | END of Message |
| STX | $10000010_2$ | $82_{16}$ | ANSWER from DEH |
| CSF | $10010110_2$ | $96_{16}$ | CHECKSUM Failure |
| SAF | $10010111_2$ | $97_{16}$ | SETPOINT ADDRESS Failure |
| SVF | $10011000_2$ | $98_{16}$ | SETPOINT VALUE Failure |

For an absolute starting address in core to transmission words are used indicating the number of transmission words in one transmission. In the sequencing charts 8-bit numbers are represented by the following symbols:

| | |
|---|---|
| ADD | First half of absolute core address |
| REF | Second half of absolute core address |
| WDS | Number of transmission words |
| W1, W2, . . . . . | Transmitted information |
| LIC | Checksum |

The checksum is the binary sum of all 8-bit numbers of a data transmission with any remainder truncated. The hardware for the DEH DATALINK is operated asynchronously. A message can be transmitted at any time from the plant commander. The interrupt program 1124 is provided so that the plant commander computer can be serviced immediately.

FIG. 76a shows a DATALINK between two computers. A modem 2510 transmission system, available through the Bell Telephone Company, is shown for data transmission. The sequence of events interrupt program 1124 directs the computer 210 to execute one or more instructions in a sequence thereby interrupting any program running in the computer 210. When the interrupt program 1124 has finished, the computer 210 returns to complete the program which it was previously executing.

A DATALINK task shuttles any received data words into an input buffer in the memory 214 and thereby through the action of the central processor 212 generates the checksum which is compared with a received checksum. The data from the DEH system is transmitted and a checksum calculated at both the plant commander and the DEH computer 210. If a mistake is found an alarm interrupt is generated and a control word indicating an error is sent back and no further action is taken. The plant commander or requesting computer must then send the same message again for a second reply. If the interrupt program receives a proper message request, a DEH DATALINK task is energized again.

AUTOMATIC TURBINE STARTUP PROGRAMS—FUNCTIONAL DESCRIPTION

PROGRAM PO1

DETERMINATION OF THE ROTOR THERMAL CONDITIONS

This program runs periodically to calculate and update the temperature of the H.P. rotor at the first stage zone, based on the temperature of its environment. Heat Transfer coefficient, rotor temperatures, temperature differentials, and rotor strain are calculated. The results are invalid if the rotor temperature has not been calculated continuously for at least2 hours i.e. if the program was not running or the relevant sensor not in service. Then the ATS control mode cannot be entered, only STS Supervision is possible.

Program Sequence

If the analog signal to frequency (A/F) converter is out of service the rotor stress program is initialized with the actual first stage metal temperature.

If it did not run one cycle the variable values used in the program to start the calculations would be misleading.

If the unit is on turning gear (TG) the "HEAT SOAK COMPLETE" indicator is cleared to allow the calculation and timing of heat soak to be initiated.

The HP first stage metal and IP metal temperatures before opening the valves (bov) to be used in the heat soak calculation program are set equal to the present metal temperatures, this being an updating process that occurs only when the unit is on TG. Until the unit has been synchronized these temperatures are not changed since the heat soak calculation is based only on initial metal temperature values.

If the unit is not on TG, the variable N used to calculate the heat transfer coefficient is set equal to actual speed, otherwise it will be N=0.

The first stage metal temperature will determine if the turbine will go through a cold or hot start procedure. Rotor strain limits as well as rotor (surface-volume average) temperature are chosen based on the above temperature.

The heat transfer coefficient H will be computed as a function of speed reaching its higher value in the speed mode at rated speed. (See FIG. 1). Once the breaker is closed H will increase linearly as a function of time reaching its maximum value after five (5) minutes. The heat coefficient algorithms for speed and load modes are:

$$H_{speed} = 12.4(1000+N)^2 \times 10^{-6} N = RPM$$
$$H_{Load} = 262 + (12.3 \times \text{Time Counter}).$$

The rotor surface temperature is calculated as a function of the first stage steam temperature, the present heat transfer coefficient, and the rotor metal temperature's history. The magnitude of the rotor stress is determined by the rotor (surface-volume average) temperature which is stored in memory to be used by program PO4 to analyze the rotor conditions based on present and past history. If the computer has been running after initialization for two (2) hours or more the rotor temperature calculation will be considered valid. Rotor strain, which is a direct function of the rotor temperature, is then calculated, compared to the selected limit and printed out if it is found to exceed the limit.

Rotor surface temperature $= T_S$
Rotor Volume Average $= \overline{T}$
Rotor strain $= C.f(T_S, \overline{T})$ Principal steps accomplished in this program are:

1. Set:
   (a) 1st stage metal temperature b.o.v.
   (b) rotor strain limits
   (c) rotor (surface-volume average) temperature limits
2. Calculate:
   (a) heat transfer coefficient (H)
   (b) rotor (surface-volume average) temperature
   (c) rotor strain
3. Store and Update:
   (a) latest 15 values of rotor volume average every 1 min.
   (b) latest 15 values of rotor (surface-volume average) every 1 min.

PROGRAM PO2

Computation and supervision of anticipated steam chest wall, bolt flange temperature differentials and differential expansion. This program runs every 1 minute to calculate the anticipated steam chest wall temperature difference in both chests. The actual generator and governor end differential expansion are compared against limits to determine the best course of action.

Program Sequence

The "SKIP NO PART OF PO2" indicator is used to avoid erroneous calculations of the anticipated temperature differentials when this program runs for the first time. This is accomplished by setting this indicator when the programs are initialized. Likewise "P13" sets this indicator in order to avoid misleading actions and messages when at least one of the thermocouples used in this part of the program is out of service.

This program will calculate the 5 MINUTES ANTICIPATED STEAM CHEST WALL TEMPERATURE DIFFERENTIAL as a linear interpolation for a 5 minute period from the latest stored temperature difference and the one stored one minute before. The algorithms used is $T_A = T_j + 5\ (T_j - T_{j-i})$. The heating/cooling limit for the ANTIC. (IN-OUT) WALL TEMP. DIFF is ±150. A speed or load hold is generated by ANTIC. METAL COND REQUIRE HOLD indicator.

The GENERATOR END and GOVERNOR END differential expansion input is checked against the alarm and trip limits resulting in different actions taken by program PO7.

Generator End: If the input exceeds the ALARM limit the DIFF. EXP. SPD HOLD indicator is set. This results in a speed or load hold.

If the input exceeds the TRIP limit the "DIFF. EXP. TRIP" indicator is set and a tripping action is initiated.

Governor End: Two different actions are taken when the alarm limits are exceeded.

If the rotor is short the "DIFF. EXP. INCR SPEED RATE" indicator is set in order to increase the ACCELERATION which will result in an increase of the heat transfer coefficient. Therefore the rotor will heat faster counteracting the cause that generated the alarm.

If the rotor is long the "DIFF. EXP. SPD. HOLD" indicator. This results in a speed or load hold. If the TRIP limit is exceeded the "DIFF. EXP. TRIP" indicator is set and a tripping action is initiated.

Any of the conditions analyzed will set the "DIFF. EXP. OF NORMAL" indicator which will prevent the turbine from rolling off turing gear (Ref to PO3), if the turbine is on turning gear.

In the Figures, there are shown the GENERATOR END and GOVERNOR END differential expansion non-contacting sensors in relationship to the thrust bearing and turbine elements for the rotor long and rotor short relative position. A representation of the supervisory recorder scale and the pointer movement in relation to the sensors and shaft position are shown. FIG. 3 shows the alarm and trip limits in relation to the pointer movement in the supervisory recorder scale.

PO2

Principal steps accomplished in this program are:

1. Calculate the:
   a. 5 MIN. anticipated steam chest wall temperature differential
   b. 5 MIN. anticipated HP & IP (flange-bolt) temperature differential.
2. Compares against limits the:
   a. anticipated HP & IP (flange-bolt) temperature differential
   b. anticipated steam chest wall differential
   c. governor end present differential expansion
   d. generator end present differential expansion.

Action Taken

Generator End
- exceed alarm short—speed/load hold
- exceed alarm long—speed/load hold
- exceed trip—short or long—turbine trip request Governor End
- exceed alarm—short—accelerate
- exceed alarm—long—speed/load hold
- exceed trip—short or long—turbine trip request.

PROGRAM PO3

Supervision of Turning Gear Operation

All conditions that would hold the unit from rolling-off turning gear are checked. Messages will guide the operator on how to obtain the allowable mismatch between the impulse chamber steam and metal temperatures.

Program Sequence

This program runs to completion only if the unit is on turning gear. The minimum allowable throttle steam temperature at the existing pressure is checked against the actual throttle steam temperature (TST).

In the event of low TST the minimum allowed TST necessary to avoid steam condensation is printed-out.

If the TST is too high in respect to the rotor the TST will have to be decremented.

The two above mentioned conditions will prevent an automatic roll-off turning gear. The computer estimates what the first stage steam temperature would be when the valves open, as a function of the actual throttle steam temperature and pressure.

The expected temperature mismatch between the expected or anticipated first stage steam and metal temperature is checked. If the mismatch is out of specified limits a message will tell the operator what the first stage steam temperature should be to fall within limits and therefore permit the roll-off as soon as the inlet conditions are adjusted accordingly.

The following conditions checked and flagged in another program have to be within limits before a roll-off is allowed.

| FROM | CONDITION |
|---|---|
| PO2 | Present differential expansion (governor & generator end) |
| P05 | Rotor eccentricity |
| P06 | Present steam chest wall temperature differential |
| P06 | Presnet cover-base wall temperature differential |
| P08 | Bearing oil temperature and pressures |
| P08 | Lube oil out of cooler temperature |
| P09 | Generator and exciter cooling media |
| P10 | Gland steam and rotor metal temperatures |
| P10 | LP exhaust pressure |
| P10 | LP exhaust hood temperature |
| | Drain valve conditions |
| | EH fluid pressure |

The above listed conditions will be alarmed by setting a common indicator for P15.

PROGRAM PO4

Control of Rotor Stress At First Stage

Since the rotor surface thermal stress (or strain) is proportional to the surface-to-volume average temperature differential calculated in PO1, this is the parameter selected to determine the acceleration. By comparing the present value with previous values, the program finds the type of thermal transient the rotor is undergoing, and selects the path to be followed. An extrapolated value is also calculated and compared with the allowed value, according to this difference.

Program Sequence

If the turbine is off turning gear, latched, and the periodic programs have been running for 2 hours or more we proceed to:

1. Calculate the 15 minute anticipated rotor (surface-volume average) temperature.
2. To set permissive indicators for the PO7 periodic program that will hold, reduce or increase turbine speed.

If the turbine is in turning gear and latched but the periodic programs have not been running for 2 hours or more we proceed for:

1. Store and update the latest ten values of 1st stage steam temperature to calculate the temperature gradient.
2. Hold speed by means of PO7 if the 1st stage steam temperature rate of change is ≧300°/hr. and turbine speed is ≧600 RPM.

An increase in speed or load rate will be requested making use of the "ROTOR STRESS INCREASE RATE" indicator if, 1.1 The load is increasing and the rotor heating or, 1.2 The load decreasing and the rotor cooling, the anticipated (surface-volume average) temperature difference is less than 50% of specified limit, and the present difference is less than 90% of the same limit.

2.1 The load is increasing and the rotor cooling.

2.2 The load is decreasing and the rotor heating, and the present (surface-volume average) temperature is less than 90% of limit.

3.1 In speed mode the motor is cooling, the anticipated difference is less than 10% of limit, and the present difference is less than 90% of limit.

4.1 In speed mode the rotor is heating, the anticipated difference is less than 50% of limit and the present difference is less than 90% of limit.

A reduction in speed or load rate will be requested making use of the "ROTOR STRESS REDUCE RATE" indicator, if 1.1 The load is increasing and the rotor heating, or 1.2 The load is decreasing and the rotor cooling, or 1.3 In speed mode the rotor is heating and the anticipated difference larger than the limit and the actual difference less than 85% of limit, or The anticipated difference larger than 75% of limit.

Finally the remaining action, a speed or load hold will be requested making use of the "ROTOR STRESS HOLD" indicator which is set when 2.1 The load is increasing and the rotor heating 3.1 The load is decreasing and the rotor cooling and (a) the present temperature difference is larger than the limit or (b) the anticipated temperature difference is larger than the limit and the present temperature difference is large than 85% of limit.

PROGRAM PO5

Supervision Of Eccentricity and Vibration

This program analyzes present vibration inputs and takes action in accordance with the previously determined vibration trend.

Program Sequence

The program starts by clearing the vibration trip and vibration alarm indicators. If the turbine speed is below 600 rpm it checks for eccentricity. If the eccentricity is below the alarm limit, the high eccentricity indicator is cleared and the program is completed. Otherwise it prints "high eccentricity" and sets the high eccentricity indicator. If the turbine speed is larger than 600 rpm it proceeds to set alarm limits as a function of turbine speed. Below 2400 rpm the vibration alarm limit will be 8 mils. Above 3200 rpm it will be 5 mils. Between 2400 and 3200 rpm the vibration alarm will be a linear function of speed.

All vibration inputs to the computer are checked. This is done by as many loops as vibration inputs. Each loop represents one input as is referenced by an index number, according to the bearing number.

A trip is requested if a vibration input is equal to or higher than 10 mils. Tables are used to record the vibration values of each input. As more than one input may be in alarm at the same time, separate loops must be used. Also each input may be in a different stage of alarm requiring a speed hold or a change of speed to correct the vibration. Therefore, a priority system is necessary. Top priority is the decreasing mode, next is the hold condition and third the increasing mode of speed reference. Thus, a decrease is always checked before a hold or increase is called for by the conditions in the other vibration inputs. By applying the described method the following is accomplished for each bearing:

| Speed, N in RPM | Vibration, VIB in mils | Action |
|---|---|---|
| For all N | VIB ≧ 10 | Req. a Trip |
| 600 < N ≦ 2400 | VIB ≧ 8 | Alarm |
| 2400 < N ≦ 3700 | VIB > 8-000375 × (N-2400) | Alarm |
| 3200 < N | VIB > 5 | Alarm |

Vibration Trend

The program scans each vibration input in sequential order and determines if a vibration alarm condition exists. The alarm limit is decreased slightly to avoid an unstable alarm condition that would occur in the event of an input signal with ripple and/or noise. If a decrease or increase condition has not been set previously the program makes sure that the speed is not going to be held within the blade resonance range. If this is the case the program continues with the next sensor.

Otherwise, making use of counter "B" the program stores the present vibration level $(VIB)_o$ for use one minute later and continues the scanning process. Once a minute has elapsed the following is executed.

$$(VIB)_{+1}-(VIB)_o=VIB$$

1. If $\Delta VIB>0$ the expected vibration 5 minutes later is computed by $(VIB)_{+5}=(VIB)_o+((VIB)_{+1}-(VIB)_o)\times 5$
   1. If $(VIB)_{+5}\geqq$TRIP LIMIT speed is reduced by 200 rpm. If $(VIB)_{+5}<$TRIP LIMIT the $(VIB)_o$ is replaced by the present vibration level and the process described is repeated again.
   2. If $\Delta VIB\leqq 0$ the program keeps updating $(VIB)_o$, $(VIB)_{+1}$ and calculating $\Delta VIB$ until the alarm condition is cleared or until 15 minutes has elapsed. The latter would indicate that the vibration has been decreasing steadily for 15 minutes, as a result an increase in speed of 200 rpm will be requested.

The speed change is accomplished by making the SPEED REFERENCE equal to the VIBR. SPEED REF. in program PO7.

The VIB SPEED REF is decreased or increased by 200 RPM every time the conditions mentioned before are satisfied.

To make sure that the SPEED REFERENCE is only decreased or increased in steps of 200 RPM the VIBR. SPEED REF CHANGE NOT PERMITTED indicator is cleared only when the PRESENT TURBINE SPEED=SPEED REF.

PROGRAM PO6

Turbine Metal Temperature Supervision

The temperature difference across the steam chest wall has to be maintained within limits to avoid extreme stresses.

Temperature sensors in the base and cover of the HP or HP-IP turbine will monitor its temperature. A difference larger than 100° F. denotes presence of water and the unit should be tripped to avoid further damage.

Program Sequence

This program monitors and alarms on metal conditions of the steam chest walls, cylinder bolt-flange (in single case units), and cover-base cylinder differentials. When limits are reached speed or load holds are requested.

A trip is requested if the cover-base temperature difference indicates presence of water induction. In this program:

1. Limits are compared to:
   a. both steam chest (outer wall-inner wall) temperature difference.
   b. (flange-bolt) temperature.
   c. (cover-outer cylinder base metal) temperature.
2. Indicators are set to:
   a. hold speed if temperature differentials are above limits.
   b. request ATS rejection if the (flange-outer cylinder base metal) temperature is>100 and the load is 20% or the load is<20% and the drain valves are open.

PROGRAM PO7

Control of DEH Speed Reference

This is the speed controlling or action program. It sets DEH speed DEMAND which is used by the DEH speed control programs when in ATS control. Acceleration rates are also selected by checking permissive set by other programs.

Program Sequence

Trip conditions requested by other programs will reject the ATS program.

Vibration Trip (PO5)
Met. Temp. Trip (PO6)
Diff. Exp. Trip (PO2)
Brg. Metal Temp. Trip (PO8)

Any of the five (5) sensors listed below will also make this program reject ATS.

1. differential expansion sensor (P13)
2. first stage metal temperature sensor (P13)
3. first stage steam temperature (P13)
4. reheat steam temperature (P13)
5. vibration sensor failed high and an adjacent vibration sensor failed high or is in an alarm condition (P13).

If there is at least one bearing with a vibration level above the ALARM limit and the unit is not on the line and the turbine is not changing speed (turbine not acclerating decelerating) the program will make sure that the speed hold to be generated will not fall in the blade critical regions designated by "X" and "Y" in the flow chart.

If the turbine is dwelling at a blade resonance speed a new speed reference is generated which will decrease the speed to a lower level out of the resonant region. To avoid another reference change request due to the same cause the "VIBR. SPEED REF CHANGE NOT PERMITTED" is set, which will make the program go through a different path.

If in ATS mode the DEH demand will be changed to satisfy the new desired speed called by this program or by PO5.

As soon as the demand is within ±7 RPM of the reference is new speed change will be permitted (if a request exists) by clearing the "VIBR. SPEED REF. CHANGE NOT PERMITTED" indicator. Lights are turned on and off accordingly.

With reference to connector (a) in the PO7 flow chart, once the vibration alarm is cleared indicators or flags set by other programs are scanned and new flags (to determine the type of message to be printed out) will be set. Following is a list of indicators scanned.

| FROM PROGRAM | INDICATOR |
|---|---|
| P02 | ANT. METAL COND. REQ. HOLD |
| P02 | DIFF. EXP. SPEED HOLD |
| P04 | ROTOR STRESS HOLD |
| P04 | 1st. STAGE TEMP. SPEED HOLD |
| P05 | HIGH ECCENTRICITY |
| P06 | METAL COND. REQ. HOLD |
| P08 | BRG. METAL TEMP. HIGH |
| P09 | HYDROGEN TEMP. LIMITING |
| P10 | VACUUM OUT OF LIMIT |
| P11 | ANTICIPATED DIFF. EXP. SPEED HOLD |

If the first stage steam temperature sensor fails messages requesting a hold because of rotor stresses are inhibited.

If the turbine is not dwelling at a blade resonance speed, a speed hold is requested (i.e. "SPEED HOLD" ind.) and continues per 3.1 of this program description.

With reference to connector (C) in the PO7 flow chart, if a speed hold other than vibration was requested, with the turbine in speed mode (i.e. breaker open) and not dwelling at blade resonance, speed messages indicating the type of speed hold are output.

The speed hold is accomplished by making the DEH DEMAND equal to the instantaneous REFERENCE.

If it is dwelling in or going through a blade resonance frequency zone the turbine will continue to accelerate toward the next speed reference plateau set by the Acceleration Sequence (P15) program before a hold.

If a speed hold was not requested and the first stage steam temperature sensor did not fail, the rotor stress program PO4 will decrease or increase the present acceleration rate one step down or up at the maximum rate of one step every 3 minutes according to the standard acceleration index table.

Present and anticipated differential expansion increase the acceleration rate at a maximum rate of one step every 5 minutes.

Acceleration rate changes will be carried on within the standard or allowable limit which are represented by index 1 through 9 (refer to PO7-3).

If a rate request change would allow the present rate to exceed the allowable limits the request and corresponding messages will not be acknowledged.

Once a rate is selected, the DEH DEMAND will be made equal to the target speed reference set by the Acceleration Sequencing program P15. This is accomplished by means of a jump to connector (f) in PO7-2.

Going back to connector (c) we will notice that if the turbine is in a hold speed condition and in load control relevant messages will be printed out.

PROGRAM PO8

Supervision of Bearing Temperature

This program monitors the lube oil in and out of cooler temperature, the bearing metal temperature, and the bearing oil header pressure.

Program Sequence

Two different low and high oil out of cooler limits are used. If the turbine is running (speed or load mode) a higher pair of limits are used.

If the turbine is accelerating the oil will increase in temperature therefore if the oil temperature is below the low limit but the turbine is accelerating no action is required from the operator. All journal and thrust bearing metal temperatures are checked against two limits.

If any one of the bearing metal temperatures exceeds 210° F. an indicator is used to request a speed or load hold by means of program PO7.

If any of these temperatures exceeds 225° F., a trip request is generated. The bearing oil pressure is monitored continuously, nevertheless the only action taken is a hold if the unit is in the roll-off turning gear routine. The oil returning to the lube oil cooler should be kept below 170° F., otherwise the program will put out a message indicating this alarm condition.

Summarizing in a table like format the following are the different steps and actions that this program takes care of:

1. If compares against limits:
   a. the oil temperature out of cooler in turning gear
   b. the oil temperature out of cooler out of turning gear
   c. each metal bearing temperature (trip and alarm)
   d. the bearing oil pressure
   e. the oil temperature to cooler
2. It sets indicators that will:
   a. hold roll-off T.G. if, the lube oil temperature is too cold, or the lube oil pressure is too low
   b. hold speed or load if any bearing temperature exceeds the alarm limit
   c. request a turbine trip if any bearing temperature exceeds the trip limit.

PROGRAM PO9

Supervision of Generator

The generator cooling and sealing system and exciter cooling system are monitored by this program. Calculations are run continuously to determine if the generator stator coil temperature rise is within calculated limits.

Program Sequence

The generator cooling gas or water is monitored and a roll-off turning gear hold or a prior to synchronizing hold is generated if the cooling fluid exceeds a fixed high limit. A similar action is taken with the exciter cooling air.

The allowable coolant expected temperature rise is continuously calculated as a function of the coolant pressure (if it is a gas), the instantaneous or present stator current ($I_{SA}$) and the nominal stator current ($I_S$). Its limit is a sole function of the gas pressure (if gas cooled). Messages will tell the operator if the temperature rise trend is larger than expected. This will give him enough lead time to take a corrective action. Hydrogen pressure and purity are closely monitored, as well as seal oil pressures (air and hydrogen side).

The latter conditions will prevent the synchronization program to run. This means that the unit will go on a speed hold until these conditions are cleared.

Principal steps accomplished in this program are:

1. Calculate the:
   a. expected generator stator coil coolant discharge temperature rise.
   b. generator stator coil coolant temperature rise limit.
   c. present generator stator coil coolant discharge temperature rise.
   d. present exciter air temperature rise.
2. Compares against limits the:
   a. coolant inlet temperature.
   b. present generator stator coil coolant discharge temperature rise.
   c. exciter coolant air.
   d. exciter previously calculated temperature rise.
   e. hydrogen and air side seal oil pressure and temperature.
   f. hydrogen pressure.
   g. seal pressure difference
3. It checks the running status of the
   a. air side seal oil back-up pump.
   b. hydrogen side seal oil pump.

PROGRAM P10

Supervision of Gland Seal, Turbine Exhaust And Condenser Vacuum Conditions

This program monitors temperatures and pressures in the LP exhaust and temperature differences in the seal LP gland system. Exhaust spray operation is monitored and HP sealing steam temperature are also monitored.

Program Description

The following conditions, which are monitored by this program will not allow the P15 program to carry on the roll-off turning gear operation if the:

1. HP gland seal steam is too cold
2. LP gland seal steam temperature is too high (3500° F.)
3. difference between the metal and the sealing steam temperatures in the HP sealing area is too great (±200° F. max.)
4. LP exhaust steam temperature is larger than the allowable limit for the sprays.

If the LP exhaust pressure is larger than 5 inches of Hg Absolute this program will request a speed or load hold carry on by P07 as usual.

Turbine operation experience recommends that the LP exhaust sprays be open between 600 RPM and 10 percent load. This is properly monitored by this program. Commands to take corrective actions are given to the operator by printed messages.

PROGRAM P11

Supervision Of Drain Valves And Computation Of Anticipated Differential Expansion This program can be considered an extension of P02. The anticipated differential expansion in one or both ends is calculated and appropriate actions determined. Drain valves position are monitored and commands to open and close them (generated in accordance with speed and loading conditions as well as recommendation emanated of the recent water prevention operating procedures) are given.

Program Sequence

The GOVERNOR END AND GENERATOR END anticipated (desired) differential expansion is checked against the alarm and trip limits resulting in different actions taken by PO7. The present temperature is calculated by a desired anticipation algorithm $T_A = T_{-5} + 5\ (T_{-5} - T_{-6})$.

Governor End: Two different actions are taken when the alarm limits are exceeded.

If the rotor tends to become shorter the "ANTIC. DIFF. EXP. RATE" indicator is set in order to increase the acceleration which will result in an increase of the heat transfer coefficient. Therefore the rotor will heat faster counteracting the trend toward a shorter rotor. If the rotor tends to become longer the "ANTIC. DIFF. EXP. SPEED HOLD" indicator is set resulting in a speed or load hold made effective by P07.

Generator End: A speed or load hold is accomplished through program P07 when the "ANTIC. DIFF. EXP. SPEED HOLD" indicator is set as a result of an anticipation to a rotor long alarm condition.

If on speed control, the drain valves are opened if not already open.

If on load control at less than 20% load, the drain valves are opened. If load is greater than 20%, the drain valves are closed.

EXAMPLE P12

Supervision Of LP Exhaust Temperatures

This program provides additional checks and calculations for a turbine with Building Block 73 to prevent overheating of the low pressure blades.

The temperature in the last row of blades is a direct function of the exhaust or condenser pressure. Therefore the LP exhaust pressure is used as the sensible index to determine low pressure blade conditions.

Program Sequence

To determine if the low pressure end is exceeding preestablished limits a straight linear approximation of Operating Curve #CT-22596B, attached, is being used.

The intersection of these two (2) straight lines has been selected to be at 1.92 in. HgAbs., and its respective equations are:

1. For full speed—no load
   If cond. press. abs. < 1.92 − TEMP 1 = 1000 − (80 × cond. press. abs.)
   If cond. press. abs. > 1.92 − TEMP 1 = 1150 − (160 × cond. press. abs.)
2. For 5% of MAX. GUAR. LOAD
   If cond. press. abs. < 1.92 − TEMP 2 = 1023 − (33.3 × cond. press. abs.)
   If cond. press. abs. > 1.92 − TEMP 2 = 1150 − (100 × cond.
   If cond. press. abs. > 1.92 − TEMP 2 = 1150 − (100 × cond. press. abs.)

If the reheat temperature does not fall below the curve for FULL SPEED—NO LOAD (see curve #CT22596B) or in other words if reheat temperature is larger than TEMP 1 an indicator named "VACUUM" is set to be used in the acceleration program P15. Its function is to hold turbine speed before the speed demand is moved up to the next higher level.

SPEED MODE

If the turbine is not on the line but close to rated speed two actions would be taken:

1. If there is not any bearing vibrating above the alarm limit the program will wait 4 minutes before advising the operator to reduce speed (if in OPER. AUTO) or decrease speed to the next lower step if it was not decreased already within the last 15 minutes. If speed was decreased already the program will wait 15 minutes total before advising the operator to go to OPER AUTO and place the turbine in turning gear.
2. If there is a bearing vibration above the alarm limit the operator will be advised to reduce speed (if in OPER AUTO).

In ATS the turbine speed will be brought down to the next lower step by program P15 making use of the "SPEED REF" indicator. In any case after 15 minutes total the operator will be advised to go to OPER AUTO and turning gear.

LOAD MODE

No action will be taken if the load applied is larger than 5%. If it is less than 5% and the reheat temperature does not fall below the curve for 5% of MAX. GUAR. LOAD (curve #CT-22596B) or in other words if reheat temperature is larger than TEMP. 2 the operator will be advised to increase load to avoid overheating the LP blades.

PROGRAM P13

Sensor Failure Action

This program monitors the converted ATS analog input values for detection of sensor failures, and initiates special actions (i.e. rejects ATS) for correct system response if a sensor failure is detected.

Program Sequence

This program can be distinctly divided into two parts. The main purpose of the first part is scanning all converted analog inputs for detection of sensor failures.

If an input is not reliable the program determines if the action has already been completed for this failure.

If action is complete it determines if action was completed while not in ATS mode. If this is true and the ATS mode was just selected (in the last 5 sec.) the sensor failure conditions must be reevaluated for possible further action.

Otherwise, no further action is taken. If action was not completed, then the failure has just occurred or it occurred previously but has remained incompleted because of an outstanding sensor failure override that has been requested (to allow a substitution) has not been satisfied. This condition will light the "OVERRIDE SENSOR HOLD" pushbutton on the operator's panel.

If the failure has just occurred (within the last 5 seconds since previous monitoring) a sensor failure message is printed (P13M11), a contact closure is sent to a plant alarm and the required sensor failure action is initiated as well as any required sensor value substitutions if a sensor failure override is not required for the particular sensor in scan.

If the failure is not new and subsequent action is pending a sensor failure override by the operator, a substitution is made if the operator pushed the "OVERRIDE SENSOR HOLD" pushbutton. Otherwise, no further action is taken until the pushbutton is pressed.

The second part of P13 monitors key sensors for failures which have more serious consequence to the ATS programs than actions initiated in the first part.

This action results in,

Reverting to OPERATOR AUTO from ATS mode if 1. a differential expansion sensor failed.
2. a vibration sensor failed high and an adjacent vibration sensor failed high or is in an alarm condition.
3. the first stage metal temperature sensor failed.
4. the reheat steam temperature sensor failed.
5. the first stage steam temperature sensor failed.

Substitutions

Depending on the sensor type a direct or reference substitution will be applied. In the substitution table, each substitutable sensor is listed with its predefined substitution sensors with the latter listed in accordance with substitution priorities.

Direct Substitution

This occurs when either the last previous valid value of the failed sensor is used or some preassigned fixed value is inserted for the failed sensor.

The oil out of cooler temperature and the bearing oil pressure are in this class.

Reference Substitutions

This is based on a table of other sensors whose value may be used for the analog input of the failed sensor. Thus, if the left steam-chest inner-temperature sensor fails, the right steam-chest inner-temperature is used in its place, providing that this sensor has not also failed. However, if it too has failed, the next sensor specified in the list is used. If no valid substitute is listed, then no replacement will be made for the original sensor which failed.

Priorities

There is a priority system applied to the order in which failed sensors are monitored for substitution action. Further, certain sensors i.e. vibration, differential expansion, first stage temperature and reheat temperature are classed as nonsubstitutable and processed separately for sensor failure control action.

PROGRAM P14

Calculation And Timing Of Heat Soak Time

This program will compute the necessary soak time based on the more critical temperature in the first stage. It will keep track of the time and allow the start-up sequence control program P15 to continue as soon as the computed time has expired.

Considerations

The soaking time necessary to bring the rotor volume average temperature above 250° F. is accomplished between 2200 and 2400 rpm. This speed is chosen as a compromise between soaking temperature and rotor velocity which generates undesirable centrifugal stresses.

The IP rotor is considered the most critical rotor. The energy absorbed by the rotor as a function of rotor temperature is represented by ENERGY versus TEMPERATURE curve (FIG. 2) obtained by the Charpy test method.

The transition point (A) which corresponds approximately to 50% of the ductile fracture falls in the 250° F. zone for the IP rotor material. For the LP this transition point is below freezing.

The computation of the heat soak time is based conservatively on the lowest of four (4) temperatures listed below for the combined and separate HP-IP case.

COMBINED HP-IP

Rotor volume average temperature b.o.v. (1)
Rotor volume average temperature present
First stage metal temperature b.o.v.
First stage metal temperature present

SEPARATE HP-IP

IP metal temperature b.o.v.
IP metal temperature present
First stage metal temperature b.o.v.
First stage metal temperature present The b.o.v. temperatures are updated only when the unit is on turning gear. Once the unit rolls-off turning gear the updating process stops (See P01).

Three indicators or flags are used in order to select the appropriate path in the program. "HEAT SOAK COMPLETE" indicator which is cleared in PO1 only when the unit is on turning gear, determines if P14 will run. It is set when all thermal operating conditions have been satisfied. "SOAK TIME PERMITTED" indicator. It is used as a means of determining the validity of message P14M1 (HEAT SOAK DELAY, SPD LO). This message is printed only when the soak time speed is lower than recommended and the reheat steam temperature is larger than 500° F. The heat soak time calculation is based on that temperature.

(1) b.o.v. stands for BEFORE OPENING THE VALVES.

"RETIME" indicator. The selection of the heat soak temperature and the heat soak temperature calculation is done only when the unit is on turning gear and the first time this program runs to completion. This indicator will bypass the calculation portion of the program every time but the first time.

Program Sequence

When the soak time speed has been reached the lowest metal temperature is selected and the heat soak computed unless it is a hot start (lowest temperature 250° F.) in which case heat soak is considered unnecessary.

The countdown of the heat soak time will start as soon as the reheat temperature goes above 500° F.

If for any reason the reheat temperature goes below 500° F. the countdown will stop until the reheat temperature is reestablished. Once the soak time has timed out a final check on the rotor volume average temperature is done (it should be 250° F.) before declaring that the heat soak cycle has been completed and allowing the turbine to continue acceleration.

PROGRAM P15

Acceleration Sequence

This program runs continuously, however, its actions are only accepted by the DEH if on ATS Control. In a normal start-up this program brings the turbine from turning to synchronous speed and turns the DEH Controller REFERENCE to the AUTOSYNCHRONIZER.

If the starting sequence is interrupted by a hold requested by any of the monitoring programs, it will resume its logical sequence where it was interrupted.

P15-1

The program will be in ATS Control when a flag set in the DEH Logic Program is set. This flag is set when not in loading mode, not in OPER. AUTO, and when the "SENSOR FAILURE REJECT ATS" indicator, (which is set by the SENSOR FAILURE ACTION program) is clear.

If in speed control and not in TG (turning gear) the VALVE POSITION LIMIT will be run up if it is set at less than 95%.

None of the conditions questioned in the vertical line between the questions IS TURB. ON T.G. will be affirmatively answered.

For study purposes we will assume that the unit is in TG and the ATS control P.B. has been pushed. Refer to P15-4.

If the unit is latched and in ATS control P03 flags are cleared. This is done to make sure that the latest PRE-ROLL conditions are being checked.

The "E" flag, set when the program has been overriden or the pre-roll completed successfully, is now not set, therefore, when PO3 has completed successfully the pre-roll check out, an ACC RATE of 200 RPM/MIN. and a TARGET speed of approximately 605 RPM is selected.

The turbine now will accelerate at the selected rate until the selected target speed is reached.

By now the "E" flag has been set. The program will jump to repeatedly select the target speed until the turning gear disengages. If no HOLD has been requested by the monitoring programs the turbine will continue to accelerate until a speed larger than 580 RPM has been reached. At this point a new target speed between 2200 and 2400 RPM is selected.

The acceleration rate by now could have been increased by P07 which will every 3 minutes recognize an increase or decrease request by P04 which looks at the rotor stress computation and determines the course of action.

P15-3

Once the turbine has reached HEAT SOAK SPEED (2200 to 2400 RMP) the program will come down the same path until P14 sets the "HEAT SOAK COMPLETION" indicator. Then a new target speed of the order of 3300 RPM is selected and the turbine accelerates now at the present acceleration rate. This rate is being updated every 3 minutes as a result of the rotor stress calculation.

Again the turbine will accelerate to reach the new target speed. In the next step the transfer from throttle valves to governor valves occurs. Prerequisites are that all vibration levels to below the alarm limit and that the cooler steam chest inner temperature be larger than the throttle temperature at existing pressure. This is to avoid water condensation on the chest walls once the transfer is accomplished. We must remember that when in governor valve control the pressure in the steam chest is equal to the throttle pressure. "D" flag is set above 3260 RMP when:

1. there is not any vibration alarm
2. there has been a vibration alarm override.

Once "D" flag is set and the correct throttle temperature is achieved, the transfer is initiated.

If the throttle temperature is too cold the recommended throttle temperature is recalculated and printed out every 10 minutes.

Also, every 10 minutes a message indicating the cause of the transfer delay is output. Once the transfer has been initiated the system will have 2 minutes to complete it. If it has not been completed in 2 minutes this will be indicative of a malfunction and a message requesting the operator to take control will be printed out with the latter frequency.

The time counter is shown as counter "J" in this program.

P15-1

The unit should now be in GOV. CONTROL, therefore, the transfer is completed and a message indicating this condition is printed out.

The next time the program runs, a new target speed reference (equals synchronous speed) will be selected and the acceleration continued until the turbine speed is within synchronization range (SYNCHRONOUS SPEED ±50 RPM). At this point the pre-synch check out starts.

P15-2

Indicator A, B and C are used to run this part of the program in a certain sequence.

It is desirable that the (surface-volume average) temperature differential in the rotor be less than 75% of the allowable limit before the unit is synchronized.

If the latter is not so the program will proceed only if the rotor average temperature is larger than the first stage steam temperature. If this second condition is not met the operator will have to override the program in order to complete the automatic start-up.

Otherwise the OPERATION AUTO mode will have to be selected to make use of the remaining synchronizing monitor sequence. The program continues checking conditions that should have been accomplished by the operator beforehand. These are:

The exciter field breaker should be unlocked.

The generator main breaker should be unlocked.

The voltage regulator switch is in the "OFF" position.

Vibration and generator system conditions are checked before the program determines if the base adjuster and voltage adjuster have been prepositioned to the rated voltage, no load position. These will be prepositioned by motor operators which are actuated by a contact closure when the exciter field breaker is opened.

The exciter field breaker is closed by a contact closure output from the DEH controller. This contact reopens after 10 seconds. Successively the program checks if the:

1. exciter field breaker has closed.
2. base adjuster is at rated no load setting.
3. voltage adjuster is at rated no load setting.
4. voltage regulator switch is in the "ON" position.
5. voltage regulator is "ON".
6. auto-synchronizer is in AUTOMATIC. This should have been set by the operator beforehand.

Messages indicating the discrepancies with the programmed logic are printed out. Finally the program will instruct the DEH controller to go in AUTO SYNC. mode allowing the automatic synchronizer to change the reference signal in the DEH.

A generator excitation system schematic is shown in FIG. 2.

Once the breaker closes a message dependent on the present rotor stress is printed out advising the operator on the most desirable loading rate.

ATS Control At Any Speed Level

This program will catch the unit on the fly and resume the start-up sequence setting the reference at the next higher reference step (600, 2200, 3300 or 3600 RPM).

SUMMARY

Improved turbine and electric power plant operation is realized through the disclosed turbine startup, synchronizing, and load control systems and methods. Improved turbine and plant operation and management also results from the disclosed turbine monitoring and operator interface systems and methods. The improvements stem from advances in functional performances, operating efficiency, operating economy, manufacturing design and operating flexibility and operating convenience.

The present system supplements, expands and improves over the prior art. In doing so, the present system includes specialized programs for suppressing noise in the reference, demand and sensed parameter signals of the turbine-generator system; the programs are broken down into a series of master task programs and other programs for better utilization of the digital computer; a special program which monitors all of the programs and detects computing, addressing and transmitting errors therein increases the reliability, safety and flexibility of the system. Panel monitoring, information transmission and warning systems greatly increase the usefulness, ease-of-operation and inherent reliability of the present system. A breaker open interrupt program indicating the loss of load connected to the generator prevents any overspeed condition from becoming serious. A stop and initialization program automatically readies the digital computer for immediate service after any computer or turbine stop or loss of power thereto, either instantaneous or long term. A logic program in the present system provides the capability for maintenance testing of logic functions; monitoring analog and digital speed failure; increasing turbine supervision capabilities, expanding manual control capabilities of the computer allowing an operator to work in conjunction with the automatic operation of the turbine generator system with the digital computer. The logic program also including hold and suspend systems; governor and throttle valves control interlock systems; turbine latching logic programs; breaker logic programs; throttle pressure control logic programs; megawatt feedback logic, impulse pressure feedback logic; speed feedback logic; automatic synchronizer logic; automatic dispatch system logic; automatic turbine startup logic and remote transfer logic.

The control program of the present system includes the capability of time updating any function in the computer; limiting the position of predetermined valves in the turbine system; testing any valve in the system, checking for contingency conditions such as inoperativeness of any program or hardware; being able to select various speed control functions and various hardware therein for high reliability; selecting a series of operating modes in both load and speed modes of operation, providing speed and load reference functions with flexibility to change these during operation, switching between the speed control function and the load control functions during the automatic operation of the DEH system providing governor valve control functions and peripheral functions, such as, lags and nonlinear characterization of characteristics in the turbine-generator systems.

The present system also has an elaborate programming system for better communications between an operator and the digital computer through use of special panel task program. The panel programs include a button-decoding program, a control switching system, a display system for displaying a vast number of system parameters of the turbine generator system, a system for changing during operation most parameters and constants in the digital computer with great ease and rapidity, a capability to select a great number of operating modes, a system for checking the status of predetermined valves in the system and display devices therefor, a testing system for predetermined valves in the system, a limiting provision for limiting the position of predetermined valves in the system. In addition the panel programs provide for the control of automatic turbine startup programs; the control of the digital computing system through the use of a series of manual buttons, switches, toggles, etc; the program capability of monitoring keyboard activity for failsafe and improper operation thereby preventing operator mistakes from resulting in improper signals and signaling means for warning an operator of any improper commands or mistakes in his operation of the keyboard, panels etc.

All information in the drawings and specification including appendices of Ser. No. 408,692, entitled "System and Method For Starting, Synchronizing and Operating A Steam Turbine With Digital Computer Control" filed by Theodore C. Giras and Robert Uram on Apr. 26, 1972 and assigned to the present assignee is incorporated in its entirety by reference.

We claim:

1. An electric power generating system having a steam turbine, a steam generator, and an electric generator rotated by said turbine and adapted to be connected to an electric load, said system comprising:

a. means for digitally computing and processing, having a central processing unit and a memory interconnected with said central processing unit;

b. means for converting input signals to digital data, said input converting means connected to said digital computing means;

c. means for converting digital data to output signals, said digital to output converting means connected to said digital computing means;

d-1. means for sensing the value of predetermined turbine operating parameters and for generating input signals representative of said parameters, said sensing means being connected to said input converting means;

d-2. means for supplying load demand input signals to said input converting means;

e. means for controlling the steam flow to said turbine;

f. means for connecting said output signal converting means to said steam flow control means;

g. said digital computer means comprising speed control means for automatic startup and synchronization of said generating system, and characterized in that it is programmed to perfrom a plurality of respective functions in accordance with a predetermined priority, said functions including (i) computing turbine speed program signals which are a function of at least one of said input signals, and (ii) computing turbine speed control signals as a function of said speed program signal, and (iii) computing controller signals as a function of said load demand signals, for operation of said controlling means under load mode conditions, and (iv) continuously computing, throughout a predetermined startup speed range and during load operation, control signals for operation of said controlling means; and h. said computed speed control signals and controller signals being converted to output signals by said output converting means for controlling said steam flow control means as a function of said sensed parameters so as to control steam flow as an intermediate variable, and to control turbine speed during startup as an end operating variable and turbine load during load operation as an end operating variable, thereby providing continuous control through startup and load operation.

2. The system as described in claim 1, wherein said digital computer means is further characterized in that said speed program signals comprise speed sequencing signals for automatically sequencing turbine speed during startup.

3. The system as described in claim 2, wherein said digital computer means is further characterized in that said speed program signals include signals for holding turbine speed at a plurality of predetermined speed levels.

4. The system as described in claim 3, wherein said digital computer means is further characterized in that said plurality of programmed functions includes monitoring predetermined turbine condition signals for each respective speed level when speed is held at one of said plurality of speed levels.

5. The system as described in claim 4, wherein one of said speed levels is the heat soak speed level.

6. The system as described in claim 4, wherein one of said speed levels is the speed for transfer from throttle valve to governor valve mode of steam control.

7. The system as described in claim 1, wherein said digital computer means is further characterized in that it is programmed so that said computed speed control signals are derived from said computed speed program signals during turbine startup so as to automatically bring the turbine from turning speed to synchronous speed.

8. The system as described in claim 1, wherein said digital computer means is further characterized in that said speed program signals comprise speed demand and rate of change of speed signals.

9. An electric power generating system comprising:

a. a steam turbine system;

b. a steam generator for providing steam to said steam turbine system;

c. an electric generator rotated by said turbine system, and adapted to be connected to an electric load;

d. means for digitally computing and processing, having a central processor unit and a memory interconnected with said central processing unit;

e. means for converting input signals to digital data, said input converting means connected to said digital computing means;

f. means for converting digital data to output signals, said digital to output converting means connected to said digital computing means;

g. means for sensing the value of predetermined turbine operating parameters and for generating input signals representative of said parameters, said sensing means being connected to said input converting means;

h. means for controlling the steam flow to said turbine;

i. means for connecting said output signal converting means to said steam flow control means;

j. said digital computer means comprising speed control means for automatic startup and synchronization of said generating system and characterized in that it is programmed to perform a plurality of respective functions in accordance with a predetermined priority, said functions including (i) computing turbine speed program signals which are a function of at least one of said input signals, said speed program signals comprising speed sequencing signals for automatically sequencing turbine speed during startup, and including signals for holding turbine speed at a plurality of predetermined speed levels, and (ii) computing turbine speed control signals as a function of said speed program signals; and k. said computed speed control signals being converted to output signals by said output converting means for controlling said steam flow control means as a function of said sensed parameters so as to control steam flow as an intermediate variable, and to control turbine speed during startup as an end operating variable.

10. The system as described in claim 9, wherein said digital computer means is further characterized in that said plurality of programmed functions includes monitoring predetermined turbine condition signals for each respective speed level when speed is held at one of said plurality of speed levels.

11. The system as described in claim 10, wherein one of said speed levels is the heat soak speed level.

12. The system as described in claim 10, wherein one of said speed levels is the speed for transfer from throttle valve to governor valve mode of steam control.

13. The system as described in claim 9, wherein said digital computer means is further characterized in that it is programmed so that said computed speed control signals are derived from said computed speed program signals during turbine startup so as to automatically bring the turbine from turning speed to synchronous speed.

14. The system as described in claim 9, wherein said digital computer means is further characterized in that said speed program signals comprise speed demand and rate of change of speed signals.

15. An electric power generating system comprising:

a. a steam turbine system;

b. a steam generator for providing steam to said steam turbine system;

c. an electric generator rotated by said turbine system, and adapted to be connected to an electric load;

d. means for digitally computing and processing, having a central processor unit and a memory interconnected with said central processing unit;

e. means for converting input signals to digital data, said input converting means connected to said digital computing means;

f. means for converting digital data to output signals, said digital to output converting means connected to said digital computing means;

g-1. means for sensing the value of predetermined turbine operating parameters and for generating input signals representative of said parameters, said sensing means being connected to said input converting means;

g-2. means for supplying load demand input signals to said input converting means;

h. means for controlling the steam flow to said turbine;

i. means for connecting said output signal converting means to said steam flow control means;

j. said digital computer means further having speed control means for automatic startup and synchronization of said generating system, said speed control means including (i) means for carrying out a plurality of respective computing functions in accordance with a programmed priority;

(ii) means for computing turbine speed program signals which are a function of at least one of said input signals, (iii) means for computing turbine speed control signals as a function of said speed program signals;

(iv) means for computing controller signals as a function of said load demand signals, for operation of said controlling means when said steam turbine system is providing load; and k. said computed speed control signals being converted to output signals by said output converting means for controlling said steam flow control means as a function of said sensed parameters so as to control steam flow as an intermediate variable, and to control turbine speed during startup as an end operating variable.

16. The system as described in claim 15, wherein said digital computer means is further characterized in that said speed program signals comprise speed sequencing signals for automatically sequencing turbine speed during startup.

17. The system as described in claim 16, wherein said digital computer means is further characterized in that said speed program signals include signals for holding turbine speed at a plurality of predetermined speed levels.

18. The system as described in claim 17, wherein said digital computer means is further characterized in that said plurality of functions includes monitoring predetermined turbine condition signals for each respective speed level when speed is held at one of said plurality of speed levels.

19. The system as described in claim 18, wherein one of said speed levels is the heat soak speed level.

20. The system as described in claim 18, wherein one of said speed levels is the speed for transfer from throttle valve to governor valve mode of steam control.

21. The system as described in claim 15, wherein said digital computer means is further characterized in that it is programmed so that said computed speed control signals are derived from said computed speed program signals during turbine startup so as to automatically bring the turbine from turning speed to synchronous speed.

22. The system as described in claim 15, wherein said digital computer means is further characterized in that said speed program signals comprise speed demand and rate of change of speed signals.

23. In an electric power generating system having a steam turbine with means for controlling steam flow therethrough, a steam generator, and an electric generator rotated by said turbine for delivering load to a power system, a method of startup and synchronization of said power generating system comprising:

a. sensing the values of predetermined turbine operating parameters, and generating input signals representative of said parameters;

b. converting said input signals to digital data and inputting said digital data to a digital computer having a central processing unit and a memory interconnected with said central processing unit;

c. computing in said digital computer turbine speed program signals which are a function of at least one of said input signals;

d. computing in said digital computer turbine speed control signals as a function of at least one of said input signals and of said speed program signals, said speed control computing step including computing speed sequencing signals for automatically sequencing turbine speed during startup, and computing signals for holding turbine speed at a plurality of predetermined speed levels;

e. performing in said digital computer a plurality of respective computing and processing functions in accordance with a predetermined priority, said functions including computing load control signals for controlling turbine load, said speed program computing, and said speed control computing;

f. converting said control signals to output signals adapted to operate said turbine steam flow control means; and g. controlling the operation of said turbine by using said control signals to operate said turbine steam flow control means during turbine startup, including holding turbine speed at said predetermined speed levels.

24. The method as described in claim 23, comprising deriving signals representing turbine conditions and inputting said condition signals to said digital computer, and wherein the step of computing a plurality of functions includes monitoring predetermined ones of said turbine condition signals at each respective speed level when speed is held at one of said plurality of speed levels.

25. The method as described in claim 24, wherein one of said speed levels is the heat soak speed level.

26. The method as described in claim 24, wherein one of said speed levels is the speed for transfer from throttle valve to governor valve mode of steam control.

27. The method as described in claim 23, comprising automatically bringing said turbine from turning speed to synchronous speed under control of said computed speed control signals.

28. The method as described in claim 23, wherein the step of computing speed program signals comprises computing speed demand and rate of change of speed signals.

29. In an electric power generating system having a steam turbine with means for controlling steam flow therethrough, a steam generator, and an electric generator rotated by said turbine for delivering load to a power system, a method of operating said power generating system comprising:

a. sensing the magnitude of predetermined turbine operating parameters, and generating input signals representative of said parameters;

b. converting said input signals to digital data and inputting said digital data to a digital computer having a central processing unit and a memory interconnected with said central processing unit;

c. sensing predetermined turbine conditions and generating condition signals representative of said conditions, and connecting said condition signals to said digital computer;

d. monitoring, with said digital computer, said condition signals and producing alarm signals for energizing alarm means when predetermined alarm conditions are monitored;

e. computing, in said digital computer, turbine speed program signals which are a function of at least one of said input signals;

f. generating in said digital computer turbine startup and synchronization speed control signals as a function of said speed program signals;

g. synchronizing in said digital computer the performing of said monitoring, said speed program computing, and said speed control computing;

h. converting said control signals to output signals adapted to operate said turbine steam flow control means; and i. controlling the operation of said turbine by using said control signals to operate said turbine steam flow control means during startup.

30. The method as described in claim 29, wherein the step of computing speed program signals comprises computing speed sequencing signals for automatically sequencing turbine speed during startup.

31. The method as described in claim 30, wherein the step of computing said speed program signals includes computing signals for holding turbine speed at a plurality of predetermined speed levels, and the step of controlling said turbine operation with said control signals comprises holding turbine speed at said predetermined speed levels.

32. The method as described in claim 31, comprising deriving signals representing turbine conditions and inputting said condition signals to said digital computer, and wherein the step of computing a plurality of functions includes monitoring predetermined ones of said turbine condition signals at each respective speed level when speed is held at one of said plurality of speed levels.

33. The method as described in claim 32, wherein one of said speed levels is the heat soak speed level.

34. The method as described in claim 32, wherein one of said speed levels is the speed for transfer from throttle valve to governor valve mode of steam control.

35. The method as described in claim 29, comprising automatically bringing said turbine from turning speed to synchronous speed under control of said computed speed control signals.

36. The method as described in claim 29, wherein the step of computing speed program signals comprises computing speed demand and rate of change of speed signals.

37. In an electric power generating system having a steam turbine, a steam generator, and an electric generator rotated by said turbine to supply an electric load, a control system comprising:

a. means for sensing the values of predetermined turbine operating parameters;

b. means for developing speed control signals for startup and synchronization of said turbine, said means for developing including (i) means for producing turbine speed program signals which are a function of at least one of said parameters, and (ii) means for generating said speed control signals in response to said speed program signals;

c. means for regulating the flow of steam from said steam generator to said turbine;

d. means for providing inputs representative of desired turbine load when said system is supplying said electric load;

e. means for developing load control signals as a function of said load inputs; and f. means, responsive to said speed control signals and said load control signals, for continuously operating said means for regulating, whereby steam flow is controlled as an intermediate variable, and turbine speed is controlled as an end variable when said turbine is in startup and turbine load is controlled as an end variable when said turbine is delivering load.

38. A system as described in claim 37, wherein said means for developing comprises a digital computer having a central processing unit with an interconnected memory, said computer being programmed to perform the functions of said means for developing in accordance with a predetermined priority schedule.

39. The system as described in claim 37, wherein said means for developing is further characterized in that said speed program signals comprise speed sequencing signals for automatically sequencing turbine speed during startup.

40. The system as described in claim 39, wherein said means for developing is further characterized in that said speed program signals include signals for holding turbine speed at a plurality of predetermined speed levels.

41. A system as described in claim 10, wherein said means for developing comprises means for monitoring said parameters for each respective speed level, when speed is held at one of said speed levels.

42. A system as described in claim 41, wherein one of said speed levels is the heat soak speed level.

43. The system as described in claim 42, wherein one of said speed levels is the speed for transfer from throttle valve to governor valve mode of steam control.

* * * * *